US008520036B2

(12) United States Patent
Miyata et al.

(10) Patent No.: US 8,520,036 B2
(45) **Date of Patent: *Aug. 27, 2013**

(54) DISPLAY DEVICE, LIQUID CRYSTAL MONITOR, LIQUID CRYSTAL TELEVISION RECEIVER, AND DISPLAY METHOD

(75) Inventors: Hidekazu Miyata, Nagoya (JP); Tomoyuki Ishihara, Tenri (JP); Kazunari Tomizawa, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 283 days.

This patent is subject to a terminal disclaimer.

(21) Appl. No.: 13/064,069

(22) Filed: Mar. 4, 2011

(65) Prior Publication Data

US 2011/0157477 A1 Jun. 30, 2011

Related U.S. Application Data

(62) Division of application No. 11/038,067, filed on Jan. 21, 2005, now Pat. No. 7,932,915.

(30) Foreign Application Priority Data

Jan. 21, 2004 (JP) ..... 2004-013391
Jan. 20, 2005 (JP) ..... 2005-012329

(51) Int. Cl.
*G09G 5/10* (2006.01)
*G09G 3/36* (2006.01)

(52) U.S. Cl.
USPC ..... 345/690; 345/89; 345/204

(58) Field of Classification Search
USPC ..... 345/690–699, 87–104, 204–215
See application file for complete search history.

(56) References Cited

U.S. PATENT DOCUMENTS 5,142,379 A * 8/1992 Jung et al. ..... 386/224
5,923,310 A 7/1999 Kim (Continued)

FOREIGN PATENT DOCUMENTS

EP 1 553 553 7/2005
JP 05-068221 A 3/1993

(Continued)

OTHER PUBLICATIONS

"New Color Science Handbook: Second Edition", University of Tokyo Press, published on Jun. 10, 1998.

(Continued)

*Primary Examiner* — Kevin M Nguyen
*Assistant Examiner* — Cory Almeida
(74) *Attorney, Agent, or Firm* — Harness, Dickey & Pierce, P.L.C.

(57) ABSTRACT

A control section divides a single frame so that a ratio of a period corresponding to a latter sub-frame and a period corresponding to a former sub-frame ranges from 1:3 to 1:7. A divisional point of the frame is a point which allows each of the latter sub-frame and the former sub-frame to minimize a difference between an actual brightness and an expected brightness. The frame may thus be divided at the point where the difference is largest in the normal hold display, so that it is possible to minimize the difference at this point. On this account, it is possible to reduce the difference in a single frame substantially by half as compared with an arrangement for carrying out the normal hold display, and thereby suppress the excess brightness caused by the difference.

28 Claims, 20 Drawing Sheets

(56) References Cited

U.S. PATENT DOCUMENTS

| | | | | |
|---|---|---|---|---|
| 6,473,117 | B1 | 10/2002 | Iba | |
| 2001/0026256 | A1 | 10/2001 | Sugiyama | |
| 2002/0003520 | A1 | 1/2002 | Aoki | |
| 2002/0036625 | A1 | 3/2002 | Nakamura | |
| 2002/0126111 | A1 | 9/2002 | Ozawa | |
| 2003/0006951 | A1 | 1/2003 | Ito | |
| 2003/0006952 | A1* | 1/2003 | Hong | 345/89 |
| 2003/0006954 | A1 | 1/2003 | Iba | |
| 2003/0146893 | A1 | 8/2003 | Sawabe | |
| 2003/0227429 | A1* | 12/2003 | Shimoshikiryo | 345/90 |
| 2003/0234904 | A1 | 12/2003 | Matsuda et al. | |
| 2004/0001167 | A1 | 1/2004 | Takeuchi et al. | |
| 2004/0155847 | A1 | 8/2004 | Taoka et al. | |
| 2004/0239698 | A1 | 12/2004 | Kamada et al. | |
| 2005/0035939 | A1* | 2/2005 | Akiyama | 345/102 |

FOREIGN PATENT DOCUMENTS

| | | | |
|---|---|---|---|
| JP | 2001-042282 | | 2/2001 |
| JP | 2001-133753 | | 5/2001 |
| JP | 2001-296841 | A | 10/2001 |
| JP | 2002-023707 | A | 1/2002 |
| JP | 2003-295160 | A | 10/2003 |
| JP | 2004-21069 | | 1/2004 |
| JP | 2004-062146 | A | 2/2004 |
| JP | 2004-078157 | A | 3/2004 |
| JP | 2004-240317 | | 8/2004 |
| JP | 2004-258139 | A | 9/2004 |
| JP | 2004-302270 | | 10/2004 |
| KR | 2002-0072226 | | 9/2002 |
| TW | 486586 | | 5/2002 |
| TW | 574826 | | 2/2004 |

OTHER PUBLICATIONS

European Search Report.

* cited by examiner

DISPLAY DEVICE, LIQUID CRYSTAL MONITOR, LIQUID CRYSTAL TELEVISION RECEIVER, AND DISPLAY METHOD

The present application is a divisional under 35 U.S.C. §§120/121 of U.S. application Ser. No. 11/038,067 filed on Jan. 21, 2005, now U.S. Pat. No. 7,932,915 which claims priority under 35 U.S.C. §119(a) on Patent Application No. 2004/013391 filed in Japan on Jan. 21, 2004 and on Patent Application No. 2005-12329 filed in Japan on Jan. 20, 2005, the entire contents of each of which are hereby incorporated herein by reference.

FIELD OF THE INVENTION

The present invention generally relates to a display device for displaying an image. Preferably, it relates to a display device displaying by using first and second sub-frames obtained by dividing a single frame.

BACKGROUND OF THE INVENTION

In recent years, a liquid crystal display device, particularly a color liquid crystal display device including a TN mode liquid crystal display panel (TN mode liquid crystal panel, TN panel), has come to be commonly used in a field where a CRT (Cathode Ray Tube) has been used.

For example, document 1 (listed hereafter) discloses a liquid crystal display device that switches driving methods of a TN panel in accordance with whether an image to be displayed is a video image or a still image.

Incidentally, such a TN panel has a problem in its viewing angle property, as compared with a CRT.

As a viewing angle (angle with respect to the panel; an angle with respect to a normal direction of the panel) becomes wider, a gradation property varies. Accordingly, there occurs gradation reverse at some angles.

In light of this, what have been conventionally developed are (i) a technique for improving the viewing angle property by using an optical film and (ii) a technique for restraining the gradation reverse by devising display methods.

For example, disclosed in each of documents 2 and 3 (listed hereafter) is a method for improving the viewing angle by dividing a single frame so that a plurality of signal writings are carried out with respect to one pixel, and by combining the voltage levels of the signal writings.

Further, a liquid crystal display panel such as a TV (television receiver) requires a wide viewing angle. Therefore, for acquirement of the wide viewing angle, such a liquid crystal display panel adopts a liquid crystal of the IPS (In-Plane-Switching) mode, the VA (Vertical Alignment) mode, or the like, instead of the TN mode.

For example, a liquid crystal panel (VA panel) adopting the VA mode realizes a contrast of 10 or greater at an angle of 170° or less vertically and horizontally with respect to the VA panel, and prevents the gradation reverse.

Document 1: Japanese Laid-Open Patent Publication Tokukai 2002-23707 (published on Jan. 25, 2002);

Document 2: Japanese Laid-Open Patent Publication Tokukaihei 05-68221/1993 (published on Mar. 19, 1993);

Document 3: Japanese Laid-Open Patent Publication Tokukai 2001-296841 (published on Oct. 26, 2001);

Document 4: Japanese Laid-Open Patent Publication Tokukai 2004-78157 (published on Mar. 11, 2004);

Document 5: Japanese Laid-Open Patent Publication Tokukai 2003-295160 (published on Oct. 15, 2003);

Document 6: Japanese Laid-Open Patent Publication Tokukai 2004-62146 (published on Feb. 26, 2004);

Document 7: Japanese Laid-Open Patent Publication Tokukai 2004-258139 (published on Sep. 16, 2004); and Document 8: Color Science Handbook, second edition, (University of Tokyo Press; published on Jun. 10, 1998).

However, even the VA panel which is thought to realize a wide viewing angle, cannot completely eliminate variation in the gradation property, due to variation in the viewing angle. For example, the wider the viewing angle is in a horizontal direction, the more the gradation property is deteriorated.

That is, as illustrated in FIG. 2, when changing the viewing angle from 0° (front of the panel) to 60°, a gradation γ property accordingly varies, thereby causing such an excess brightness phenomenon that a luminance in halftone becomes excessively high.

Also in a liquid crystal display panel adopting the IPS mode, its gradation property varies to some extent as the viewing angle is wider though the variation of the gradation property depends on how an optical characteristic of an optical film is designed.

SUMMARY OF THE INVENTION

An embodiment of the present invention was made with the foregoing conventional problem in mind. Further, an object of an embodiment of the present invention is to provide a display device which can suppress the excess brightness.

A display device (present display device) of an embodiment of the present invention includes, (a) dividing a single frame into m number of sub-frames, where m is an integer not less than 2, so as to display an image, said display device is characterized by including:

(b) a display section for displaying an image whose luminance is based on a luminance gradation of a display signal that has been inputted; and (c) a control section for generating first to m-th display signals which are display signals in first to m-th sub-frames so that division of the frame does not vary a total luminance outputted from the display section in a single frame and for outputting the first to m-th display signals to the display section, wherein (d) the control section is designed so that the control section sets a luminance gradation of at least one of the first to m-th display signals to "a minimum value or a value smaller than a first predetermined value" or "a maximum value or a value larger than a second predetermined value" and adjusts a luminance gradation of each of other display signals so as to display an image.

An embodiment of the present display device displays an image by using the display section provided with a display screen such as a liquid crystal panel.

Further, an embodiment of the present display device drives the display section by carrying out sub-frame display. Here, the sub-frame display is a display method in which a single frame is divided into a plurality of (in the present display device, m number of) sub-frames (the first to m-th sub-frames) so as to display an image.

That is, the control section outputs display signals to the display section m times (sequentially outputs the first to m-th display signals which are display signals in the first to m-th sub frames).

On this account, the control section turns ON all gate lines of the display screen of the display section once in each sub-frame period (turns ON the gate line m times in each frame).

Further, in one exemplary embodiment, the control section obtains an output frequency (clock) of each display signal by multiplying a normal hold display output frequency by m (obtains an m-fold clock).

Note that, the normal hold display is normal display which is carried out without dividing a single frame into sub-frames (display which is carried out by turning ON all gate lines of the display screen only once in each frame period).

Further, the display section (display screen) is designed so as to display an image whose luminance is based on a luminance gradation of the display signal that has been inputted from the control section.

Further, the control section generates the first to m-th display signals (sets luminance gradations of these display signals) so that division of the frame does not vary a total luminance (entire luminance) outputted from the screen in a single frame.

Normally, in the display screen of the display section, a difference (brightness difference) between an actual brightness and an expected brightness at a wide viewing angle is sufficiently small in case of setting a brightness (and a luminance) of the image to "a minimum value or a value smaller than a first predetermined value" or "a maximum value or a value larger than a second predetermined value".

Here, it is natural that the brightness difference can be made smallest in case where the luminance gradation is minimum or maximum. However, actually, it is found that it is possible to obtain the same effect merely by bringing the luminance gradation close to minimum or maximum (for example, merely setting the luminance gradation to not more than 0.02% or more than 80% of the maximum).

Here, the "brightness" refers to, for example, a degree of brightness sensed by a human according to a luminance of a displayed image (see equations (5) and (6) in embodiments described later). Note that, in case where a total luminance obtained in a single frame does not vary, also a brightness obtained in a single frame does not vary.

Further, the "expected brightness" refers to, for example, a brightness that should be displayed in a displayed image (a value corresponding to a luminance gradation of the display signal).

Further, the "actual brightness" refers to, for example, a brightness actually displayed in the image, and is a value which varies depending on a viewing angle. In front of the image, the actual brightness and the expected brightness are equal with each other, so that there is no brightness difference. Meanwhile, the brightness difference is larger as the viewing angle is wider.

Further, in an embodiment of the present display device, when displaying an image, the control section sets a luminance gradation of at least one of the first to m-th display signals to "a minimum value or a value smaller than a first predetermined value" or "a maximum value or a value larger than a second predetermined value", and adjusts a luminance gradation of each of other display signals, so as to carry out the gradation expression.

Thus, it is possible to sufficiently reduce the brightness difference in at least a single sub-frame. On this account, an embodiment of the present display device can suppress the brightness difference as compared with the case of carrying out the normal hold display, so that it is possible to improve the viewing angle property. Thus, it is possible to favorably suppress the excess brightness.

For a fuller understanding of the nature and advantages of the invention, reference should be made to the ensuing detailed description taken in conjunction with the accompanying drawings.

BRIEF DESCRIPTION OF THE DRAWINGS

FIG. 12(*b*) is a graph illustrating transition of a voltage (liquid crystal voltage) applied to the liquid crystal in case where polarities of the voltage are differentiated from each other at a sub-frame cycle.

FIG. 18(*b*) is a graph illustrating a liquid crystal voltage in a sub-pixel (bright pixel) whose luminance becomes high in the pixel-division driving. Further, FIG. 18(*c*) is a graph illustrating a liquid crystal voltage in a sub-pixel (dark pixel) whose luminance becomes low in the pixel-division driving.

DESCRIPTION OF THE EMBODIMENTS

One embodiment of the present invention will be described below.

A liquid crystal display device (present display device) according to the present embodiment includes a liquid crystal panel that adopts the vertical alignment (VA) mode and that is divided into a plurality of domains.

The present display device serves as a liquid crystal monitor displaying an image based on an image signal, sent from outside, on the liquid crystal display panel.

Figure 1:
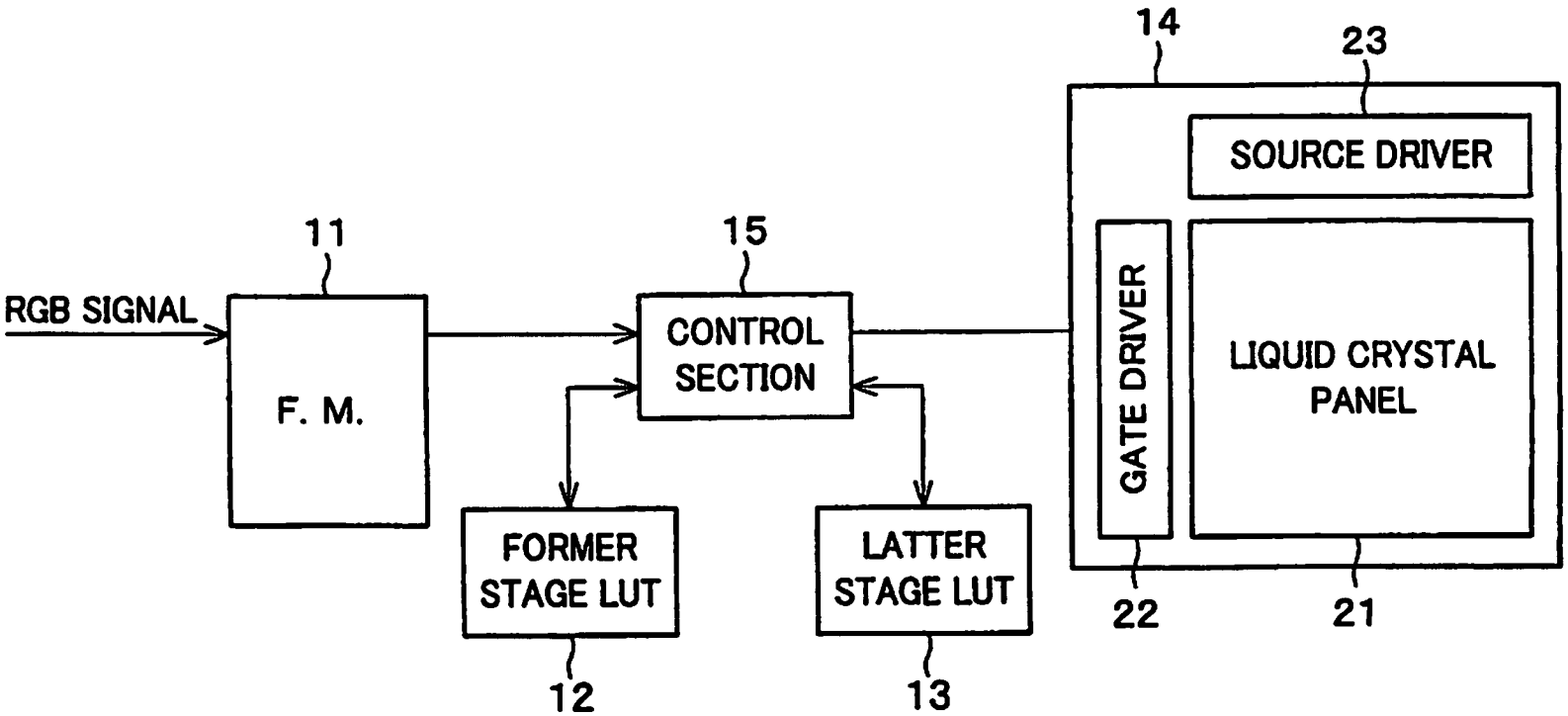
FIG. 1 is a block diagram illustrating an arrangement of a display device according to one embodiment of the present invention.

FIG. 1 is a block diagram illustrating an inside structure of the present display device.

As illustrated in FIG. 1, the present display device includes a frame memory (F.M.) 11, a former stage LUT 12, a latter stage LUT 13, a display section 14, and a control section 15.

The frame memory (image signal input section) 11 accumulates image signals (RGB signals), sent from an outer signal source, that correspond to a single frame.

Each of the former stage LUT (look-up table) 12 and the latter stage LUT 13 is a relation table (conversion table) indicative of a relationship between (i) each of the image signals sent from outside and (ii) each of display signals to be sent to the display section 14.

Note that, the present display device carries out a sub-frame display. Here, the sub-frame display refers to a way of a display using a plurality of sub-frames obtained by dividing a single frame.

In other words, the present display device is designed so as to carry out a display in accordance with the image signals, inputted during a single frame period, that correspond to a single frame, and so as to carry out a display at a frequency twice as large as a frequency of each image signal by using two sub-frames whose sizes (periods) are the same.

The former stage LUT 12 is the relation table for a display signal (former stage display signal; second display signal) outputted in a former stage sub-frame (front sub-frame; second sub-frame). The latter stage LUT 13 is the relation table for a display signal (latter stage display signal; first display signal) outputted in a latter stage sub-frame (latter sub-frame; first sub-frame).

The display section 14 includes a liquid crystal panel 21, a gate driver 22, and a source driver 23 as illustrated in FIG. 1, and displays an image in accordance with the received displaying signals.

Here, the liquid crystal panel 21 is an active matrix (TFT) liquid crystal panel adopting the VA mode.

The control section 15 is a central section of the present display device, and controls all the operations in the present display device. The control section 15 generates the display signals based on the image signals accumulated in the frame memory 11, by using the former stage LUT 12 and the latter stage LUT13. Then, the control section 15 sends the generated display signals to the display section 14.

Namely, the control section 15 accumulates, in the frame memory 11, the image signals sent at a normal output frequency (normal clock; for example, 25 MHz). Then, the control section 15 outputs each of the image signals from the frame memory 11 twice at a clock (doubled clock; 50 MHz) twice as high as the normal clock.

Then, the control section 15 generates the former stage display signal, in accordance with the image signal firstly outputted, by using the former stage LUT 12. Thereafter, the control section 15 generates the latter stage display signal, in accordance with the image signal secondly outputted, by using the former stage LUT 13. The control section 15 sequentially sends, at a doubled clock, the display signals to the display section 14.

On this account, the display section 14 displays two different images, one at a time during the single frame period in accordance with the display signals. In other words, all the gate lines in the liquid crystal liquid crystal panel 21 turn ON once during each of the sub-frame periods.

Note that, operation for outputting the display signals will be described in detail later.

Here, how the control section 15 generates the former stage and latter stage display signals is explained as follows.

Firstly explained is a general display luminance (luminance of an image displayed on a panel) in the liquid crystal display panel.

In case of displaying an image based on ordinary 8-bit data by using a single frame instead of the sub-frames (in case of carrying out a normal hold display, i.e., in case of turning ON all the gate lines in the liquid crystal panel only once during a single frame period), a luminance gradation (signal gradation) of the display signal falls within a range from 0 to 255.

The signal gradation and the display luminance in the liquid crystal panel are approximately expressed by the following equation (1):

$$(a)((T-T0)/(T\max-T0))=(L/L\max)\hat{}\gamma \quad (1)$$

In the equation (1), L indicates the signal gradation (frame gradation) in the case of displaying image in the single frame (in the case of displaying an image in accordance with the normal hold display); Lmax indicates a maximum luminance gradation (255); T indicates a display luminance; Tmax indicates a maximum luminance (luminance when L=Lmax=255 is satisfied; white); T0 indicates a minimum luminance (luminance when L is 0; black); and γ is a correction value (normally, 2.2).

Note that, T0 is not actually 0 in the liquid crystal panel 21, however, for ease of explanation, the following description assumes that T0 is 0.

Figure 2:
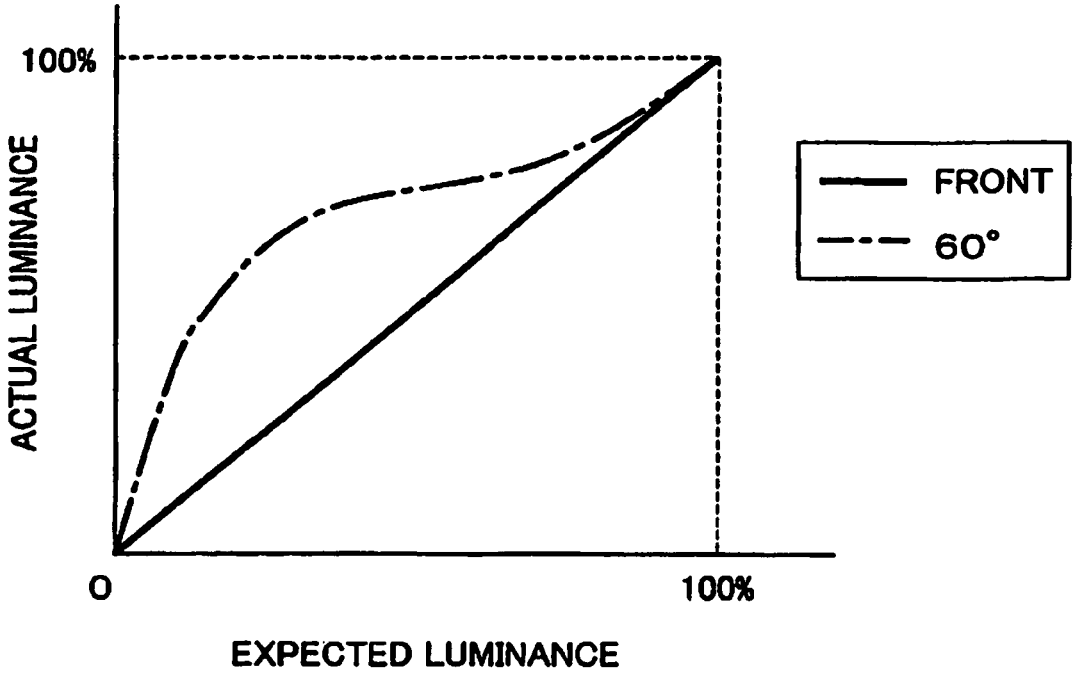
FIG. 2 is a graph illustrating a display luminance (a relationship between an expected luminance and an actual luminance) outputted from a liquid crystal panel in case of normal hold display.

Further, the display luminance T to be obtained in the liquid crystal panel 21 is illustrated in a graph of FIG. 2.

A horizontal axis of the graph indicates "a luminance (expected luminance; value that corresponds to the signal gradation; equivalent to the display luminance T) which is supposed to be obtained." A vertical axis of the graph indicates "a luminance (actual luminance) that is actually obtained."

In this case, in front of the liquid crystal panel 21 (i.e., at a viewing angle of 0°), the expected luminance and the actual luminance are equal to each other as illustrated in the graph.

However, at a viewing angle of 60°, the actual luminance seems to become higher in a halftone luminance due to a change in a gradation γ property.

Next, the display luminance in the present display device is explained.

In the present display device, the control section 15 is designed so as to carry out the gradation expression while satisfying the following conditions (a) and (b):

(a) "a total (integrated luminance in the single frame) of (i) the luminance (display luminance) of the image displayed in the former sub-frame by the display section 14 and (ii) the luminance (display luminance) of the image displayed in the latter sub-frame by the display section 14 is equal to the display luminance in the single frame in the case of carry out the normal hold display," and (b) "one of the sub-frames is set to be black (minimum luminance) or white (maximum luminance)."

In order to satisfy the conditions (a) and (b), the present display device is designed so that: the control section 15 divides a single frame into two sub-frames, and uses one of the sub-frames so as to display an image whose luminance is not more than the half of the maximum luminance.

That is, when outputting an image whose luminance is not more than the half (threshold luminance; Tmax/2) of the maximum luminance in a single frame (i.e., when the luminance is low), the control section 15 sets the luminance in the former sub-frame to be the minimum luminance (black) and adjusts only the display luminance in the latter sub-frame so as to carry out the gradation expression. In other words, when the luminance is low, the control section 15 carries out the gradation expression by using only the latter sub-frame.

In this case, the integrated luminance in the frame is represented by the following equation: "(the minimum luminance+the luminance in the latter sub-frame)/2."

Further, when outputting an image whose luminance is higher than the threshold luminance (i.e., when the luminance is high), the control section 15 sets the luminance in the latter sub-frame to be the maximum luminance (white) and adjusts the display luminance in the former sub-frame so as to carry out the gradation expression.

In this case, the integrated luminance in the frame is represented by the following equation: "(the luminance in the former sub-frame+the maximum luminance)/2."

The following description specifically explains a signal gradation setting carried out with respect to the display signals (the former stage display signal and the latter stage display signal) for acquirement of such display luminance.

Note that, the signal gradation setting is carried out by the control section 15 illustrated in FIG. 1.

The control section 15 calculates, in advance, a frame gradation that corresponds to the threshold luminance (Tmax/2) by using the aforementioned equation (1).

That is, the frame gradation (threshold luminance gradation; Lt) that corresponds to such display luminance is found in accordance with the equation (1):

$$(a)Lt=0.5\hat{}(1/\gamma)\times L\max \quad (2) \text{ and,}$$

$$(b)L\max=T\max\hat{}\gamma \quad (2a)$$

Further, in displaying an image, the control section 15 determines a frame gradation L in accordance with the image signal sent from the frame memory 11.

When L is equal to or smaller than Lt, the control section 15 sets the luminance gradation (F) of the former display signal to be the minimum value (0) by using the former stage LUT 12.

Meanwhile, the control section 15 sets, in accordance with the equation (1), the luminance gradation (R) of the latter stage display signal by using the latter stage LUT 13 so that the luminance gradation R satisfies the following equation (3).

$$(a)R=0.5\hat{}(1/\gamma)\times L \quad (3)$$

When the frame gradation L is larger than Lt, the control section 15 sets the luminance gradation R of the latter display signal to be the maximum value (255).

Meanwhile, the control section 15 carries out a setting in accordance with the equation (1) so that the luminance gradation F of the former sub-frame satisfies the following equation (4).

$$(a)F=(L\hat{}\gamma-0.5\times L\max\hat{}\gamma)\hat{}(1/\gamma) \quad (4)$$

Next, the following description explains, more in detail, the operation for outputting the display signals in the present display device. Note that, the following description assumes the number of pixels in the liquid crystal panel 21 is a×b.

In this case, the control section 15 accumulates, in a source driver 23 at the doubled clock, the former stage display signals that correspond to a-number of pixels in a first gate line.

Then, the control section 15 causes the gate driver 22 to turn ON the first gate line so that the former stage display signals are written in the pixels in the first gate line. Thereafter, the control section 23 sequentially accumulates, in the source driver 23, the former stage display signals that respectively correspond to second to b-th gate lines, and sequentially turns ON the second to the b-th gate lines at a doubled clock. On this account, it is possible to write the former stage display signals in all the pixels during a period (½ frame period) that corresponds to the half of the frame.

Further, the control section 15 carries out a similar operation during the other ½ frame period so as to write the latter stage display signals in the pixels of all the gate lines.

On this account, a length of time (½ frame period) for writing each of the former stage display signals in each pixel is equal to that (½ frame period) for writing each of the latter stage display signals in each pixel.

Figure 3:
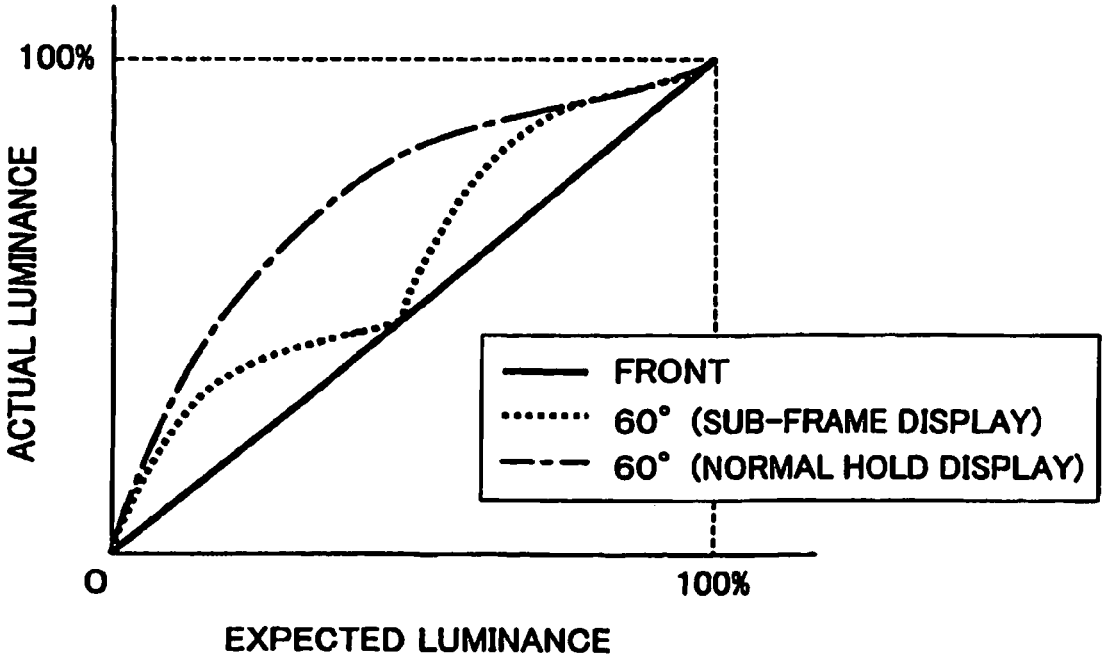
FIG. 3 is a graph illustrating a display luminance (a relationship between an expected luminance and an actual luminance) outputted from the liquid crystal panel in case of carrying out sub-frame display in the display device illustrated in FIG. 1.

FIG. 3 illustrates (i) a result (indicated by a broken line and a continuous line) in case where the sub-frame display is carded out, that is, in case where the former stage display signals are written during the former sub-frame period and the latter stage display signals are written during the latter sub-frame period and (ii) the result (indicated by a chain line and the continuous line) illustrated in FIG. 2.

As illustrated in FIG. 2, the liquid crystal panel 21 of the present display device is such a liquid crystal display panel that the difference between (i) the actual luminance and (ii) the expected luminance (equal to a luminance indicated by the continuous line) at the wide viewing angle is minimum (0) when the display luminance is minimum or maximum, and that the difference therebetween is largest in a half-tone luminance (in the vicinity of the threshold luminance).

Further, the present display device carries out the sub-frame display, which uses the sub-frames obtained by dividing the frame.

Moreover, the present display device sets two sub-frame periods to be equal with each other. When the luminance is low, the present display device carries out the black display in the former sub-frame and uses only the latter sub-frame so that the integrated luminance in the single frame is not varied, thereby displaying an image.

Accordingly, the difference between the actual luminance and the expected luminance becomes minimum in the former sub-frame. Therefore, the total difference in the former sub-frame and in the latter sub-frame is reduced approximately by half as illustrated by the broken line in FIG. 3.

Meanwhile, when the luminance is high, the present display device carries out the white display in the latter sub-frame and adjusts only the former sub-frame so that the integrated luminance in the single frame is not varied, thereby displaying an image.

Accordingly, also in this case, the difference between the actual luminance and the expected luminance becomes minimum in the latter sub-frame. Therefore, the total difference in the former sub-frame and in the latter sub-frame is reduced approximately by half as illustrated by the broken line in FIG. 3.

In this way, the whole difference in the present display device can be reduced approximately by half as compared with the arrangement that carries out the normal hold display (the arrangement that displays an image by using a single frame instead of the sub-frames).

This restrains such a phenomenon (excess brightness phenomenon; see FIG. 2) that an image in halftone luminance becomes bright and pale.

Note that, in the present embodiment, the period that corresponds to the former sub-frame is identical to the period that corresponds to the latter sub-frame. This is because one of the sub-frames is used to display an image whose luminance is not more than the half of the maximum luminance.

However, the sub-frame periods may be set to be values different from each other.

That is, the problematic excess brightness phenomenon in the present display device is such a phenomenon that an image in the halftone luminance becomes bright and pale because the actual luminance at the wide viewing angle has the property illustrated in FIG. 2.

Normally, an image picked up by a camera is converted into a signal based on a luminance. In case where the image is transmitted in a digital form, the image is converted into a display signal by using the correction value γ mentioned in the equation (1) (that is, a value of the luminance is multiplied by (1/γ) and thus multiplied value is equally divided so as to obtain a gradation).

On this account, an image displayed by a display device such as a liquid crystal panel in accordance with such a display signal has the display luminance determined by the equation (1).

Incidentally, a human visual sense recognizes an image as brightness rather than luminance. Moreover, the brightness (psychometric lightness) M can be expressed by the following equations (5) and (6) (see Document 8).

$$M=166\times Y^{(1/3)}-16,\ Y>0.008856 \tag{5}$$

$$M=903.29\times Y,\ Y\leqq 0.008856 \tag{6}$$

Here, Y is equivalent to the aforementioned actual luminance, and is an amount satisfying Y=(y/yn). Note that, y indicates a y-value of tristimulus values of arbitrary xyz color systems, and yn indicates a y-value based on average light of a perfect reflecting diffuser and is determined so as to satisfy yn=100.

These equations represent such a tendency that a human is sensitive to an image which is dark in terms of luminance, and becomes insensitive to an image which is bright in terms of luminance.

Further, it is considered that a human takes the excessive brightness as difference in brightness rather than difference in luminance.

Figure 6:
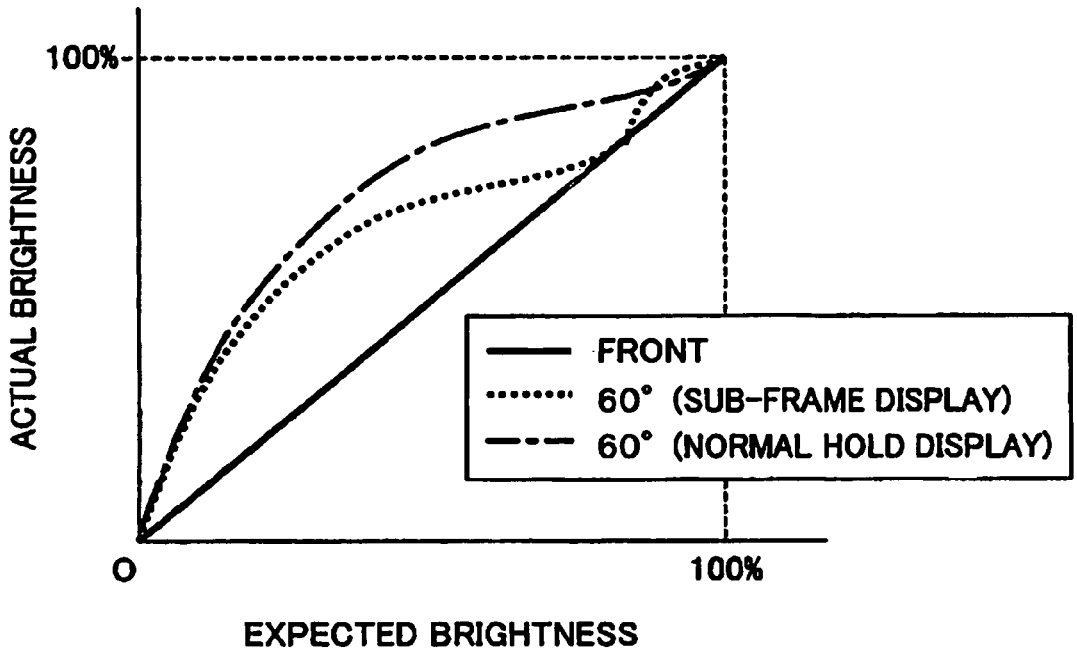
FIG. 6 is a graph illustrating a brightness obtained by converting the luminance graph illustrated in FIG. 3.

Here, FIG. 6 is a graph illustrating brightness converted from the luminance illustrated in the graph of FIG. 3.

A horizontal axis of the graph indicates "brightness (expected brightness; value that corresponds to the signal gradation; equivalent to the psychometric lightness M) supposed to be obtained." A vertical axis of the graph indicates "brightness (actual brightness) that is actually obtained."

As illustrated by a broken line in the graph, the expected brightness and the actual brightness are equal to each other in front of the liquid crystal panel 21 (i.e., at a viewing angle of 0°).

Meanwhile, in a case where the viewing angle is 60° and the sub-frame periods are equal to each other (i.e., one of the sub-frames is used to display an image whose luminance is not more than the maximum value), the difference between the actual brightness and the expected brightness is improved as compared with the conventional case of carrying out the normal hold display. Therefore, restraint of the excess brightness phenomenon is achieved to some extent.

In order to obtain better restraint of the excess brightness phenomenon in terms of a human visual sense, it is preferable to determine a ratio, at which the frame is divided, in accordance with brightness rather than luminance.

Further, as in the case of luminance, the difference between the actual brightness and the expected brightness is largest at a value that is the half of the maximum value of the expected brightness.

For this reason, the difference (i.e., the excess brightness) recognized by a human can be more improved by dividing the frame so that an image whose brightness is not more than the half of the maximum value is displayed in the single sub-frame than by dividing the frame so that an image whose luminance is the half of the maximum value is displayed in the single sub-frame.

Therefore, a preferable value of a divisional point of the frame is explained as follows.

Firstly, for ease of calculation, the aforementioned equations (5) and (6) are approximated so as to obtain the following equation (6a), which is similar to the equation (1) in terms of a form of a mathematical expression.

$$M=Y^{(1/\alpha)} \tag{6a}$$

In the case of converting the equations (5) and (6) into the equation (6a), $\alpha$ in the equation (6a) has a value of approximately 2.5.

If the value of $\alpha$ falls within a range from 2.2 to 3.0, it is considered that a relation between the luminance Y and the psychometric lightness M is appropriate in the equation (6a) (i.e., the relation matches with a human visual sense).

It is found that: in order to display an image whose psychometric lightness M is the half of the maximum value in the single sub-frame, it is preferable to set two sub-frame periods at approximately 1:3 when $\gamma$ is 2.2 and approximately 1:7 when $\gamma$ is 3.0.

Note that, in the case of dividing the frame in this way, a sub-frame used to display an image when the luminance is low (a sub-frame in which the maximum luminance is kept when the luminance is high) is a shorter period.

The following description explains the case where the ratio of (i) the period corresponding to the former sub-frame and (ii) the period corresponding to the latter sub-frame is 3:1.

Firstly explained is the display luminance in this case.

In this case, when carrying out a low luminance display by outputting and displaying, in a single frame, an image whose luminance is not more than ¼ (threshold luminance; Tmax/4) of the maximum luminance, the control section 15 sets a luminance in the former sub-frame to be the minimum luminance (black) and adjusts only the display luminance of the latter sub-frame so as to carry out the gradation expression (the gradation expression is carried out by using only the latter sub-frame).

On this occasion, the integrated luminance in the frame is represented by the following equation: "(the minimum luminance+the luminance in the latter sub-frame)/4."

Further, when outputting an image whose luminance is higher than the threshold luminance (Tmax/4) in a single frame (when the luminance is high), the control section 15 sets the luminance in the latter sub-frame to be the maximum luminance (white) and adjusts the display luminance in the former sub-frame so as to carry out the gradation expression.

In this case, the integrated luminance in the frame is represented by the following equation: "(the luminance in the former sub-frame+the maximum luminance)/4."

Next, the following description specifically explains a signal gradation setting carried out with respect to the display signals (the former stage display signal and the latter stage display signal) for acquirement of the aforementioned display luminance.

Note that, also in this case, the signal gradation (and the below-mentioned outputting operation) is determined so as to satisfy the aforementioned conditions (a) and (b).

Firstly, the control section 15 calculates, in advance, the frame gradation that corresponds to the threshold luminance (Tmax/4) by using the equation (1).

Namely, the frame gradation (threshold luminance gradation; Lt) that corresponds to such display luminance is found in accordance with the equation (1) as follows.

$$Lt=(1/4)\hat{}(1/\gamma)\times L\max \quad (7)$$

Further, in displaying an image, the control section 15 determines a frame gradation L in accordance with the image signal sent from the frame memory 11.

When the frame gradation L is equal to or smaller than the frame gradation Lt, the control section 15 sets the luminance gradation F of the former display signal to be the minimum value (0) by using the former stage LUT 12.

On the other hand, the control section 15 sets, in accordance with the equation (1), the luminance gradation R of the latter stage display signal by using the latter stage LUT 13 so that the luminance gradation R satisfies the following equation (8).

$$R=(1/4)\hat{}(1/\gamma)\times L \quad (8)$$

When the frame gradation L is larger than Lt, the control section 15 sets the luminance gradation R of the latter display signal to be the maximum value (255).

On the other hand, the control section 15 sets the luminance gradation F of the former sub-frame in accordance with the equation (1) so that the luminance gradation F satisfies the following equation (9).

$$F=(L\hat{}\gamma-(1/4)\times L\max\hat{}\gamma)\hat{}(1/\gamma) \quad (9)$$

The following description explains the operation for outputting the former stage display signal and the latter stage display signal.

As described above, in the arrangement equally dividing the frame, the time (½ frame period) in which the former stage display signals are written in the pixels is equal to the time (½ frame period) in which the latter stage display signals are written in the pixels.

A reason for this is as follows. That is, after finishing writing all the former stage display signals at a doubled clock, the latter stage display signals are written, so that a period in which the gate lines corresponding to the former stage display signals are ON is equal to a period in which the gate lines corresponding to the latter stage display signals are ON.

Therefore, the divisional ratio can be changed by changing a timing at which the writing of the latter stage display signals starts (a timing at which the gate lines corresponding to the latter stage display signals are turned ON).

Figure 4:
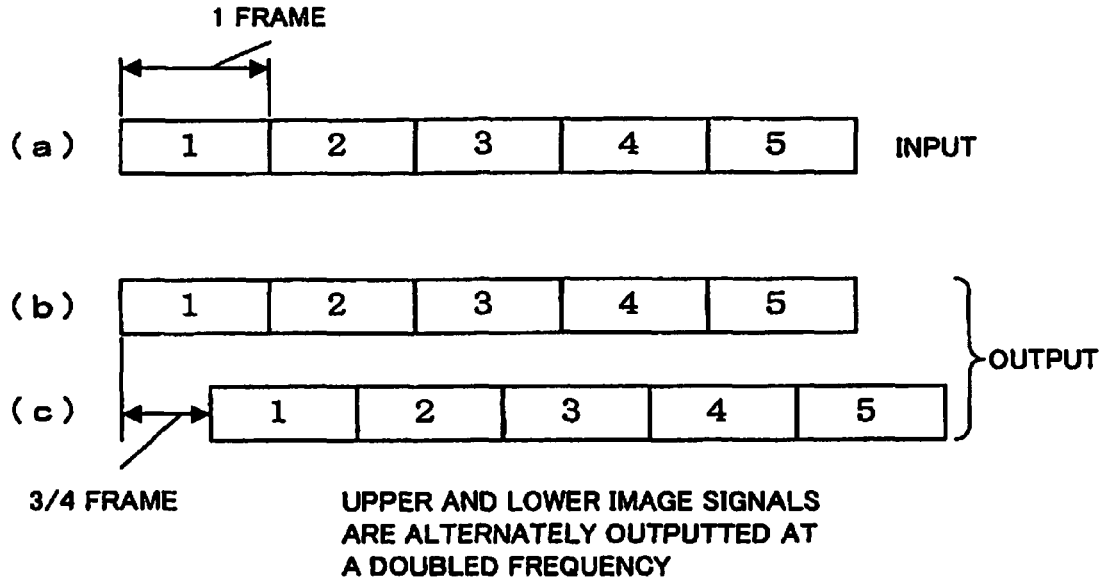
FIG. 4 illustrates an image signal inputted to a frame memory of the display device illustrated in FIG. 1, and illustrates an image signal outputted from the frame memory to a former stage LUT and an image signal outputted from the frame memory to a latter stage LUT in case of dividing a frame at 3:1.

FIG. 4(*a*) illustrates the image signal sent to the frame memory 11. FIG. 4(*b*) is an explanatory diagram illustrating each of the image signals sent from the frame memory 11 to the former stage LUT 12 in the case where the divisional ratio is 3:1. FIG. 4(*c*) is an explanatory diagram illustrating each of the image signals sent from the frame memory 11 to the latter stage LUT 13 in this case.

Figure 5:
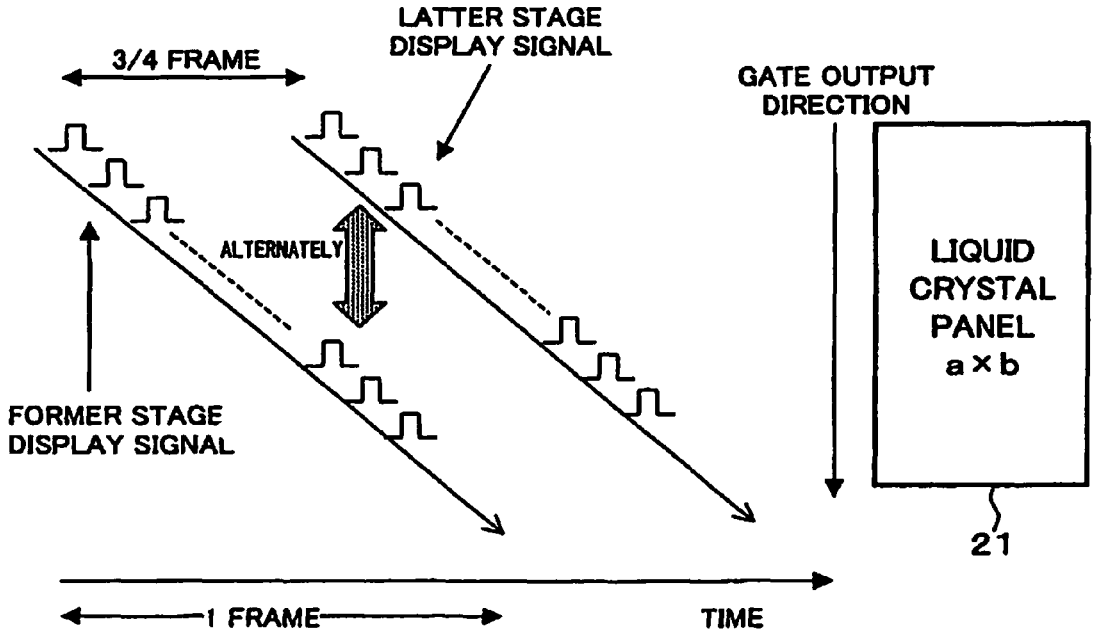
FIG. 5 illustrates timings at which a gate line concerning a former stage display signal is turned ON and a gate line concerning a latter stage display signal is turned ON in case of dividing the frame at 3:1 in the display device illustrated in FIG. 1.

FIG. 5 is an explanatory diagram illustrating (i) the timing at which the gate lines corresponding to the former display signals are turned ON and (ii) the timing at which the gate lines corresponding to the latter display signals are turned ON in the case where the divisional ratio is 3:1.

As illustrated in these figures, in this case, the control section 15 writes the former stage display signals, corresponding to a first frame, in the gate lines at a normal clock.

After ¾ frame period later, the writing of the latter display signals starts. Thereafter, the display signals and the latter display signals are alternately written at a doubled clock.

In other words, after finishing writing the former display signals in the pixels corresponding to a "number of all the gate lines×¾"-th gate line, the control section 15 accumulates, in the source driver 23, the latter display signals that correspond to pixels in a first gate line, and then turns ON the first gate line. Next, the control section 15 accumulates, in the source driver 23, the former display signals that correspond to pixels in a gate line indicated by "number of all the gate lines×¾"+1, and then turns ON the gate line.

By alternately outputting the former display signals and the latter display signals at a doubled clock in this way after the ¾ frame period of the first frame, the divisional ratio of the former sub-frame and the latter sub-frame can be 3:1.

And, a total (total obtained by integration) of the display luminance of the sub-frames in the two sub-frames is the integrated luminance of the frame.

Note that the data accumulated in the frame memory 11 is sent to the source driver 23 in synchronization with the gate timing.

Figure 7:
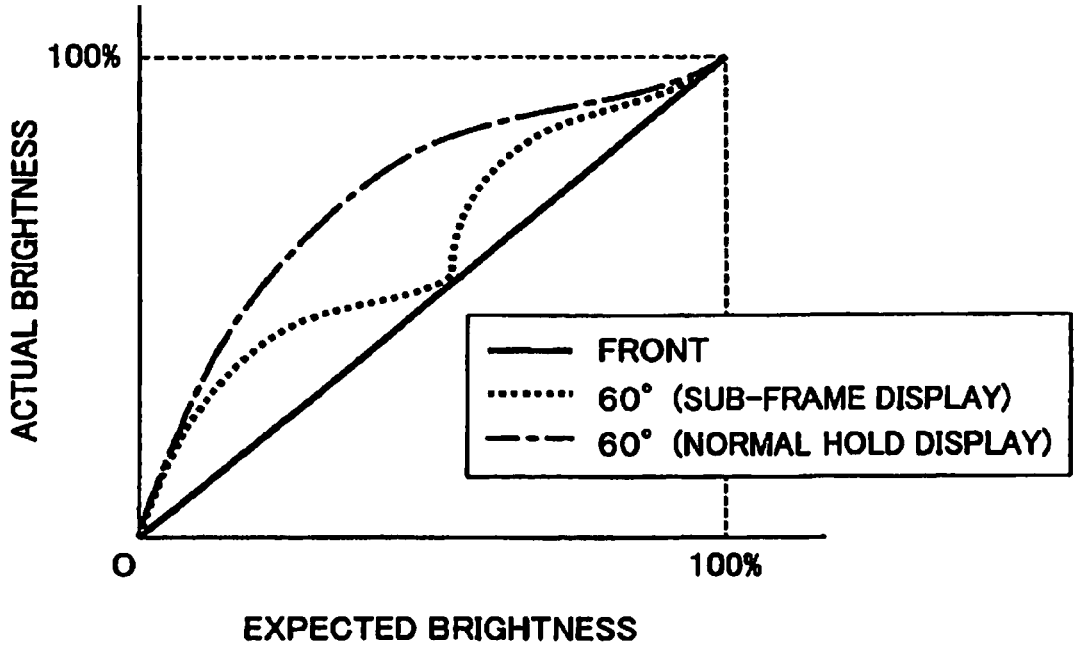
FIG. 7 is a graph illustrating a relationship between an expected brightness and an actual brightness in case of dividing the frame at 3:1 in the display device illustrated in FIG. 1.

FIG. 7 is a graph illustrating a relationship between the expected brightness and the actual brightness in the case of dividing the frame at the ratio of 3:1.

As illustrated in FIG. 7, with this arrangement, the frame is divided at a point where the difference between the expected brightness and the actual brightness is largest. Therefore, the difference between the expected brightness and the actual brightness at a viewing angle of 60° is much smaller than the difference illustrated in FIG. 6.

Therefore, when the luminance (brightness) is so low as to be not more than "Tmax/4", the present display device carries out the black display in the former sub-frame and uses only the latter sub-frame so that the integrated luminance of the frame is not varied, thereby displaying an image.

Accordingly, the difference (between the actual brightness and the expected brightness) in the former sub-frame is minimized, so that the total difference in the former sub-frame and in the latter sub-frame is reduced approximately by half as illustrated by a broken line in FIG. 7.

On the other hand, when the luminance (brightness) is high, the present display device sets the luminance of the latter sub-frame to be the white display and adjusts only the luminance of the former sub-frame so that the integrated luminance of the frame is not varied, thereby displaying an image.

Accordingly, also in this case, the difference in the latter sub-frame is minimized, so that the total difference in the former sub-frame and in the latter sub-frame is reduced approximately by half as illustrated by the broken line in FIG. 7.

In this way, the present display device reduces the total difference in the brightness approximately by half as compared with the arrangement that carries out the normal hold display.

This allows more effective restraint of such a phenomenon (excess brightness phenomenon; see FIG. 2) that an image in halftone luminance becomes bright and pale.

Here, in the aforementioned arrangement, the former stage display signals of the first frame are written in pixels of the gate lines at normal clock during a period of time from the start of the display to the ¾ frame period. This is because, during the period, a timing for the writing of the latter stage display signal has not come.

However, instead of such a way of displaying an image, doubled-clock display may be carried out from the start of the display, by using a dummy latter stage display signal. Specifically, during the period of time from the start of the displaying to the ¾ frame period, the former stage display signals and the latter display signals (dummy latter stage display signals) whose signal gradation is 0 are alternately outputted.

Here, the following description explains a more general case where the divisional ratio of the former sub-frame and the latter sub-frame is n: 1.

In this case, when outputting an image whose luminance (threshold luminance; Tmax/(n+1)) is not more than the half of the maximum luminance in a single frame (when the luminance is low), the control section 15 sets the luminance in the former sub-frame to be the minimum luminance (black) and adjusts only the display luminance in the latter sub-frame so as to carry out the gradation expression (the control section 15 carries out the gradation expression by using only the latter sub-frame).

In this case, the integrated luminance in the frame is represented by the following equation: "(the minimum luminance+the luminance in the latter sub-frame)/(n+1)."

On the other hand, when outputting an image whose luminance is higher than the threshold luminance (when the luminance is high), the control section 15 sets the luminance in the latter sub-frame to be the maximum luminance (white) and adjusts the display luminance in the former sub-frame so as to carry out the gradation expression.

In this case, the integrated luminance in the frame is represented by the following equation: "(the luminance in the latter sub-frame+the minimum luminance)/(n+1)."

Next, the following description specifically explains a signal gradation setting carried out with respect to the display signals (the former stage display signal and the latter stage display signal) for acquirement of such display luminance.

Note that, also in this case, the signal gradation setting (and an outputting operation) is so set as to satisfy the aforementioned conditions (a) and (b).

Firstly, the control section 15 calculates, in advance, a frame gradation that corresponds to the threshold luminance (Tmax/(n+1)) by using the aforementioned equation (1).

Specifically, the frame gradation (threshold luminance gradation; Lt) that corresponds to such display luminance is found in accordance with the equation (1) as follows.

$$Lt=(1/(n+1))\hat{}(1/\gamma)\times L\max \quad (10)$$

Further, in displaying an image, the control section 15 determines a frame gradation L in accordance with the image signal sent from the frame memory 11.

When the frame gradation L is equal to or smaller than the frame gradation Lt, the control section 15 sets the luminance gradation F of the former display signal to be the minimum value (0) by using the former stage LUT 12.

On the other hand, the control section 15 sets, in accordance with the equation (1), the luminance gradation R of the latter stage display signal by using the latter stage LUT 13 so that the luminance gradation R satisfies the following equation (11).

$$R=(1/(n+1))\hat{}(1/\gamma)\times L \quad (11)$$

When the frame gradation L is larger than the frame gradation Lt, the control section 15 sets the luminance gradation R of the latter display signal to be the maximum value (255).

On the other hand, the control section 15 sets the luminance gradation F of the former sub-frame in accordance with the equation (1) so that the luminance gradation F satisfies the following equation (12).

$$F=(L\hat{}\gamma-(1/(n+1))\times L\max\hat{}\gamma)\hat{}(1/\gamma) \quad (12)$$

In the case of dividing the frame at the divisional ratio of 3:1, the present display device may be designed so as to carry out the operation for outputting the display signals in the following manner. That is, the former stage display signals and the latter stage display signals are alternately outputted at the doubled clock after a period corresponding to n/(n+1) of a first frame.

Further, it is possible to describe the arrangement equally dividing the frame as follows. That is, the frame is divided into "1+n (n=1)" number of sub-frames, and the former display signals are outputted at a clock "1+n (n=1)" times as high as a normal clock during a period corresponding to a single sub-frame, and then the latter display signals are continuously outputted during a period corresponding to the other n-number (n=1) of sub-frame.

However, in this arrangement, when n is 2 or more, a very fast clock is required. This increases a device cost.

Therefore, when n is 2 or more, it is preferable to arrange the present display device so that the former display signals and the latter display signals are alternately outputted.

In this case, because the ratio of the former sub-frame and the latter sub-frame can be n:1 by adjusting an outputting timing of the latter stage display signal, a required clock frequency is maintained at a frequency twice as high as the normal clock frequency.

Further, in the present embodiment, the control section 15 converts the image signals into the display signals by using the former stage LUT 12 and the latter stage LUT 13.

Here, it is possible to provide a plurality of the former stage LUTs 12 and the latter stage LUTs 13 in the present display device.

Figure 8:
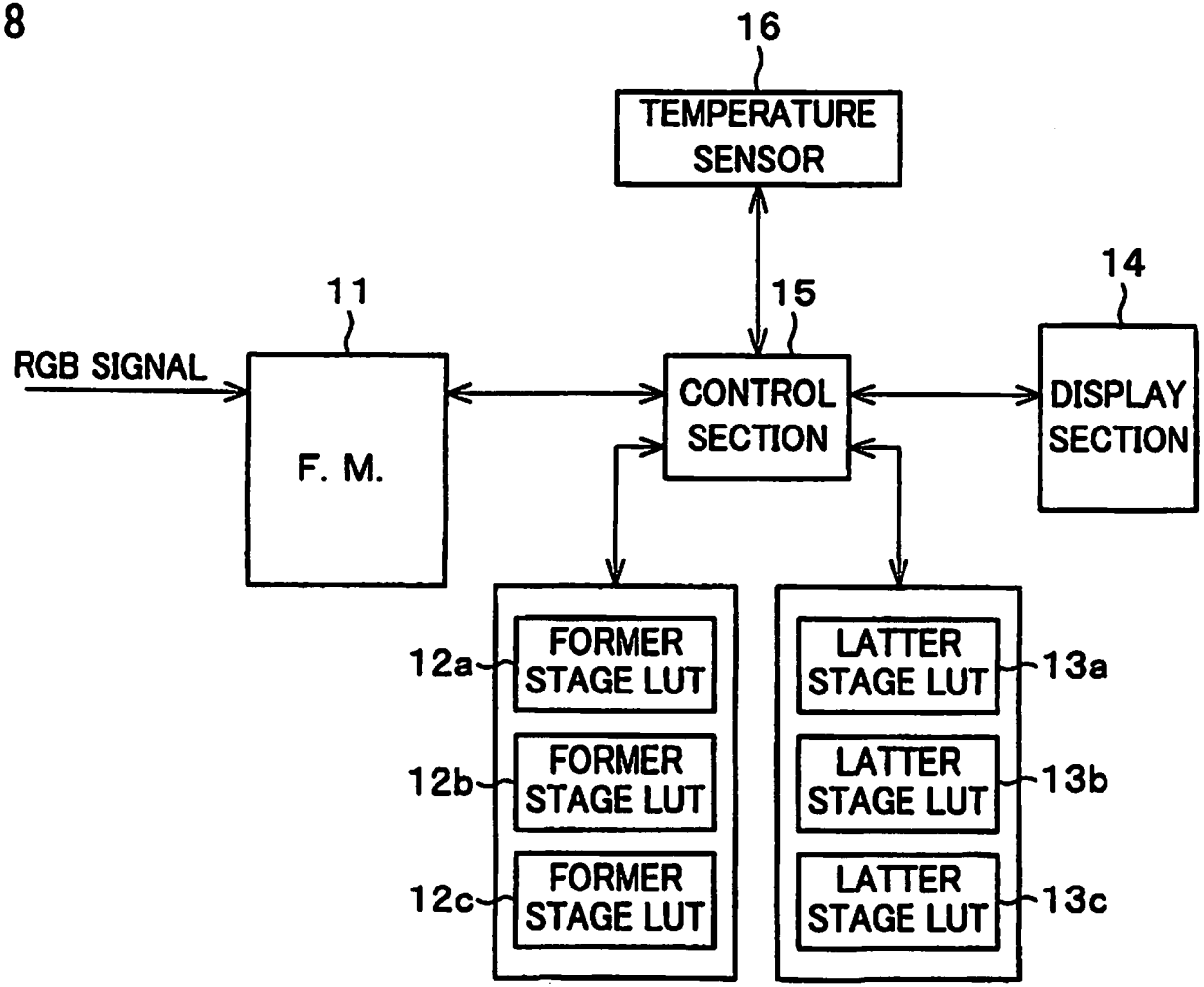
FIG. 8 illustrates a display device obtained by partially varying the arrangement of the display device illustrated in FIG. 1.

FIG. 8 illustrates an arrangement in which three former stage LUTs 12*a* to 12*c* and three latter stage LUTs 13*a* to 13*c* are provided instead of the former stage LUT12 and the latter stage LUT 13 in the arrangement illustrated in FIG. 1, and a temperature sensor 16 is further provided.

That is, the response property and the gradation luminance property of the liquid crystal panel 21 change according to the environmental temperature (temperature (air temperature) of the environment surrounding the display section 14). On this account, an optimal display signal corresponding to the image signal also changes according to the environmental temperature.

Note that, the former stage LUTs 12*a* to 12*c* are the former stage LUTs suitably used in temperature ranges different from each other. Moreover, the latter stage LUTs 13*a* to 13*c* are the latter stage LUTs suitably used in temperature ranges different from each other.

Moreover, the temperature sensor 16 measures the environmental temperature around the present display device, and informs measurement results to the control section 15.

In this arrangement, the control section 15 is designed so as to determine which LUT to use according to information about the environmental temperature informed by the temperature sensor 16. Therefore, this arrangement makes it possible to send a more appropriate display signal, generated from the image signal, to the liquid crystal panel 21. Therefore, the image display can be carried out with appropriate luminance in any temperature ranges assumable (for example, from 0° C. to 65° C.).

Moreover, it is preferable that the liquid crystal panel 21 be driven by an alternating current. This is because, by driving the liquid crystal panel 21 by the alternating current, it is possible to change the electric charge polarity (direction of the voltage (inter-electrode voltage) between the pixel electrodes sandwiching the liquid crystal) of the pixel per frame.

In case of a direct current drive, a biased voltage is applied between the electrodes, so that the electrodes are electrically charged. In cases where this state is continued, a state in which the electric potential difference is generated between the electrodes (a state called "burning") occurs even when a voltage is not applied.

Here, in case of carrying out the sub-frame display like the present display device does, in many cases, values (absolute values) of a voltage applied between the pixel electrodes are different from each other between the sub-frames.

Therefore, in case of changing the polarity of the inter-electrode voltage at a sub-frame cycle, the voltage difference between the former sub-frame and the latter sub-frame causes an applied inter-electrode voltage to be biased. On this account, in case of driving the liquid crystal panel 21 for a long time, the electrodes are electrically charged, so that there is a possibility that the burning, flicker, or the like drawback occurs.

Therefore, in case of the present display device, it is preferable that the polarity of the inter-electrode voltage be changed at a frame cycle.

Note that, there are two methods for changing the polarity of the inter-electrode voltage at the frame cycle. One method is to apply a single-polar voltage in a single frame.

Another method is that polarities of the inter-electrode voltage in two sub-frames of a single frame are made opposite to each other, and further the polarities of the inter-electrode voltage are equalized with each other in a latter sub-frame of a frame and in a former sub-frame of its following frame.

Figure 9:
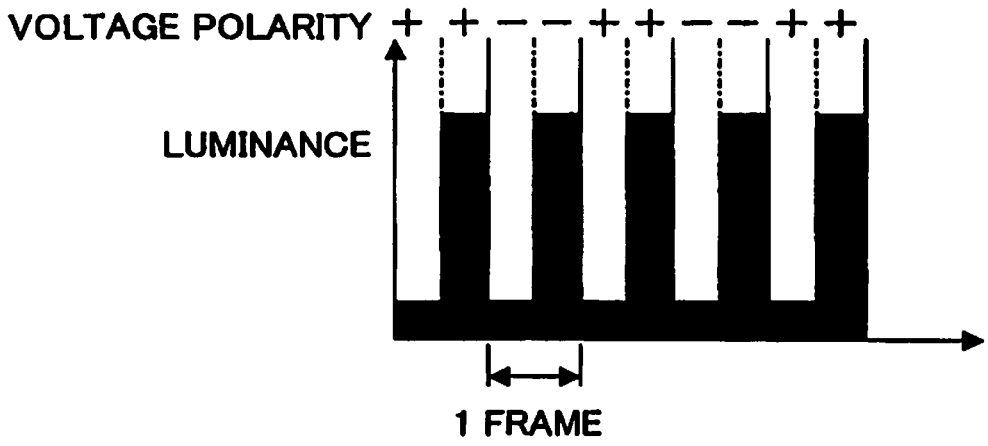
FIGS. 9(*a*) and 9(*b*) are graphs each of which illustrates how a polarity of an inter-electrode voltage is varied at a frame cycle.
Figure 9:
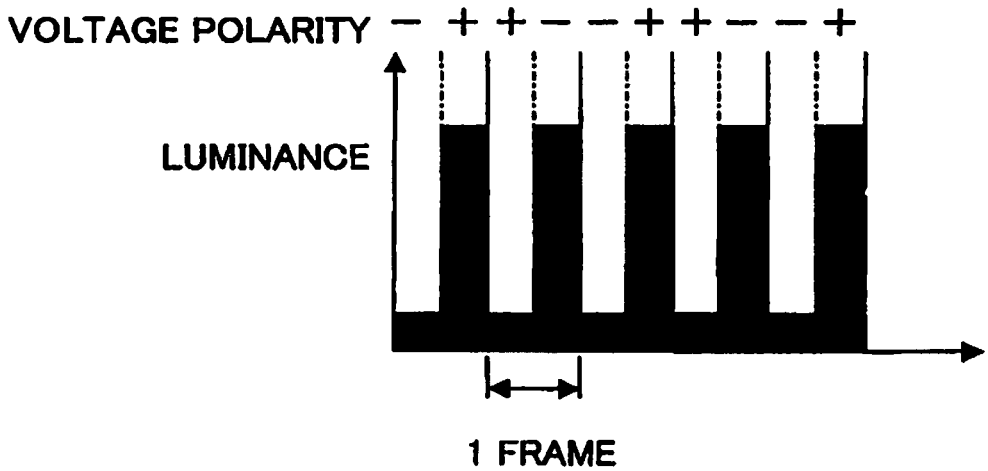

FIG. 9(*a*) illustrates a relationship between a polarity of a voltage (polarity of the inter-electrode voltage) and the frame cycle in case of using the former method. Moreover, FIG. 9(*b*) illustrates a relationship between the polarity of the voltage and the frame cycle in case of using the latter method.

Even in case where, the inter-electrode voltages are largely different from each other between the sub-frames, it is possible, to prevent the burning and the flicker by alternating the inter-electrode voltage at the frame cycle.

Moreover, as described above, the present display device drives the liquid crystal panel 21 by the sub-frame display whereby the excess brightness is suppressed.

However, in case where the response speed (speed until the voltage (inter-electrode voltage) applied to the liquid crystal becomes the same as the applied voltage) of the liquid crystal is low, effects obtained by the sub-frame display are sometimes reduced.

That is, in case of carrying out the normal hold display, a single liquid crystal state corresponds to a single luminance gradation in a TFT liquid crystal panel. Therefore, the response property of the liquid crystal does not depend on the luminance gradation of the display signal.

Figure 10:
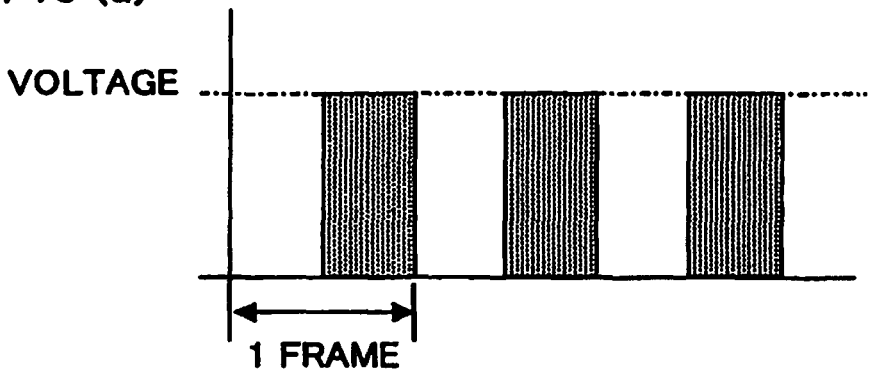
FIGS. 10(*a*) through 10(*c*) are graphs each of which illustrates a response speed of liquid crystal.
Figure 10:
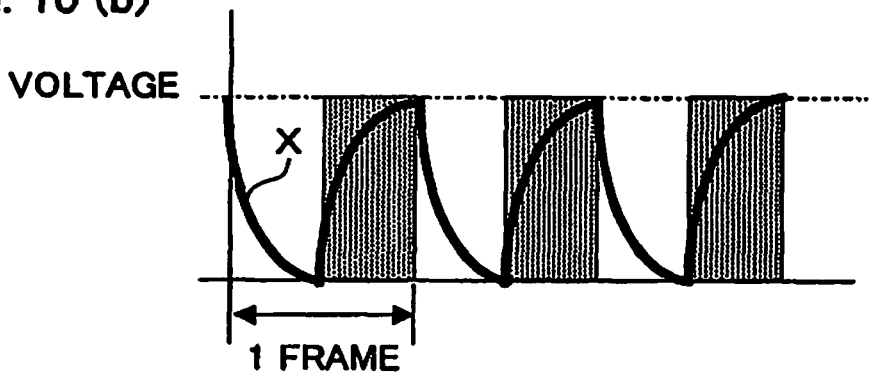
Figure 10:
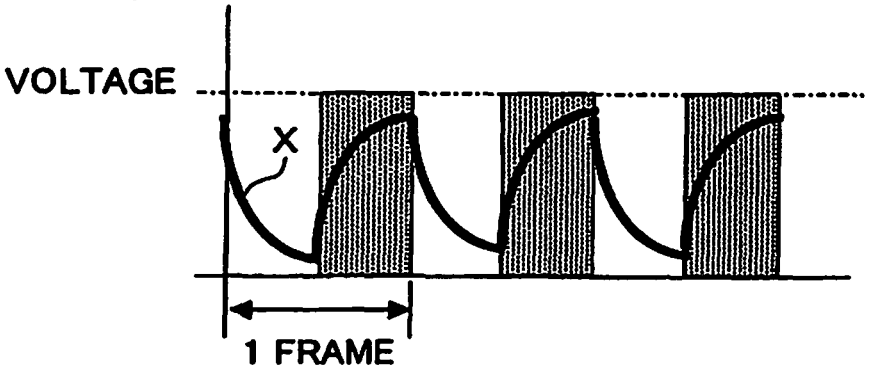

Meanwhile, in case of carrying out the sub-frame display like the present display device does, when displaying an image based on a halftone display signal which results in the minimum luminance (white) of the former sub-frame and the maximum luminance of the latter frame, the voltage applied to the liquid crystal in a single frame fluctuates as illustrated in FIG. 10(*a*).

Moreover, as illustrated by a continuous line X in FIG. 10(*b*), the inter-electrode voltage changes according to the response speed (response property) of the liquid crystal.

Here, in case where the response speed of the liquid crystal is low, when carrying out such a halftone display, the inter-electrode voltage (continuous line X) changes as illustrated in FIG. 10(*c*).

Therefore, in this case, the display luminance of the former sub-frame does not become minimum, and the display luminance of the latter sub-frame does not become maximum.

Figure 11:
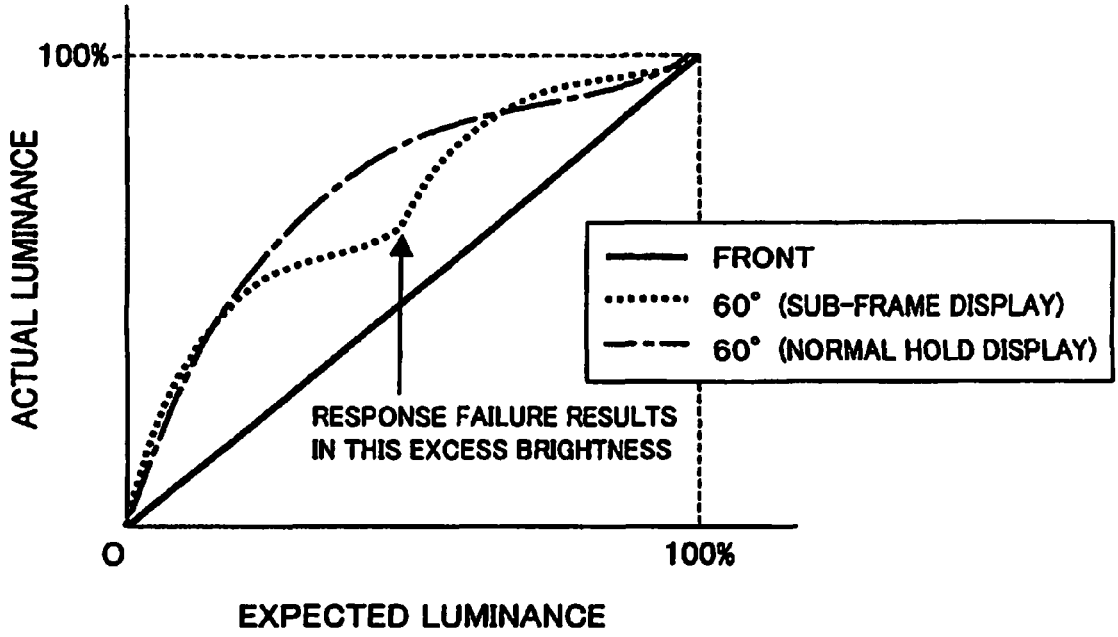
FIG. 11 is a graph illustrating a display luminance (a relationship between an expected luminance and an actual luminance) outputted from the liquid crystal panel in case of carrying out the sub-frame display by using liquid crystal whose response speed is low.

On this account, a relationship between the expected luminance and the actual luminance is as illustrated in FIG. 11. That is, even in case of carrying out the sub-frame display, it becomes impossible to carry out a display with a luminance (minimum luminance/maximum luminance) which causes the expected luminance and the actual luminance to be less differentiated (deviated) from each other when the viewing angle is large.

On this account, an effect of suppressing the excess brightness phenomenon is reduced.

Therefore, in order to satisfactorily carry out the sub-frame display like the present display device does, it is preferable to design the liquid crystal panel 21 so that the response speed of the liquid crystal in the liquid crystal panel 21 satisfy the following conditions (c) and (d).

When a voltage signal (generated by the source driver 23 according to the display signal) is given to the liquid crystal, displaying an image having the minimum luminance (black; corresponding to the minimum brightness), in order to change the image having the minimum luminance into the image having the maximum luminance (white; corresponding to the maximum brightness), the voltage of the liquid crystal (inter-electrode voltage) reaches a value not less than 90% of the voltage of the voltage signal (the actual brightness reaches 90% of the maximum brightness when viewed perpendicularly with respect to the front surface) in a period corresponding to a shorter sub-frame.

When a voltage signal is given to the liquid crystal displaying an image having the maximum luminance (white) in, order to change the image having the maximum luminance into the image having the minimum luminance (black), the voltage of the liquid crystal (inter-electrode voltage) reaches a value not more than 5% of the voltage of the voltage signal (the actual brightness reaches 5% of the minimum brightness when viewed perpendicularly with respect to the front surface) in a period corresponding to the shorter sub-frame.

Moreover, it is preferable that the control section 15 be designed so as to be able to monitor the response speed of the liquid crystal.

In case where the control section judges that the response speed of the liquid crystal is low due to the environmental temperature or the like and the above conditions (c) and (d) can not be satisfied, the control section 15 may be set so as to stop the sub-frame display and drive the liquid crystal panel 21 on the basis of the normal hold display.

With this arrangement, even in case where the excess brightness phenomenon becomes rather conspicuous due to the sub-frame display, it is possible to change the display mode of the liquid crystal panel from the sub-frame display to the normal hold display.

In the present embodiment, the present display device functions as a liquid crystal monitor. However, the present display device can function also as a liquid crystal television receiver (liquid crystal television).

Such a liquid crystal television can be realized by providing a tuner section on the present display device. The tuner section selects a channel of a television broadcasting signal, and conveys a television image signal of thus selected channel to the control section 15 via the frame memory 11.

In this arrangement, the control section 15 generates a display signal in accordance with the television image signal.

Note that, in the present embodiment, black is expressed in the former sub-frame and the gradation is expressed by using only the latter sub-frame in case of a low luminance.

However, even when the former and latter sub-frames are replaced with each other (even when black is expressed in the latter sub-frame and the gradation is expressed by using only the former sub-frame in case of a low luminance), it is possible to obtain the same display state.

Further, in the present embodiment, the equation (1) is used to set luminance gradations (signal gradations) of display signals (a former stage display signal and a latter stage display signal).

However, an actual panel has a luminance even in case of a black display (gradation 0), and a response speed of liquid crystal is limited, so that it is preferable to take these factors into consideration in setting a signal gradation. That is, it is preferable that: the liquid crystal panel 21 is made to display an actual image, and a relationship between a signal gradation and a display luminance is measured, so as to determine the LUT (output table) corresponding to the equation (1) in accordance with the measurement result.

Moreover, in the present embodiment, a indicated in the equation (6a) ranges from 2.2 to 3. This range is not strictly calculated, but is regarded as being substantially appropriate for a human visual sense.

Further, when a source driver for normal hold display is used as the source driver 23 of the present display device, a voltage signal is outputted to each pixel (liquid crystal) according to an inputted signal gradation (luminance gradation of a display signal) so as to obtain a display luminance calculated by using the equation (1) where $\gamma=2.2$.

Further, even in case of carrying out the sub-frame display, in each sub-frame, the source driver 23 outputs a voltage signal, used in the normal hold display, without any modification, according to an inputted signal gradation.

However, when a voltage signal is outputted in this manner, it is sometimes impossible to equalize a total luminance in a single frame in the sub-frame display with a value in the normal hold display (it is sometimes impossible to sufficiently carry out the gradation expression).

Therefore, it is preferable to design the source driver 23 so as to output a voltage signal, obtained by carrying out conversion into a divided luminance, in the sub-frame display.

That is, it is preferable to design the source driver 23 so as to finely adjust a voltage (inter-electrode voltage), applied to liquid crystal, according to a signal gradation.

Thus, it is preferable to design the source driver 23 as a source driver for the sub-frame display so that it is possible to carry out the foregoing fine adjustment.

Moreover, in the present embodiment, the liquid crystal panel 21 is a VA panel. However, the arrangement is not limited to this. Even when a liquid crystal panel in a mode other than the VA mode is used, the sub-frame display of the present display device can suppress the excess brightness.

That is, the sub-frame display of the present display device can suppress the excess brightness which occurs in a liquid crystal panel (liquid crystal panel in such a mode that a viewing angle property in a gradation gamma varies) in which an expected luminance (expected brightness) and an actual luminance (actual brightness) are largely different from each other when a viewing angle is wider.

Further, particularly, the sub-frame display of the present display device is effective for a liquid crystal panel having such a property that its display luminance is higher as a viewing angle is wider.

Moreover, the liquid crystal panel 21 of the present display device may be NB (Normally Black) or NW (Normally White).

Further, in the present display device, other display panel (for example, an organic EL panel or a plasma display panel) may be used instead of the liquid crystal panel 21.

Further, in the present embodiment, it is preferable to divide a frame at a ratio ranging from 1:3 to 1:7. However, the arrangement is not limited to this. The present display device may be designed so as to divide a frame at 1:n (n is a natural number not less than 1).

Further, in the present embodiment, the aforementioned equation (10) is used to set signal gradations of display signals (a former stage display signal and a latter stage display signal).

However, this setting is under such condition that a response speed of liquid crystal is 0 ms and T0. (minimum luminance)=0. Thus, it is preferable to devise further ideas in practical use.

That is, a maximum luminance (threshold luminance) which can be obtained in a sub-frame (latter sub-frame) is Tmax/(n+1) in case where a response speed of liquid crystal is 0 ms and T0=0. Further, a threshold luminance gradation Lt is a frame gradation of this luminance.

$$Lt=((T\max/(n+1)-T0)/(T\max-T0))\hat{}(1/\gamma)$$

$$(\gamma=2.2, T0=0)$$

In case where the response speed of liquid crystal is not 0, under such condition that a response of "black→white" is Y % in a sub-frame and a response of "white→p black" is Z % in a sub-frame and T0=0, a threshold luminance (luminance of Lt) Tt is represented as follows.

$$Tt=((T\max-T0)\times Y/100+(T\max-T0)\times Z/100)/2$$

Thus, the following equation holds.

$$Lt=((Tt-T0)/(T\max-T0))\hat{}(1/\gamma)$$

$$(\gamma=2.2)$$

Further, actual Lt may be more complicated and the threshold luminance Tt sometimes cannot be represented by a simple equation. Therefore, it is sometimes difficult to express Lt by Lmax.

In order to calculate Lt in this case, it is preferable to use a result obtained by measuring a luminance of the liquid crystal panel. That is, in case where a maximum luminance is obtained in one sub-frame and a minimum luminance is obtained in the other sub-frame, a luminance obtained in emission from the liquid crystal panel is measured. Thus obtained luminance is Tt. Further, a gradation Lt upon leakage is determined in accordance with the following equation.

$$Lt=((Tt-T0)/(T\max-T0))\hat{}(1/\gamma)$$

$$(\gamma=2.2)$$

In this manner, Lt calculated in accordance with the equation (10) is an ideal value, so that it is preferable to use this value merely as a barometer.

Here, the following description explains, more in detail, why it is preferable in the present display device to change a polarity of the inter-electrode voltage at a frame cycle.

Figure 12:
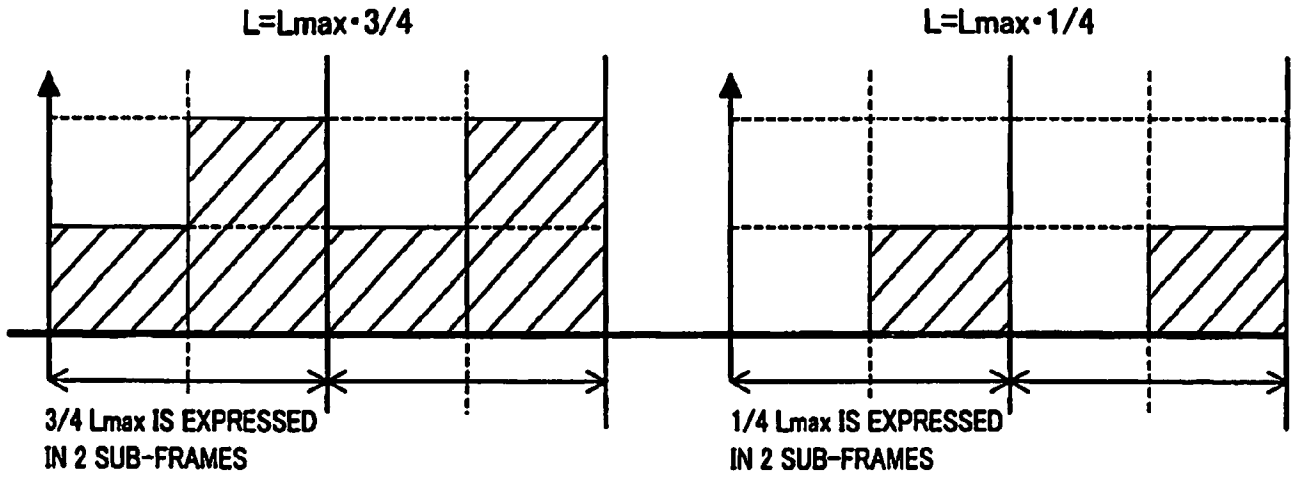
FIG. 12(*a*) is a graph illustrating luminances obtained in a former sub-frame and a latter sub-frame in case where the display luminance is ¾ and in case where the display luminance is ¼ of Lmax.
Figure 12:
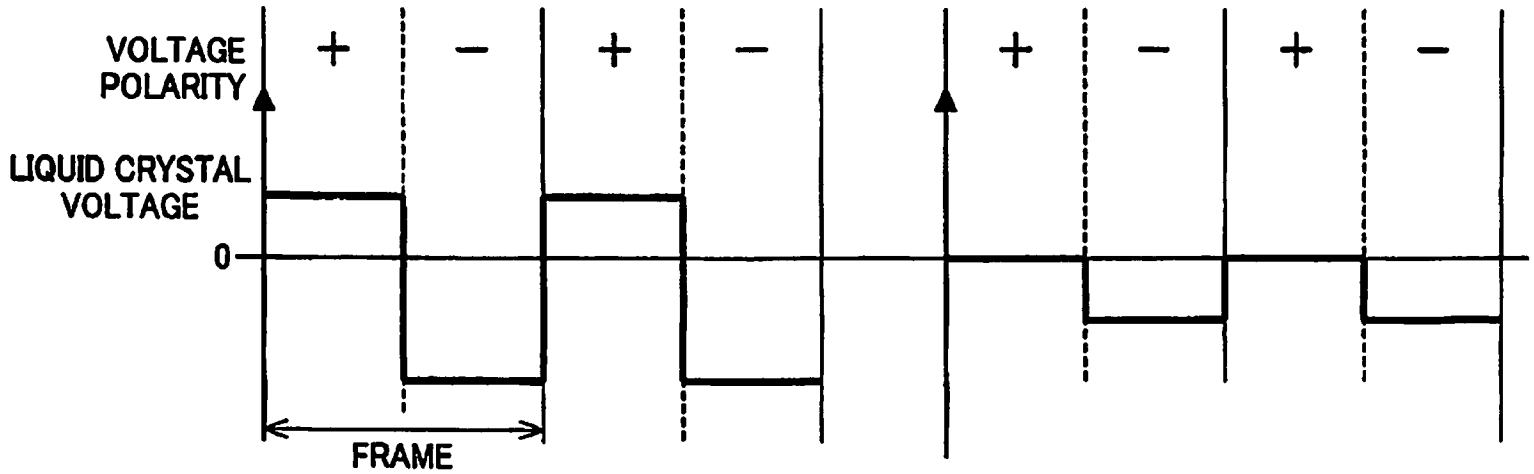

FIG. 12(*a*) is a graph illustrating a luminance of an image displayed by using the former sub-frame and the latter sub-frame in the case where the display luminance is ¾ of Lmax and in the case where the display luminance is ¼ of Lmax.

As shown in FIG. 12(*a*), in the case of carrying out the sub-frame display like the present display device, a value (value of a voltage to be applied to a region between the pixel electrodes; absolute value) of a voltage to be applied to a liquid crystal in the former sub-frame is different from that in the latter sub-frame.

Therefore, when the polarity of each voltage (liquid crystal voltage) to be applied to the liquid crystal is changed at a sub-frame cycle, the liquid crystal voltages to be applied are uneven due to the difference between the voltage value in the former sub-frame and the voltage value in the latter sub-frame as illustrated in FIG. 12(*b*). In other words, a total of the liquid crystal voltage to be applied is not 0V. Thus, it is impossible to cancel any direct current component of the liquid crystal voltage. For this reason, when the liquid crystal liquid crystal panel 21 is driven for a long time, electric charges are accumulated in the electrodes, which may result in drawbacks such as burning, flicker, and the like.

Therefore, it is preferable that the polarity of the liquid crystal voltage be changed at the frame cycle.

Note that, there are two methods for varying the polarity of the liquid crystal voltage at the frame cycle. One of the methods is to apply a voltage whose polarity is maintained during a single frame period.

The other method is to apply a liquid crystal voltage whose polarity is reversed between the sub-frames of the single frame and is maintained between the latter sub-frame and a former sub-frame of another frame which occurs after that frame.

Figure 13:
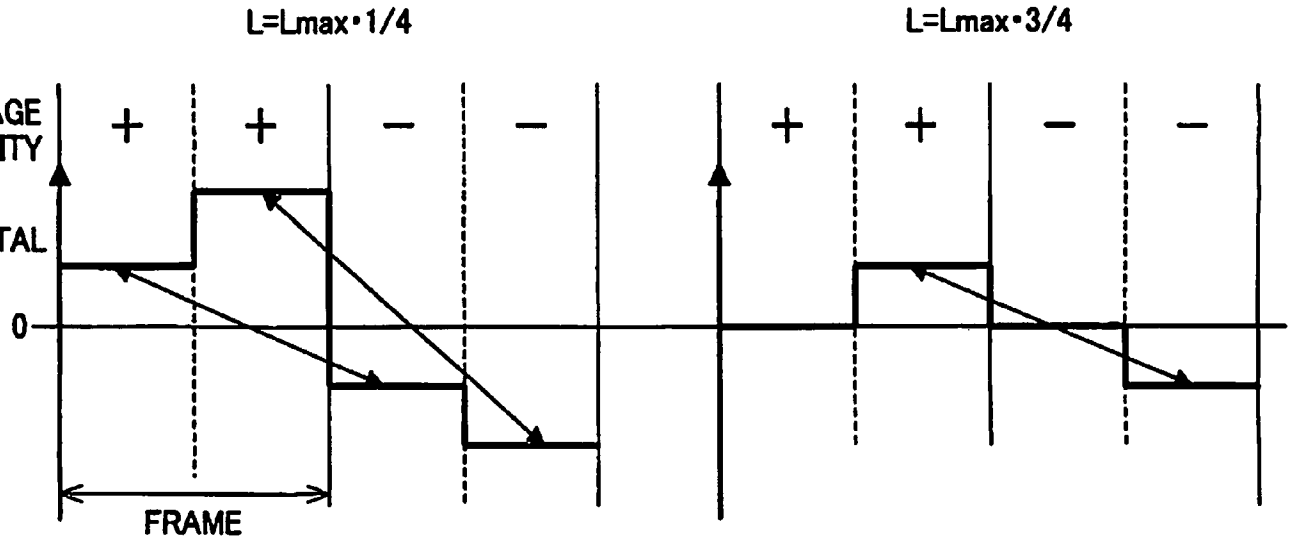
FIGS. 13(*a*) and 13(*b*) are graphs each of which illustrates how to vary the polarity of the inter-electrode voltage at a frame cycle.
Figure 13:
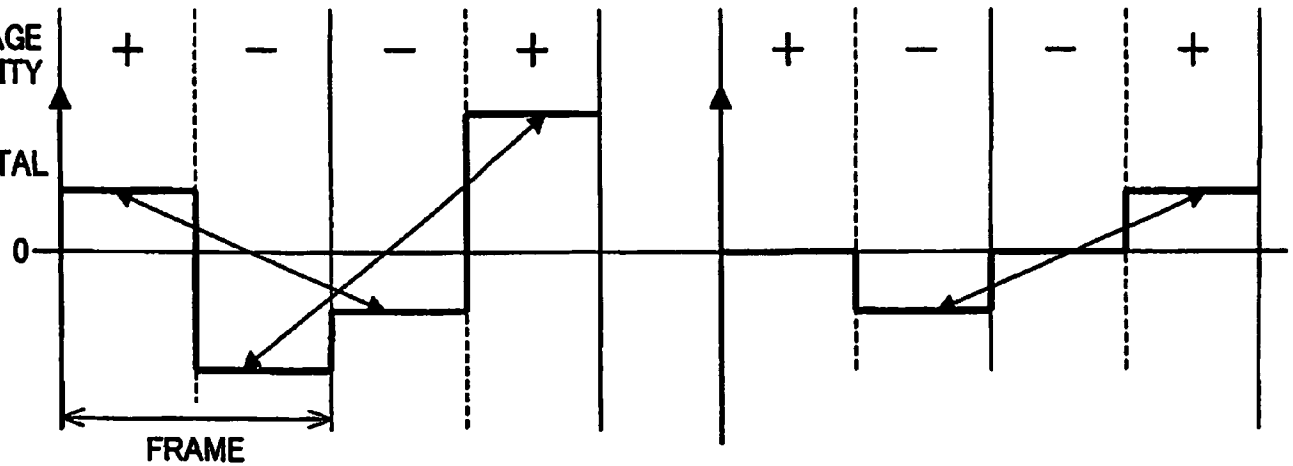

FIG. 13(*a*) is a graph illustrating a relationship between the voltage polarity (polarity of the liquid crystal voltage) and the frame cycle and a relation between the voltage polarity and the liquid crystal voltage in case of adopting the former method. Meanwhile, FIG. 13(*b*) is a graph illustrating the relationship in case of adopting the latter method.

As illustrated in the graphs, in the case of changing the polarity of each liquid crystal voltage at the frame cycle, a total voltage of the former sub-frames of the frames adjacent to each other can be made into 0V and a total voltage of the latter sub-frames of the frames adjacent to each other can be made into 0V. In other words, a total voltage in the two frames is 0V. Thus, it is possible to cancel the direct current component of the applied voltage.

Accordingly, even when the liquid crystal voltage is greatly varied between the sub-frames, the burning and the flicker can be prevented by alternating the liquid crystal voltage at the frame cycle as described above.

Figure 14:
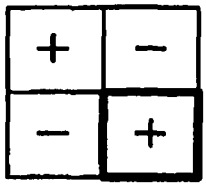
FIGS. 14(*a*) through 14(*d*) are graphs each of which illustrates four pixels of the liquid crystal panel and the polarity of the liquid crystal voltage in each pixel.
Figure 14:
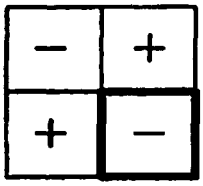
Figure 14:
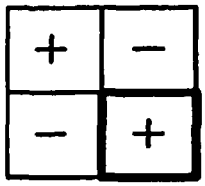
Figure 14:
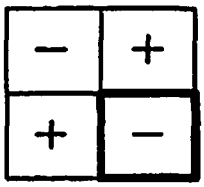

Each of FIG. 14(*a*) through FIG. 14(*d*) is a diagram illustrating four pixels of the liquid crystal panel 21 and polarities of liquid crystal voltages applied to the pixels.

As described above, it is preferable that a polarity of a voltage applied to a pixel be reversed at the frame cycle. In this case, polarities of the liquid crystal voltages applied to the pixels change, in an order from FIG. 14(*a*) to FIG. 14(*d*), at the frame cycle.

Here, it is preferable that a total of the liquid crystal voltages applied to all the pixels in the liquid crystal panel 21 be 0V. A control for obtaining such a total can be realized by applying voltages in such a manner that a polarity of a voltage applied to a pixel is different from a polarity of another voltage applied to another pixel adjacent to that pixel.

Further, the present display device may be so designed as to carry out pixel-division driving (area-ratio gradation driving).

Figure 15:
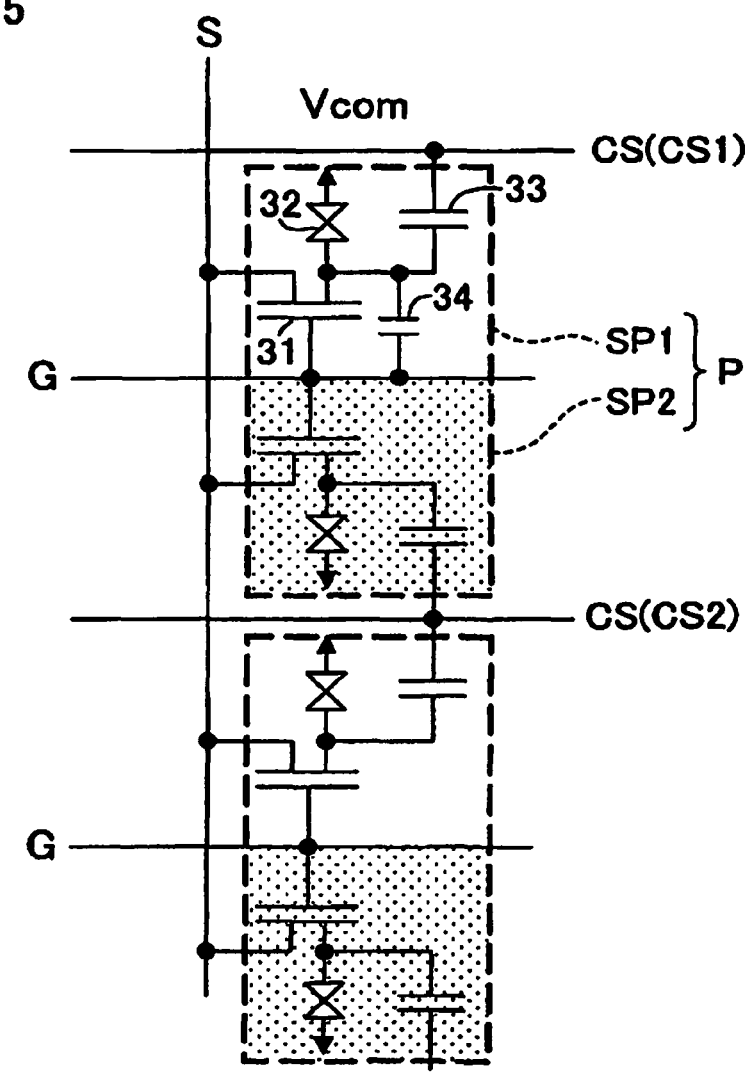
FIG. 15 illustrates an arrangement of the liquid crystal panel driven with each pixel divided.

The following description explains the pixel-division driving of the present display device. FIG. 15 is a diagram illustrating a structure of the liquid crystal panel 21 carrying out the pixel-division driving.

Displaying in accordance with the pixel-division driving is carried out by respectively applying different voltages to sub-pixels SP 1 and SP2 obtained by dividing a pixel P connected to a gate line G and a source line S of the liquid crystal panel 21 as illustrated in FIG. 15.

Note that, such a pixel-division driving is described in, for example, Documents 4 through 7.

The pixel-division driving is briefly explained as follows.

As illustrated in FIG. 15, in the present display device that carries out the pixel-division driving, the pixel P is sandwiched between two different auxiliary capacitor lines CS1 and CS2. The auxiliary capacitor lines CS1 and CS2 are connected to the sub-pixels SP1 and SP2, respectively.

Further, each of the sub-pixels SP1 and SP2 is provided with a TFT 31, a liquid crystal capacitor 32, and an auxiliary capacitor 33.

The TFT 31 is connected to the gate line G, the source line S, and the liquid crystal capacitor 32. The auxiliary capacitor 33 is connected to the TFT 31, the liquid crystal capacitor 32, and the auxiliary capacitor lines CS1 or CS2.

Auxiliary signals that are alternating voltage signals each having a predetermined frequency are applied to the auxiliary capacitor lines CS1 and CS2. The auxiliary signals applied to the auxiliary capacitor lines CS1 and CS2 have phases opposite to each other (phases different at 180°).

The liquid crystal capacitor 32 is connected to the TFT 31, a common voltage Vcom, and the auxiliary capacitor 33. Further, the liquid crystal capacitor 32 is connected to a parasitic capacitor 34 generated between the liquid crystal capacitor 32 and the gate line G.

In this arrangement, when the gate line G is brought into an ON state, the TFTs 31 of the sub-pixels SP1 and SP2 in the pixel P are in a conductive state.

Figure 16:
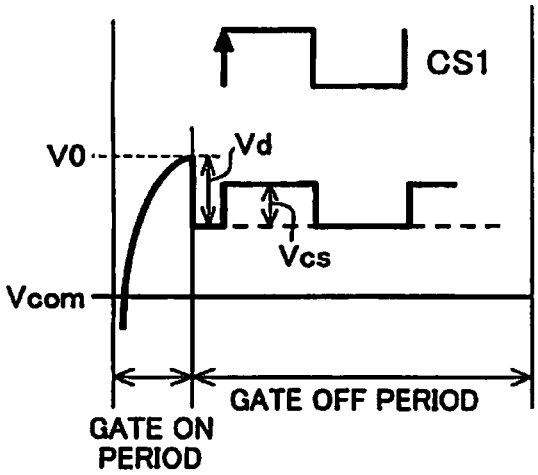
FIGS. 16(*a*) and 16(*c*) are graphs each of which illustrates a voltage (liquid crystal voltage) applied to a liquid crystal capacitor of a sub-pixel in case where a positive (≧Vcom) display signal is applied to a source line S. Further, FIGS. 16(*b*) and 16(*d*) are graphs each of which illustrates a voltage (liquid crystal voltage) applied to the liquid crystal capacitor of the sub-pixel in case where a negative (≦Vcom) display signal is applied to the source line S.
Figure 16:
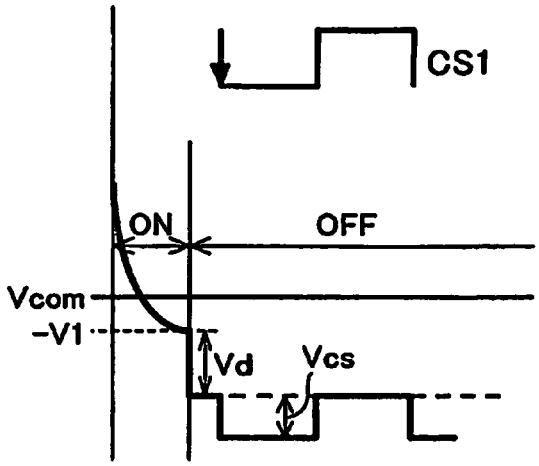
Figure 16:
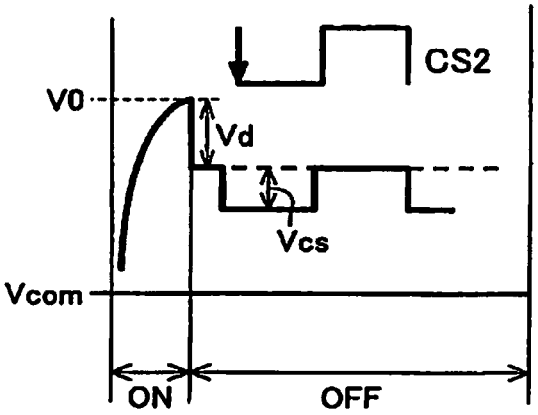
Figure 16:
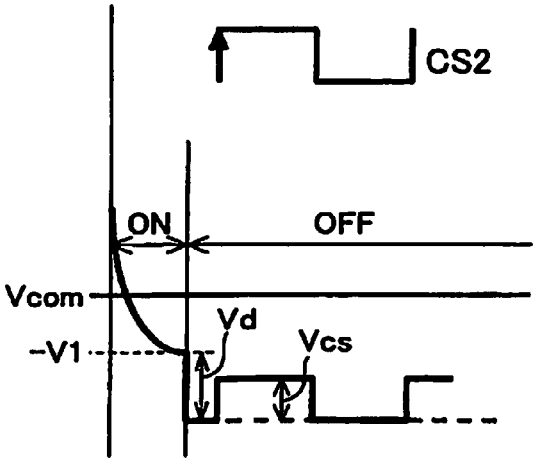

FIG. 16(*a*) and FIG. 16(*c*) are graphs illustrating voltages (liquid crystal voltages) applied to the liquid crystal capacitors 32 of the sub-pixels SP 1 and SP2 in case where a display signal indicative of positive (≧Vcom) is applied to the source line S.

In this case, as illustrated in FIG. 16(*a*) and FIG. 16(*c*), each voltage value in the liquid crystal capacitor 32 increases to a value (V0) that corresponds to the display signal.

When the gate line G becomes OFF, a gate drawing phenomenon due to the parasitic capacitor 34 causes the liquid crystal voltage to decrease by Vd.

On this occasion, when the auxiliary signal of the auxiliary capacitor line CS1 rises (from low to high) as illustrated in FIG. 16(*a*), the liquid crystal voltage of the sub-pixel SP1 connected to the auxiliary capacitor line CS1 increases by Vcs, which is a value corresponding to an amplitude of the auxiliary signal flowing in the auxiliary capacitor lines CS1. Moreover, the liquid crystal voltage of the sub-pixel SP 1 oscillates within a range from V0 to V0-Vd, at the amplitude Vcs, in accordance with the frequency of the auxiliary signal flowing in the auxiliary capacitor lines CS1.

Meanwhile, in this case, the auxiliary signal in the auxiliary capacitor line CS2 falls (from high to low) as illustrated in FIG. 16(*c*). This causes the liquid crystal voltage in the sub-pixel SP2 connected to the auxiliary capacitor line CS2 to decrease by Vcs corresponding to the amplitude of the auxiliary signal. Thereafter, the liquid crystal voltage in the sub-pixel SP2 oscillates within a range from V0-Vd to V0-Vd-Vcs.

FIG. 16(*b*) and FIG. 16(*d*) are graphs illustrating voltages (liquid crystal voltages) respectively applied to the liquid crystal capacitors 32 of the sub-pixels SP 1 and SP2 in case where a display signal indicative of negative (≦Vcom) is applied to the source line S when the gate line G is in the ON state.

In this case, as illustrated in FIG. 16(*b*) and FIG. 16(*d*), a liquid crystal voltage of each of the sub-pixels SP1 and SP2 decreases to a value (−V1) that corresponds to the display signal.

Thereafter, when the gate line G becomes OFF, the gate drawing phenomenon causes the liquid crystal voltage to further decrease by Vd.

On this occasion, when the auxiliary signal in the auxiliary capacitor line CS1 falls as illustrated in FIG. 16(*b*), the liquid crystal voltage in the sub-pixel SP1 connected to the auxiliary capacitor line CS2 further decreases by Vcs. Moreover, the liquid crystal voltage in the sub-pixel SP1 oscillates within a range from −V0-Vd-Vcs to −V0-Vd.

Meanwhile, in this case, the auxiliary signal in the auxiliary capacitor line CS2 rises as illustrated in FIG. 16(*c*). This causes the liquid crystal voltage in the sub-pixel SP2 connected to the auxiliary capacitor line CS2 to increase by Vcs. Thereafter, the liquid crystal voltage in the sub-pixel SP2 oscillates within a range from V0-Vd to V0-Vd-Vcs.

In this way, it is possible to differentiate the liquid crystal voltages of the sub-pixels SP1 and SP2 from each other by applying the auxiliary signals whose phases are different at 180°.

That is, when the display signal in the source line S indicates positive, in the sub-pixel receiving the auxiliary signal that rises just after the occurrence of the drawing phenomenon, an absolute value of the liquid crystal voltage becomes higher than the display signal voltage (see FIG. 16(*a*)).

Meanwhile, in the sub-pixel receiving the auxiliary signal that falls on this occasion, an absolute value of the liquid crystal voltage becomes lower than the voltage value of the display signal (see FIG. 16(*c*)).

Further, when the display signal in the source line S indicates negative, in the sub-pixel receiving the auxiliary signal that falls just after occurrence of the drawing phenomenon, an absolute value of the liquid crystal voltage becomes higher than the voltage value of the display signal (see FIG. 16(*b*)).

Meanwhile, in the sub-pixel receiving the auxiliary signal that rises on this occasion, an absolute value of the liquid crystal voltage becomes lower than the voltage value of the display signal (see FIG. 16(*d*)).

Therefore, in the example illustrated in FIG. 16(*a*) through FIG. 16(*d*), the liquid crystal voltage (absolute value) in the sub-pixel SP1 is higher than that in the sub-pixel SP2 (the sub-pixel SP1 has a higher display luminance than that of the sub-pixel SP2).

Further, it is possible to control the difference (Vcs) between the liquid crystal voltages of the sub-pixels SP 1 and SP2 in accordance with the amplitude values of the auxiliary signals applied to the auxiliary capacitor lines CS1 and CS2. This makes it possible to make a desirable difference between the display luminance of the sub-pixel SP1 and that of the sub-pixel SP2 (a first luminance and a second luminance).

Table 1 illustrates (i) the polarity of the liquid crystal voltage applied to the sub-pixel (bright pixel) in which the luminance is high and the polarity of the liquid crystal voltage applied to the sub-pixel (dark pixel) in which the luminance is low; and (ii) a state of the auxiliary signal just after the occurrence of the drawing phenomenon. Note that, in Table 1, the polarities of the liquid crystal voltages are indicated by symbols "+" and "−". Also in Table 1, a symbol "↑" indicates the rise of the auxiliary signal just after the drawing phenomenon, and a symbol "↓" indicates the fall of the auxiliary signal.

TABLE 1

| | | |
|---|---|---|
| Bright pixel | +, ↑ | −, ↓ |
| Dark pixel | +, ↓ | −, ↑ |

Note that luminance in the pixel P is a total value of luminance values (equal to transmissivity of the liquid crystal) of the sub-pixels SP1 and SP2.

Figure 17:
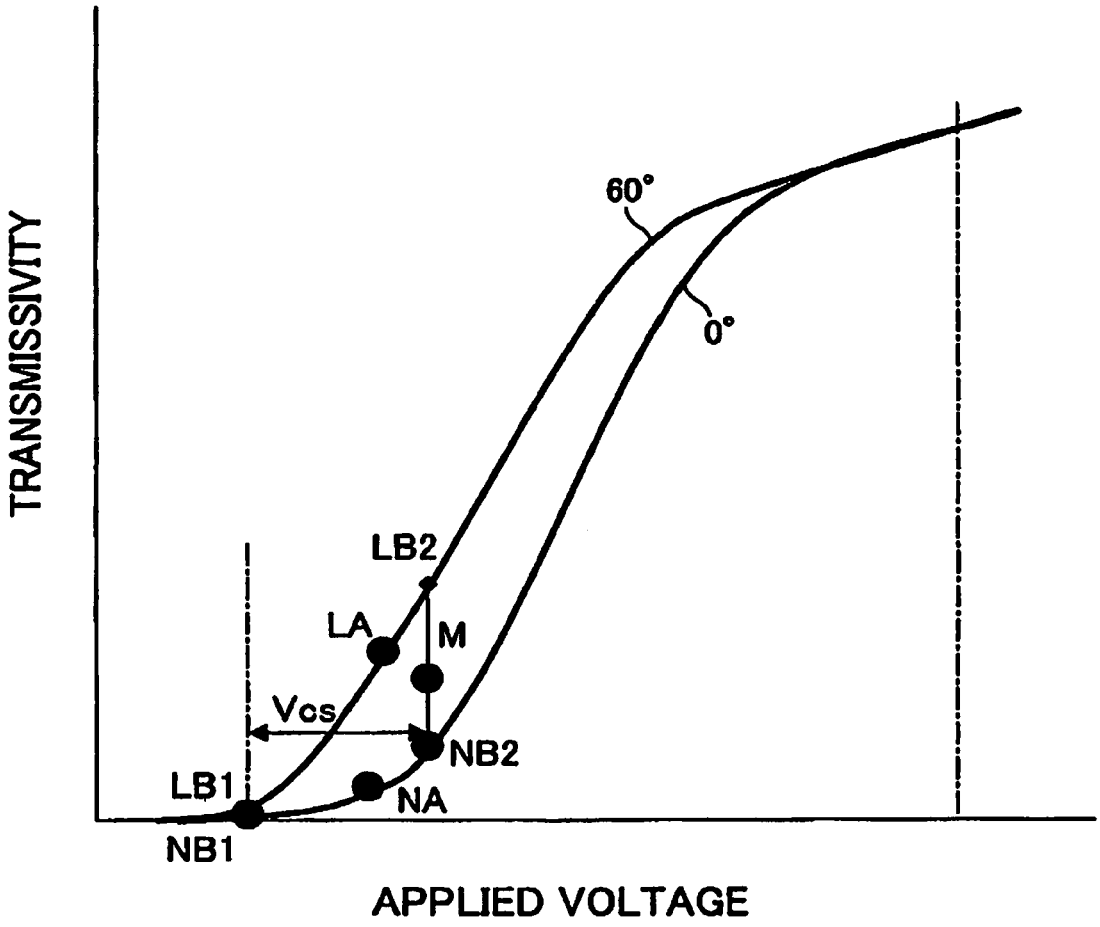
FIG. 17 is a graph illustrating a relationship between transmissivity and an applied voltage of a liquid crystal panel 21 viewed at two viewing angles (0° (front) and 60°) in case where the pixel-division driving is not carried out.

FIG. 17 is a graph illustrating a relationship between the transmissivity of the liquid crystal panel 21 and the applied voltage at a viewing angle of 0° (front) and at a viewing angle of 60° in the case where the pixel-division driving is not carried out.

As illustrated in the graph, when the transmissivity in the front surface is NA (when the liquid crystal voltage is so control that the transmissivity becomes NA), the transmissivity at a viewing angle of 60° is LA.

Here, in the pixel-division driving, the transmissivity of NA in the front surface is obtained as follows. That is, voltages that are different by Vcs are applied to the sub-pixels SP1 and SP2 respectively so that the sub-pixels SP1 and SP2 have transmissivities NB1 and NB2 satisfying the following equation: NA=(NB1+NB2)/2, respectively.

When the transmissivity of the sub-pixel SP1 is NB1 at a viewing angle of 0°, the transmissivity of the sub-pixel SP1 is LB1 at a viewing angle of 60°. Also, the transmissivity of the sub-pixel SP2 is NB2 at a viewing angle of 0°, the transmissivity of the sub-pixel SP2 is LB2 at a viewing angle of 60°. The transmissivity LB 1 is almost 0, so that the transmissivity in the single pixel is M (LB2/2) that is smaller than LA.

In this way, the viewing angle property can be improved by carrying out the pixel-division driving.

Further, for example, in case where the pixel-division driving is carried out, when an amplitude of the CS signal is increased, it is also possible to display an image having a low luminance (high luminance) by carrying out the black display (white display) in one sub-pixel and adjusting a luminance of the other sub-pixel. As in the sub-frame display, it is possible to minimize the difference between the display luminance and the actual luminance in the one sub-pixel. On this account, the viewing angle property can be further improved.

Further, the foregoing arrangement may be varied so that the black display (white display) is not carried out in one sub-pixel. That is, when both the sub-pixels are different from each other in terms of the luminance, it is possible to improve the viewing angle in principle. Thus, it is possible to reduce the CS amplitude, it is easier to design the panel driving.

Further, as to all the display signals, it is not necessary to differentiate the sub-pixels SP1 and SP2 in terms of the luminance. For example, when carrying out the white display or the black display, it is preferable to equalize these luminances. Thus, the display device is designed so that: with respect to at least one display signal (display signal voltage), a luminance of the sub-pixel SP 1 is set to be the first luminance and a luminance of the sub-pixel SP2 is set to be the second luminance different from the first luminance.

Further, in the pixel-division driving, it is preferable that the polarity of the display signal applied to the source line S be changed per frame. In other words, in case where the sub-pixels SP1 and SP2 are driven as illustrated in FIG. 16(*a*) and FIG. 16(*c*) in a certain frame, it is preferable to drive the sub-pixels SP1 and SP2 as illustrated in FIG. 16(*b*) and FIG. 16(*d*) in a subsequent frame.

On this account, the two liquid crystal capacitors 32 in the pixel P have a total voltage of 0V in the two frames. Thus, it is possible to cancel the direct current component of the applied voltage.

Note that, in the aforementioned pixel-division driving, a single pixel is divided into two, however, the division is not limited to this. A single pixel may be divided into three or more.

Note also that, the pixel-division driving may be carried out in combination with the normal hold display or the sub-frame display. Moreover, the pixel-division driving may be carried out in combination with the polarity-reverse driving described with reference to FIG. 12(*a*), FIG. 12(*b*), FIG. 13(*a*), and FIG. 13(*b*).

The following description explains the combination of the pixel-division driving, the sub-frame display, and the polarity-reverse driving.

Figure 18:
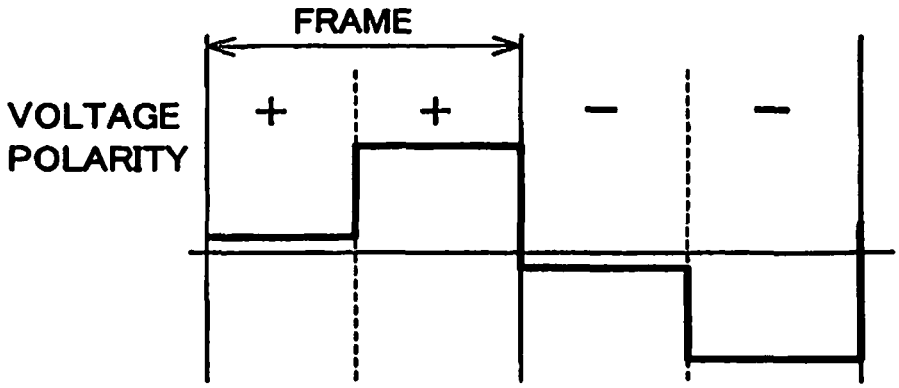
FIG. 18(*a*) is a graph illustrating how the liquid crystal voltage (corresponding to a single pixel) varies in case of carrying out the sub-frame display while reversing the polarity of the liquid crystal voltage in each frame.
Figure 18:
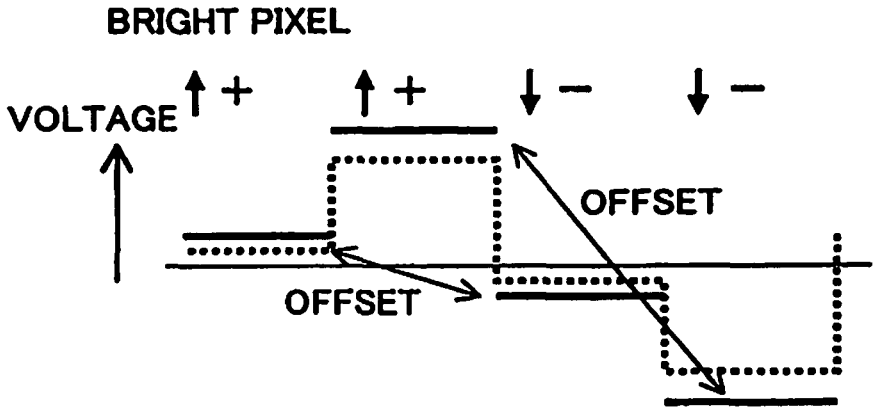
Figure 18:
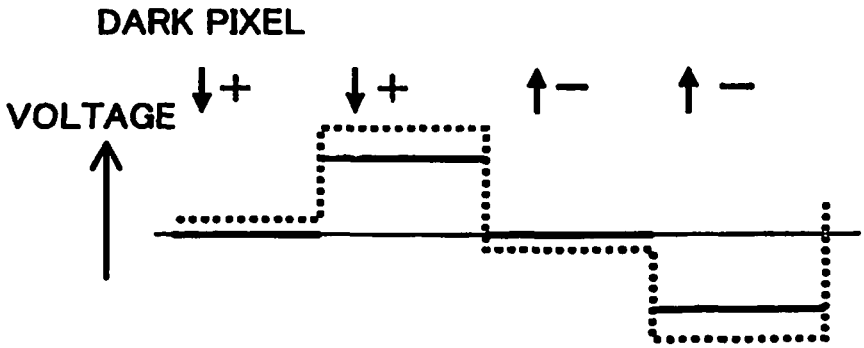

FIG. 18(*a*) is a graph illustrating how a liquid crystal voltage (corresponding to a single pixel) varies in case where the sub-frame display is carried out while reversing a polarity of the liquid crystal voltage in every frame as in the case illustrated in FIG. 13(*a*).

In case where the sub-frame display is carried out with the combination of the polarity-reverse driving and the pixel-division driving, the liquid crystal voltage in each sub-pixel changes as illustrated in FIG. 18(*b*) and FIG. 18(*c*).

That is, FIG. 18(*b*) is a graph illustrating the liquid crystal voltage in the sub-pixel (bright pixel) having a high luminance in the pixel-division driving. FIG. 18(*c*) is a graph illustrating the liquid crystal voltage in the sub-pixel (dark pixel) having a low luminance in the pixel-division driving.

Note that each of broken lines in FIG. 18(*b*) and FIG. 18(*c*) indicates the liquid crystal voltage in the case of carrying out no pixel-division driving. Note also that, each of continuous lines therein indicates the liquid crystal voltage in the case of carrying out the pixel-division driving.

Figure 19:
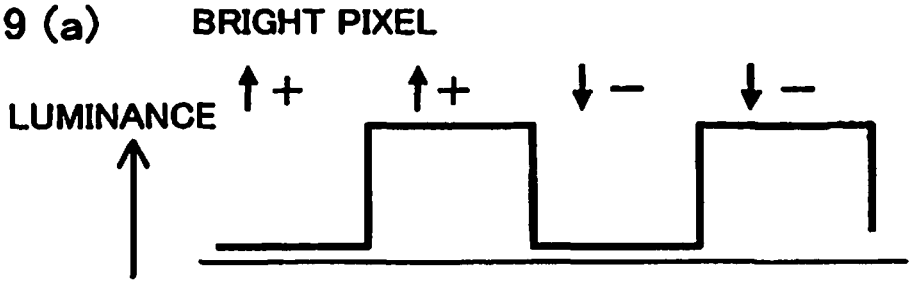
FIGS. 19(*a*) and 19(*b*) are graphs, corresponding to FIGS. 18(*a*) and 18(*b*), which respectively illustrate a luminance of the bright pixel and a luminance of the dark pixel.
Figure 19:
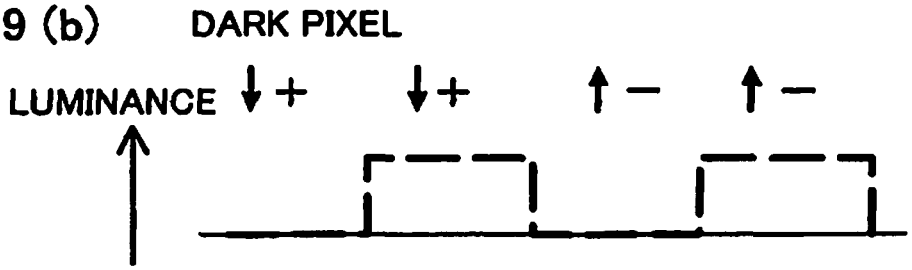

FIG. 19(*a*) and FIG. 19(*b*) are graphs, corresponding to the FIG. 18(*b*) and FIG. 18(*c*), each of which illustrates a luminance of the bright pixel and a luminance of the dark pixel.

Note that, each of symbols "↑" and "↓" in the figures indicates a state of the auxiliary signal just after occurrence of the drawing phenomenon (whether the auxiliary signal rises or falls just after occurrence of the drawing phenomenon).

As illustrated in the figures, in this case, a polarity of the liquid crystal voltage is reversed in every frame. This operation is carried out in order to appropriately offset the liquid crystal voltages different from each other between sub-frames (in order that a total of the liquid crystal voltages in the two frames is 0V).

Each state (phase just after the drawing phenomenon; ↑ and ↓) of the auxiliary signal is reversed at the same phase as the polarity reverse.

When the driving is carried out in this way, the liquid crystal voltage (absolute value) and the luminance in both the sub-frames become high in the bright pixel, and the liquid crystal voltage and the luminance in both the sub-frames become low in the dark pixel, as illustrated in FIG. 18(*b*), FIG. 18(*c*), FIG. 19(*a*), and FIG. 19(*b*).

Moreover, in the former sub-frame, an increment of the liquid crystal voltage in the bright pixel is equal to a decrement of the liquid crystal voltage in the dark pixel. Similarly, in the latter sub-frame, an increment of the liquid crystal voltage in the bright pixel is equal to a decrement of the liquid crystal voltage in the dark pixel.

This prevents the unevenness in polarities of the liquid crystal voltages applied to the pixel. On this account, the total of the liquid crystal voltages can be made into 0V in two frames. (Note that, an increment (decrement) of the liquid crystal voltage in the former sub-frame due to the pixel-division driving is different from an increment (decrement) of the liquid crystal voltage in the latter sub-frame due to the pixel-division driving. This is because the capacitance vanes according to the transmissivity of the liquid crystal.)

Here, in the aforementioned description, the polarity of the liquid crystal voltage applied to the sub-pixel is reversed in every frame. However, the present invention is not limited to this, and the polarity of the liquid crystal voltage may be reversed at a frame cycle.

Therefore, as illustrated in FIG. 13(*b*), each of the liquid crystal voltages may have a reverse polarity between the sub-frames of the single frame, and may have the same polarity between the latter sub-frame and a former sub-frame of a frame occurring subsequent to the frame.

Figure 20:
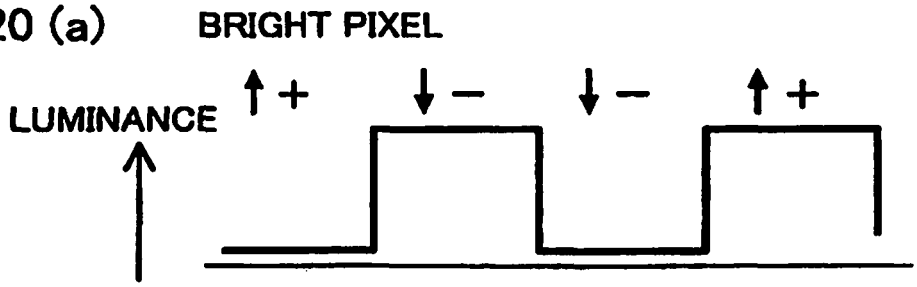
FIGS. 20(*a*) and 20(*b*) are graphs which respectively illustrate a luminance of the bright pixel and a luminance of the dark pixel in case of carrying out polarity reverse at a frame cycle.
Figure 20:
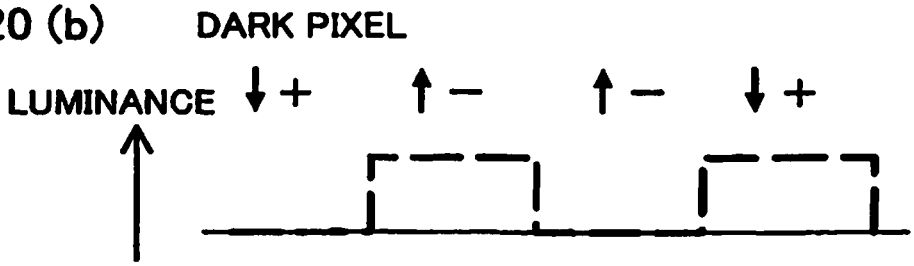

FIG. 20(*a*) and FIG. 20(*b*) are graphs which respectively illustrate the luminance in the bright pixel and the luminance in the dark pixel in case of carrying out such polarity reverse.

Also in this case, each state (↑ and ↓) of the auxiliary signal is reversed at the same phase as the polarity reverse. Thus, a total of the liquid crystal voltages can be made into 0V.

Figure 21:
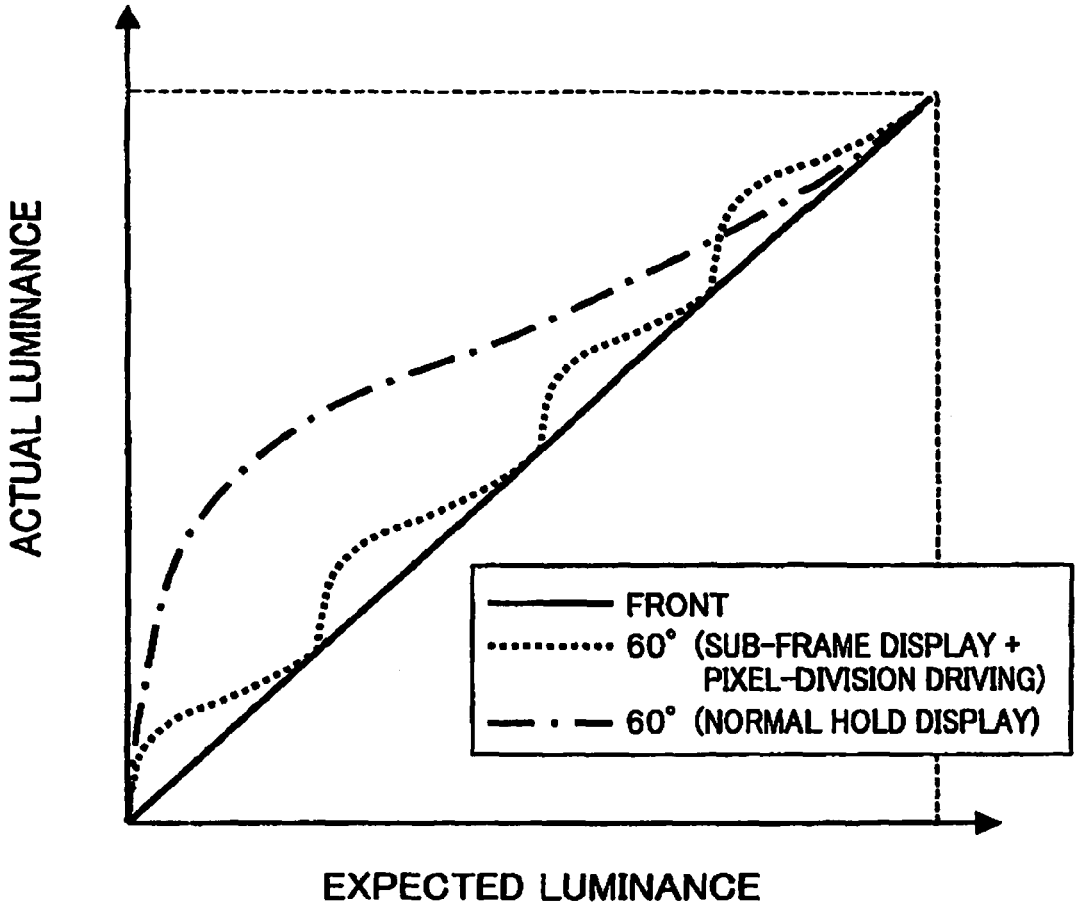
FIG. 21 is a graph illustrating a result (indicated by a broken line and a continuous line) of display carried out by combining the polarity-reverse driving with the pixel-division driving and a result (indicated by a chain line and a continuous line) of the normal hold display.

FIG. 21 is a graph illustrating (i) a result (indicated by a broken line and a continuous line) of display carried out in combination with the sub-frame display, the polarity-reverse driving, and the pixel-division driving and (ii) a result (indicated by a chain line and a continuous line in the same manner as in FIG. 2) of the normal hold display.

As illustrated in the graph, by carrying out the sub-frame display and the pixel-division driving in combination, the actual luminance can be very close to the expected luminance at a viewing angle of 60°. That is, the viewing angle property can be greatly improved by the synergy effect of the sub-frame display and the pixel-division driving.

Note that, in the aforementioned description, each state (phase just after the drawing phenomenon; ↑ and ↓) of the auxiliary signal is reversed at the same phase as the polarity reverse. When the state of the auxiliary signal is changed in every sub-frame irrespective of the polarity reverse, the liquid crystal voltages cannot be offset appropriately.

That is, a variation amount of the liquid crystal voltage corresponding to a state of the auxiliary signal changes according to intensity (absolute value) of the original liquid crystal voltage (in case where the liquid crystal voltage is high, also the variation amount becomes large). Further, as described above, an increment (decrement) of the liquid crystal voltage due to the pixel-division driving varies between the former sub-frame and the latter sub-frame (in examples of FIG. 18(*b*) and FIG. 18(*c*), the variation amount of the latter sub-frame is larger than that of the former sub-frame).

Figure 22:
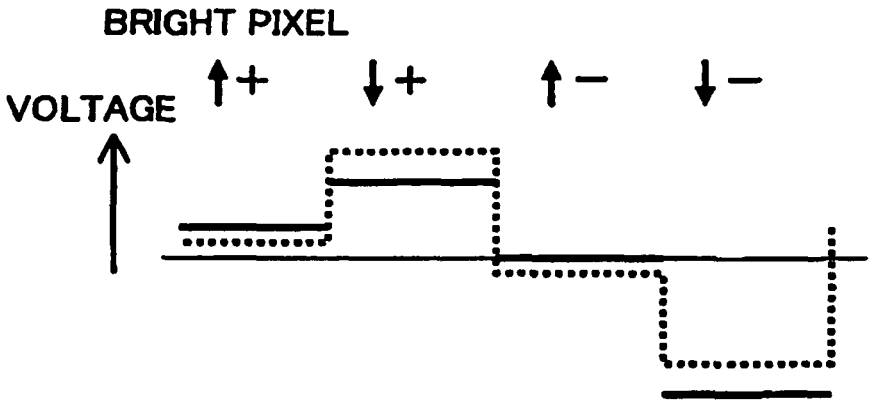
FIGS. 22(*a*) and 22(*b*) are graphs which respectively illustrate a luminance of the bright pixel and a luminance of the dark pixel in case of carrying out the polarity reverse at a sub-frame cycle.
Figure 22:
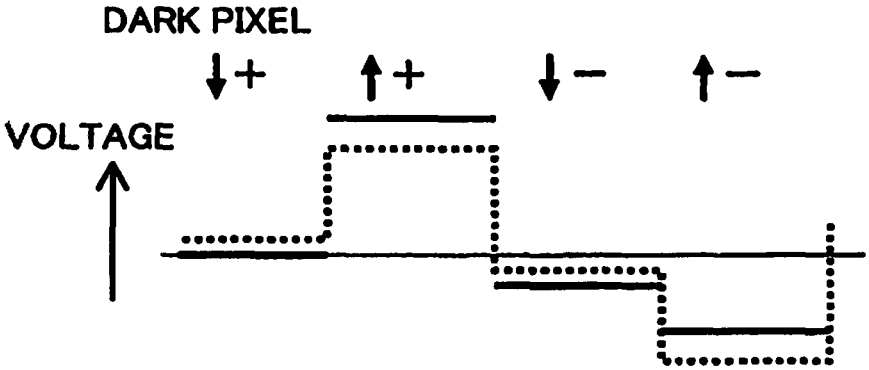

Thus, in case of applying the liquid crystal voltage as illustrated in FIG. 18(*a*), when the state (phase) of the auxiliary signal is reversed in each sub-frame, as illustrated in FIG. 22(*a*), the liquid crystal voltage of the latter sub-frame drastically drops in the bright pixel. Meanwhile, the liquid crystal voltage of the former sub-frame increases a little.

Further, as illustrated in FIG. 22(*b*), the liquid crystal voltage of the latter sub-frame greatly increases in the dark pixel, and the liquid crystal voltage of the former sub-frame decreases a little.

Therefore, a total liquid crystal voltage in whole the two frames cannot be made into 0V (negative in the bright pixel and positive in the dark pixel), and it is possible to cancel the direct current component of the liquid crystal voltage. Thus, it is impossible to sufficiently prevent the burning, the flicker, or the like.

Further, in the present embodiment, it is preferable to set the ratio (frame divisional ratio) of the former sub-frame period and the latter sub-frame period so as to range from 3:1 to 7:1. However, the present invention is not limited to this. The frame divisional ratio may be set to be 1:1 or 2:1.

For example, in case of setting the frame divisional ratio to be 1:1, the actual luminance can be made closer to the expected luminance as compared with the normal hold display as illustrated in FIG. 3. Further, also as to the brightness, the actual brightness can be made closer to the expected brightness as compared with the normal hold display as illustrated in FIG. 6.

Thus, also in this case, it is obvious that the viewing angle property can be improved as compared with the normal hold display.

Further, in the liquid crystal panel 21, it takes a time, corresponding to the response speed of the liquid crystal, for the liquid crystal voltage (voltage applied to the liquid crystal: inter-electrode voltage) to reach a value corresponding to the display signal. Thus, when one sub-frame period is too short, it may be impossible to raise the voltage of liquid crystal to be a value corresponding to the display signal within the period.

Therefore, by setting the ratio of the former sub-frame period and the latter sub-frame period to be 1:1 or 2:1, it is possible to prevent one sub-frame period from being too short. Thus, even when liquid crystal whose response speed is low is used, it is possible to appropriately carry out the display.

Further, the frame divisional ratio (ratio of the former sub-frame and the latter sub-frame) may be set to be n:1 (n is a natural number not less than 7).

Further, the divisional ratio may be set to be n:1 (n is a number not less than 1 (more preferably, n is a number more than 1)). For example, by setting the divisional ratio to be 1.5:1, it is possible to improve the viewing angle property as compared with the case where the divisional ratio is set to be 1:1. Further, it is easy to use the liquid crystal material whose response speed is low as compared with the case where the divisional ratio is set to be 2:1.

Further, even in case of setting the frame divisional ratio to be n:1 (n is a number not less than 1), when displaying an image having such a low luminance (low brightness) that "1(Tmax/(n+1))/(n+1) of the maximum luminance", it is preferable to carry out the display by using only the latter sub-frame.

Further, when displaying an image having a high luminance (high brightness) equal to or more than "Tmax/(n+1)", it is preferable to display the image by carrying out the white display in the latter sub-frame and adjusting only a luminance of the former sub-frame.

On this account, only a single sub-frame can be free from any difference between the actual luminance and the expected luminance. Thus, it is possible to improve the viewing angle property of the present display device.

Here, in case of dividing a frame at n:1, it is possible to obtain substantially the same effect when the former frame is n and when the latter frame is n. That is, the ratio of n:1 and the ratio of 1:n are identical with each other in terms of the improvement of the viewing angle.

Further, also in case where n is a number not less than 1, it is effective to control the luminance gradation by using the aforementioned equations (1) to (12).

Further, in the present embodiment, the present display device is arranged so as to carry out the sub-frame display by dividing a single frame into two sub-frames. However, the present invention is not limited to this. The present display device may be designed so as to carry out the sub-frame display by dividing a single frame into three or more sub-frames.

As to the sub-frame display carried out by dividing a single frame into m number of sub-frames, when the luminance is extremely low, the image is displayed by carrying out the black display in m−1 number of sub-frames and adjusting only a luminance (luminance gradation) of a single sub-frame. Further, when the luminance is too high to express only in this sub-frame, the white display is carried out in this sub-frame. Further, the image is displayed by carrying out the black display in m−2 number of sub-frames and adjusting a luminance of a left sub-frame.

That is, also in case of dividing a single frame into m number of sub-frames, as in the case of dividing a single frame into two sub-frames, it is preferable to adjust (vary) a luminance of only one sub-frame and to keep the white display or the black display in other sub-frames. Thus, m−1 number of sub-frames can be free from any difference between the actual luminance and the expected luminance. Therefore, it is possible to improve the viewing angle property of the present display device.

Figure 23:
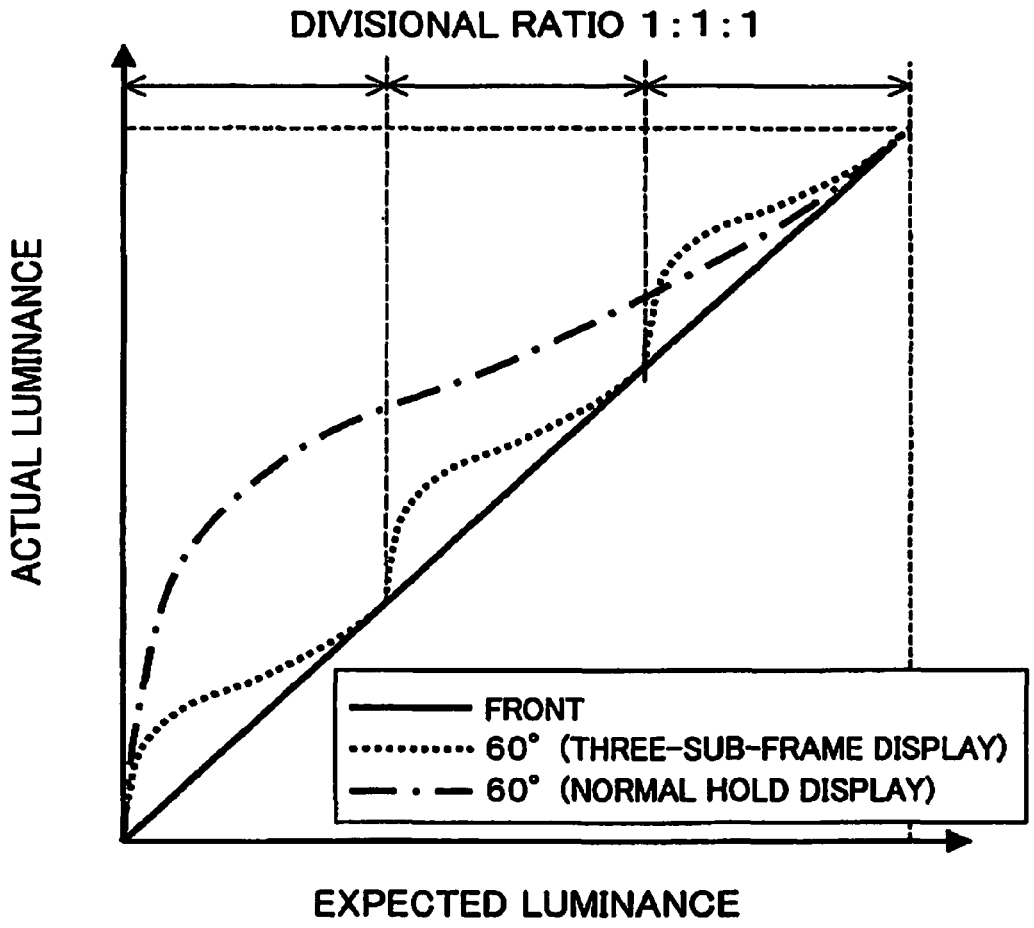
FIG. 23 is a graph illustrating a result (indicated by a broken line and a continuous line) of display carried out by evenly dividing a single frame into three sub-frames and a result (indicated by a chain line and a continuous line) of the normal hold display.

FIG. 23 is a graph illustrating a result (indicated by a broken line and a continuous line) of display carried out by evenly dividing a single frame into three sub-frames and a result (indicated by a chain line and a continuous line in the same as in FIG. 2) of the normal hold display.

As illustrated in this graph, when the number of sub-frames is increased to three, the actual luminance can be made closer to the expected luminance. This shows that it is possible to further improve the viewing angle property of the present display device.

Figure 24:
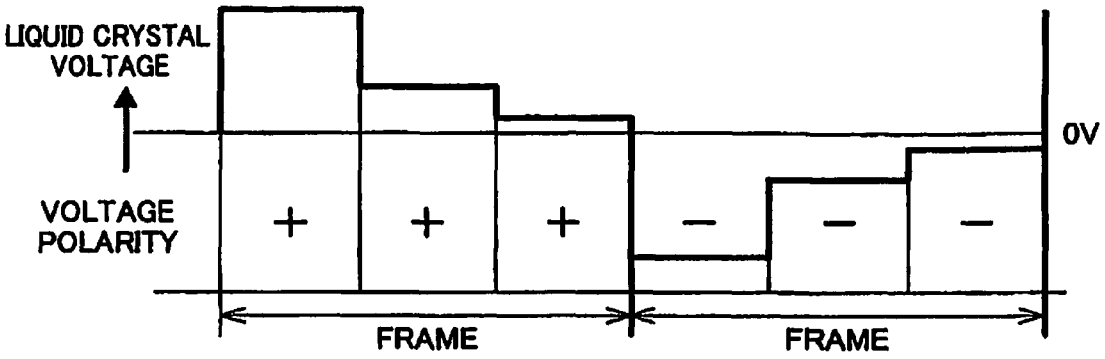
FIG. 24 is a graph illustrating transition of a liquid crystal voltage in case where a frame is divided into three and a voltage polarity is reversed in each frame.

Further, also in case of dividing a single frame into m number of sub-frames, it is preferable to carry out the aforementioned polarity-reverse driving. FIG. 24 is a graph illustrating transition of a liquid crystal voltage in case where a frame is divided into three and a voltage polarity is reversed in each frame.

As illustrated in FIG. 24, also in this case, a total liquid crystal voltage in two frames can be made into 0V.

Figure 25:
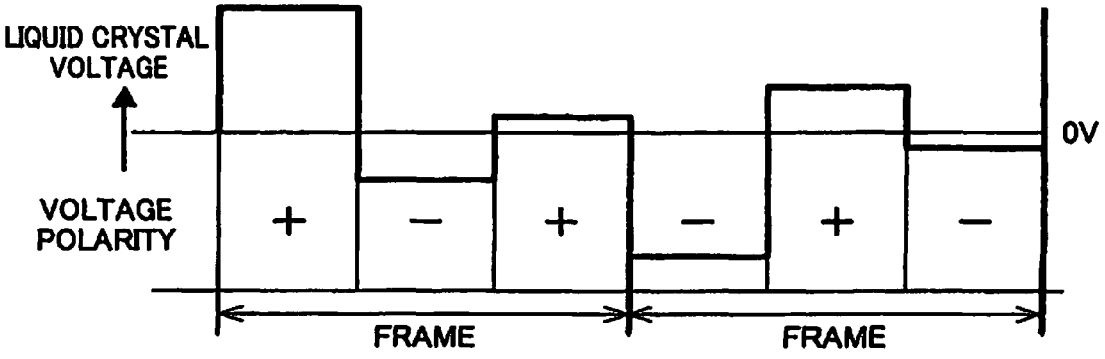
FIG. 25 is a graph illustrating transition of the liquid crystal voltage in case where a frame is divided into three and a voltage polarity is reversed in each sub-frame.

Further, FIG. 25 is a graph illustrating transition of the liquid crystal voltage in case where a frame is divided into three and a voltage polarity is reversed in each sub-frame.

In this way, when a frame is divided into an odd number of sub-frames, a total liquid crystal voltage in two frames can be made into 0V even in case where the voltage polarity is reversed in each sub-frame.

Thus, in case where a frame is divided into m number of sub-frames (m is an integer not less than 2), it is preferable to apply a liquid crystal voltage whose polarities are different from each other in an M-th sub-frame of one frame (M ranges from 1 to m) and in an M-th sub-frame of another frame adjacent to that frame (M ranges from 1 to m). Thus, a total liquid crystal voltage in two frames can be made into 0V.

In case where a frame is divided into m number of sub-frames (m is an integer not less than 2), it is preferable to reverse the polarity of the liquid crystal voltage so that a total liquid crystal voltage in two frames (or more frames) is made into 0V.

Further, in the foregoing description, when dividing a single frame into m number of sub-frames, a luminance of only a single sub-frame is adjusted, and the white display (maximum luminance) or the black display (minimum luminance) is carried out in other sub-frames.

However, the present invention is not limited to this. It may be so arranged that luminances of two or more sub-frames are adjusted. Also in this case, by carrying out the white display (maximum luminance) or the black display (minimum luminance) in at least one sub-frame, it is possible to improve the viewing angle property.

Further, a luminance of a sub-frame whose luminance is not adjusted may be set to be "a maximum value or a value larger than a second predetermined value instead of setting the luminance to be the maximum luminance. Further, the luminance may be set to be "a minimum value or a value smaller than a first predetermined value" instead of setting the luminance to be the minimum luminance.

Also in this case, it is possible to sufficiently reduce the difference (brightness difference) between the actual brightness and the expected brightness in the sub-frame whose luminance is not adjusted. Thus, it is possible to improve the viewing angle property of the present display device.

Figure 26:
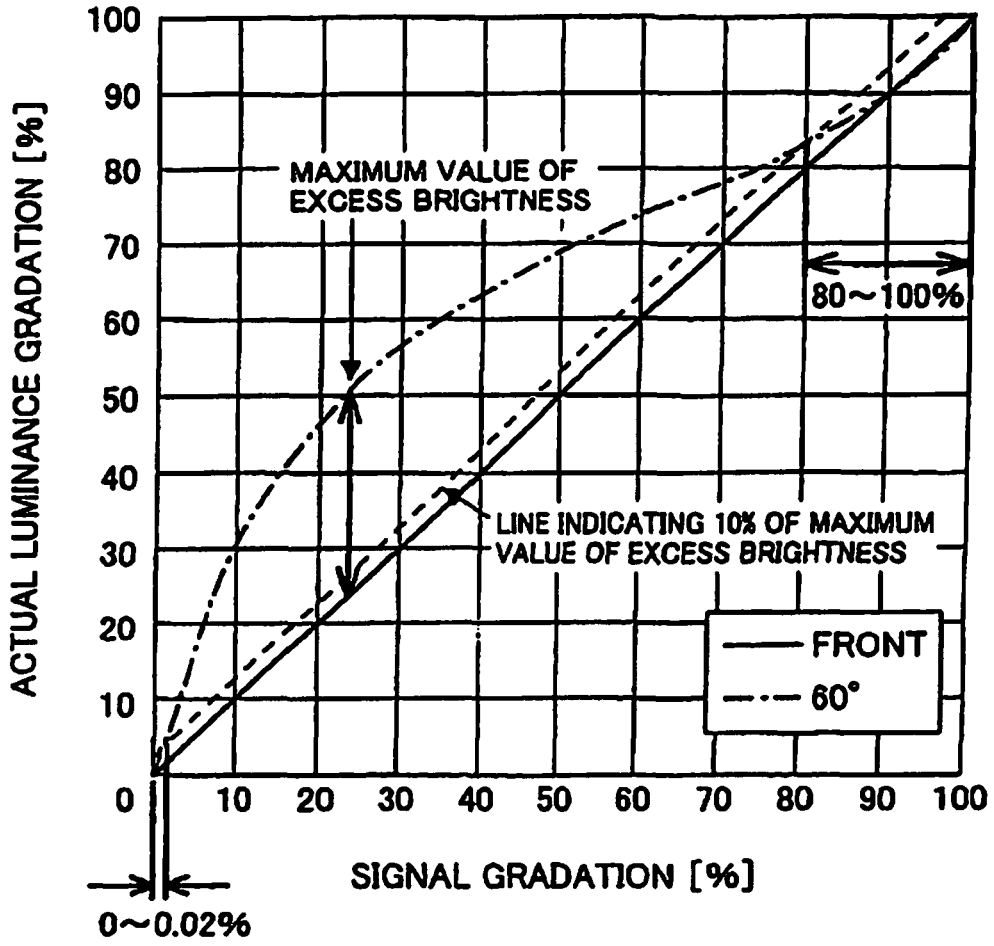
FIG. 26 is a graph for illustrating a relationship (viewing angle gradation property actual measurement) between a signal gradation (%: luminance gradation of a display signal) outputted to the display section 14 and an actual luminance gradation (%) according to each signal gradation in a sub-frame where the luminance is not adjusted.

Here, FIG. 26 is a graph for illustrating a relationship (viewing angle gradation property actual measurement) between a signal gradation (%: luminance gradation of a display signal) outputted to the display section 14 and an actual luminance gradation (%) according to each signal gradation in a sub-frame where the luminance is not adjusted.

Note that, the actual luminance gradation is obtained "by converting a luminance (actual luminance), outputted from the liquid crystal panel 21 of the display section 14 according to each signal gradation, into a luminance gradation on the basis of the foregoing equation (1)".

As illustrated in this graph, the foregoing two gradations are equal to each other in front (viewing angle=0°). Meanwhile, when the viewing angle is 60°, the excess brightness causes the actual luminance gradation to be brighter in the halftone than the signal gradation.

Further, the excess brightness reaches a maximum value regardless of the viewing angle when the luminance gradation is in a range from 20% to 30%. Here, it is found that: in a case where the excess brightness does not exceed "10% of the maximum value" indicated by a broken line of the graph, it is possible to sufficiently keep the display quality of the present display device (it is possible to sufficiently reduce the aforementioned brightness difference). Further, as to the signal gradation, its range which prevents the excess brightness from exceeding "10% of the maximum value" is 80 to 100% of the maximum value of the signal gradation and is 0 to 0.02% of the maximum value.

Further, each of these ranges does not vary even when the viewing angle varies. Thus, it is preferable to set the second predetermined value to 80% of the maximum luminance, and it preferable to set the first predetermined value to 0.02% of the maximum luminance.

Further, it may be so arranged that there is not provided the sub-frame whose luminance is not adjusted. That is, it may be so arranged that: in case of carrying out the display in m number of sub-frames, display states of the sub-frames are not differentiated from each other. Even in such an arrangement, it is preferable to carry out the polarity-reverse driving in which a polarity of the liquid crystal voltage is reversed at a frame cycle.

Note that, in case of carrying out the display in m number of sub-frames, a little difference between the sub-frames in terms of the display condition enables the viewing angle property of the liquid crystal panel 21 to be improved.

Further, in the foregoing description, all the processes in the present display device are controlled by the control section 15. However, the arrangement is not limited to this, and it may be so arranged that: a program for carrying out the processes is stored in a storage medium, and an information processing device which can read out the program is used instead of the control section 15.

In this arrangement, a computing device (CPU or MPU) of the information processing device reads out the program stored in the storage medium so as to carry out the processes. Thus, it can be said that the program itself realizes the processes.

Here, as the foregoing information processing device, it is possible to use not only a general computer (a workstation or a personal computer) but also a function extension board or a function extension unit provided on a computer.

Moreover, the program is a program code (an execute form program, intermediate code program, or source program) of software for implementing the aforementioned processes. This program may be used by itself or may be used in combination with other programs (OS or the like). Further, it may be so arranged that: the program is temporarily stored in a memory (RAM or the like) of the device after being read out from a storage medium, and is then read out again so as to implement the program.

Further, the storage medium storing the program may be a storage medium which is provided separable from the information processing device for implementing the program, or may be a medium which is fixedly provided on the information processing device. Alternatively, the storage medium may be connected to the information processing device as an external storage device.

Examples of the storage medium include tapes, such as magnetic tape and cassette tape; disks including magnetic disks, such as floppy disks (registered trademark) and hard disk, and optical disks, such as CD-ROMs, MOs, MDs, DVDs, and CD-Rs; cards, such as IC card (including memory cards) and optical cards; and semiconductor memories, such as mask ROMs, EPROMs, EEPROMs, and flash ROMs.

Further, it is possible to use a storage medium which is connected to the information processing device via a network (intranet/internet or the like). In this case, the information processing device obtains a program by downloading the program via the network. That is, it may be so arranged that: the program is obtained via a transmission medium (medium for fluidly holding the program) such as the network (connected to a fixed line or a radio line). Note that, it is preferable that a program for downloading is stored in the information processing device (or a sending side device or a receiving side device) in advance.

As described above, a display device (present display device) of the present invention (ｸﾚｰﾑ 1), dividing a single frame into m number of sub-frames, where m is an integer not less than 2, so as to display an image, said display device is characterized by including:

a display section for displaying an image whose luminance is based on a luminance gradation of a display signal that has been inputted; and a control section for generating first to m-th display signals which are display signals in first to m-th sub-frames so that division of the frame does not vary a total luminance outputted from the display section in a single frame and for outputting the first to m-th display signals to the display section, wherein the control section is designed so that the control section sets a luminance gradation of at least one of the first to m-th display signals to "a minimum value or a value smaller than a first predetermined value" or "a maximum value or a value larger than a second predetermined value" and adjusts a luminance gradation of each of other display signals so as to display an image.

The present display device displays an image by using the display section provided with a display screen such as a liquid crystal panel.

Further, the present display device drives the display section by carrying out sub-frame display. Here, the sub-frame display is a display method in which a single frame is divided into a plurality of (in the present display device, m number of) sub-frames (the first to m-th sub-frames) so as to display an image.

That is, the control section outputs display signals to the display section m times (sequentially outputs the first to m-th display signals which are display signals in the first to m-th sub frames).

On this account, the control section turns ON all gate lines of the display screen of the display section once in each sub-frame period (turns ON the gate line m times in each frame).

Further, it is preferable that the control section obtains an output frequency (clock) of each display signal by multiplying a normal hold display output frequency by m (obtains an m-fold clock).

Note that, the normal hold display is normal display which is carried out without dividing a single frame into sub-frames (display which is carried out by turning ON all gate lines of the display screen only once in each frame period).

Further, the display section (display screen) is designed so as to display an image whose luminance is based on a luminance gradation of the display signal that has been inputted from the control section.

Further, the control section generates the first to m-th display signals (sets luminance gradations of these display signals) so that division of the frame does not vary a total luminance (entire luminance) outputted from the screen in a single frame.

Normally, in the display screen of the display section, a difference (brightness difference) between an actual brightness and an expected brightness at a wide viewing angle is sufficiently small in case of setting a brightness (and a luminance) of the image to "a minimum value or a value smaller than a first predetermined value" or "a maximum value or a value larger than a second predetermined value".

Here, it is natural that the brightness difference can be made smallest in case where the luminance gradation is minimum or maximum. However, actually, it is found that it is possible to obtain the same effect merely by bringing the luminance gradation close to minimum or maximum (for example, merely setting the luminance gradation to not more than 0.02% or more than 80% of the maximum).

Here, the "brightness" means a degree of brightness sensed by a human according to a luminance of a displayed image (see equations (5) and (6) in embodiments described later). Note that, in case where a total luminance obtained in a single frame does not vary, also a brightness obtained in a single frame does not vary.

Further, the "expected brightness" means a brightness that should be displayed in a displayed image (a value corresponding to a luminance gradation of the display signal).

Further, the "actual brightness" means a brightness actually displayed in the image, and is a value which varies depending on a viewing angle. In front of the image, the actual brightness and the expected brightness are equal with each other, so that there is no brightness difference. Meanwhile, the brightness difference is larger as the viewing angle is wider.

Further, in the present display device, when displaying an image, the control section sets a luminance gradation of at least one of the first to m-th display signals to "a minimum value or a value smaller than a first predetermined value" or "a maximum value or a value larger than a second predetermined value", and adjusts a luminance gradation of each of other display signals, so as to carry out the gradation expression.

Thus, it is possible to sufficiently reduce the brightness difference in at least a single sub-frame. On this account, the present display device can suppress the brightness difference as compared with the case of carrying out the normal hold display, so that it is possible to improve the viewing angle property. Thus, it is possible to favorably suppress the excess brightness.

Moreover, usually, in the display screen of the display section, in case where the brightness (and the luminance) of the image is minimum or maximum, the difference between the actual luminance and the expected luminance when the viewing angle is large can be minimized (0). Therefore, it is preferable that the control section carry out the gradation expression by maximizing or minimizing the luminance gradation of at least one of the first to m-th display signals and by adjusting the luminance gradation of the other display signal.

This makes it possible to minimize the difference of the brightness in at least one sub-frame, so that it is possible to further improve the viewing angle property.

Moreover, in the present display device, it is preferable that the control section be designed so as to display an image by setting the luminance gradations of m−1 display signals in the first to m-th display signals to "a minimum value or a value smaller than a first predetermined value" or "a maximum value or a value larger than a second predetermined value", and by adjusting the luminance gradation of one display signal.

In this case, it is possible to sufficiently reduce the difference of the brightness in m−1 sub-frames. Therefore, in the present display device, as compared with carrying out the normal hold display, the difference of the brightness can be suppressed so as to be very small, so that it is possible to greatly improve the viewing angle property.

Here, in case where m is 2 (in case where one frame is divided into two sub-frames (the first and second sub-frames), the control section just have to generate only two display signals (the first and second display signals). Therefore, it is possible to reduce burdens of the control section.

In a case where the display screen of the display section is composed of the liquid crystal panel, it takes a time, corresponding to the response speed of the liquid crystal, for the voltage of the liquid crystal to be a value corresponding to the display signal. Therefore, in case where the number of the sub-frames is excessively increased, a period corresponding to each of the sub-frames becomes too short, so that there is a possibility that the voltage of the liquid crystal cannot be increased to be a value corresponding to the display signal within the period. Therefore, in case where m is 2, it is possible to properly display an image even by the liquid crystal whose response speed is low.

Moreover, in this case, a ratio of the period corresponding to the first sub-frame and the period corresponding to the second sub-frame may be set in any ratio. That is, in case where the ratio is 1:n, n may be any number not less than 1 (preferably, a number more than 1).

However, it is preferable that n is 7 or less in terms of a human visual sense property explained later. Particularly, in case where the display screen of the display section is composed of the liquid crystal panel, there occurs the problem in the response speed of the liquid crystal. Therefore, by setting the ratio of the period corresponding to the first sub-frame and the period corresponding to the second sub-frame to be from 1:1 to 1:2, it is possible to prevent one of the periods of the sub-frames from being too short. Therefore, it is possible to properly display an image even by the liquid crystal whose response speed is low.

Moreover, in case of displaying an image by two sub-frames (in case where m is 2), it is also preferable that a divisional point of the frame is a point which allows each of the first sub-frame and the second sub-frame to minimize the difference between the actual brightness and the expected brightness (point which maximizes the luminance of the first display signal and minimizes the luminance of the second display signal).

Moreover, in case of displaying an image by two sub-frames, the control section can generate the first display signal and the second display signal in the following way.

First, the control section calculates Lt represented by $$Lt=(1/(n+1))\hat{}(1/\gamma)\times L\max$$

in accordance with (i) the maximum luminance Lmax of an image displayed in a single frame and (ii) a predetermined value γ.

Next, the control section judges whether or not a frame gradation L, which is the luminance gradation of the display signal outputted in case of carrying out the normal hold display, is not more than Lt.

Then, in case where the frame gradation L is not more than Lt, the control section sets the luminance gradation F of the second display signal to be minimum (0), and sets the luminance gradation R of the first display signal so that $$R=(1/n+1))\hat{}(1/\gamma)\times L.$$

Further, in case where the frame gradation L is more than Lt, the control section sets the luminance gradation R of the first display signal to be maximum, and sets the luminance gradation F of the second display signal so that $$F=((L\hat{}\gamma-(1/n+1))\times L\max\hat{}\gamma))\hat{}(1/\gamma).$$

In this way, it is possible to easily generate the first and second display signals.

Moreover, as above, in case of carrying out the sub-frame display in which the ratio of the period corresponding to the first sub-frame and the period corresponding to the second sub-frame is 1:n, as for output operations of the display signals, for example, it is preferable that the first display signal and the second display signal obtained as above be alternately outputted to the display section with a difference of 1/(n+1) cycle. That is, in case of dividing a single frame at 1:n, the first display signal and the second display signal are alternately outputted in each line display while keeping a divided time width, so that it is possible to always keep an output frequency of the display signal at a doubled clock. That is, normally, in case of carrying out the division at 1:n, the output frequency is multiplied by n+1 in a simple arrangement. However, according to the foregoing arrangement, it is possible to keep the output frequency at a doubled clock. Thus, it is possible to carry out the sub-frame display at low cost.

Moreover, in the present display device, it is preferable that the display screen of the display section be composed of the liquid crystal panel. The excess brightness phenomenon described above can be seen conspicuously in the liquid crystal panel. Therefore, the sub-frame display of the present display device is especially effective in an arrangement having the display screen of the liquid crystal panel.

Moreover, the excess brightness phenomenon of the liquid crystal panel becomes conspicuous in case of the liquid crystal panel (for example, VA mode) whose display luminance becomes intense with an increase in the viewing angle. Therefore, the sub-frame display of the present display device is especially effective in an arrangement having the liquid crystal panel.

Moreover, in the present display device, in case where the display is carried out by two sub-frames, the display signals are outputted at a doubled clock, so that it may not be effective when the response speed of the liquid crystal in the liquid crystal panel is low.

Further, when the present display device is arranged so that the display is carried out by two-sub frames and the display signal is outputted at a doubled clock, this arrangement is sometimes ineffective in case where the response speed of the liquid crystal in the liquid crystal panel is so low that it is impossible to obtain sufficient response within a single sub-frame.

Therefore, it is preferable that the control section be designed so as to (i) judge whether or not a liquid crystal response speed of the liquid crystal panel satisfies the following conditions (c) and (d), and (ii) carry out the normal hold display in case where the liquid crystal response speed of the liquid crystal panel does not satisfy the following conditions (c) and (d).

(c) When a voltage signal is given to the liquid crystal, displaying an image having the minimum brightness (minimum luminance), in order to change the image having the minimum brightness into the image having the maximum brightness (maximum luminance), the voltage of the liquid crystal reaches a value not less than 90% of the voltage of the voltage signal in a period corresponding to the first sub-frame.

(d) When a voltage signal is given to the liquid crystal, displaying an image having the maximum brightness (maximum luminance), in order to change the image having the maximum brightness into the image having the minimum brightness (minimum luminance), the voltage of the liquid crystal reaches a value not more than 5% of the voltage of the voltage signal in a period corresponding to the first sub-frame.

Note that, the above-described voltage signal is a signal applied to the liquid crystal according to the display signal.

Moreover, in the normal hold display, it is preferable that the control section drive the liquid crystal panel with a gradation voltage, applied to the liquid crystal panel, which is alternated. This is because, by driving the liquid crystal panel by the alternating current, it is possible to change the electric charge polarity (direction of the voltage (inter-electrode voltage) between the pixel electrodes sandwiching the liquid crystal) of the pixel per frame.

If the liquid crystal panel is driven with a direct current, a biased voltage is applied between the electrodes, so that the electrodes are electrically charged. In case where this state is continued, a state in which the electric potential difference is generated between the electrodes (a state called "burning") occurs even when a voltage is not applied.

Here, in case of carrying out the sub-frame display like the present display device does, in many cases, values (absolute values) of a voltage applied between the pixel electrodes are different between the sub-frames.

Therefore, in case of changing the polarity of the inter-electrode voltage at the sub-frame cycle like a normal driving method, the voltage difference between the sub-frames may cause an applied inter-electrode voltage to be biased. In such case, when the liquid crystal panel is driven for a long time, the electrodes are electrically charged, so that there is a possibility that the burning, flicker, or the like drawback occurs.

Therefore, in case of the present display device, it is preferable that the polarity of the inter-electrode voltage be changed at the frame cycle.

Such polarity conversion method is effective also in case of dividing a single frame into two sub-frames. Further, this method is effective also in case where a single frame is divided into two sub-frames (two sub-fields) and the divisional is carried out at a divisional ratio of 1:n.

For example, in case of carrying out the display with two sub-frames, there are two methods for changing the polarity of the inter-electrode voltage at the frame cycle.

One method is that the polarity of the voltage applied to the liquid crystal in the first sub-frame is the same as the polarity of the voltage applied to the liquid crystal in the second sub-frame (a single-polar voltage is applied to the liquid crystal in a single frame), but the polarity of the voltage applied to the liquid crystal in a frame is different from the polarity of the voltage applied to the liquid crystal in a frame adjacent to that frame.

Moreover, another method is that polarities of the voltage applied to the liquid crystal in two sub-frames of a single frame are differentiated from each other, and the polarities of the voltage are equalized with each other in the first sub-frame of a frame and in the second sub-frame of the other frame adjacent to the above-described first sub-frame.

As described above, even in case where the inter-electrode voltages are largely different from each other between the sub-frames, it is possible to cancel a total voltage applied to the pixel electrodes of liquid crystal in two frames by alternating the inter-electrode voltage at the frame cycle, so that it is possible to prevent the burning and the flicker.

Note that, in the present display device, the control section usually generates the display signals, inputted to the display section, by utilizing the image signal inputted from outside and a relation table indicative of a relationship between the image signal and the display signal.

Here, the above-described relation table is generally called LUT (look-up table).

Incidentally, the response property and the gradation luminance property of the display screen (display panel) such as the liquid crystal panel changes according to the environmental temperature (temperature (air temperature) of the environment surrounding the display section). On this account, an optimal display signal corresponding to the image signal also changes according to the environmental temperature.

Therefore, it is preferable to provide a plurality of relation tables (LUT) covering temperature ranges different from each other in the present display device.

Then, it is preferable that the control section be designed so as to select and use the relation table corresponding to the environmental temperature.

This arrangement makes it possible to send a more appropriate display signal, generated from the image signal, to the display section. Therefore, the image display can be carried out with appropriate luminance (brightness) in any temperature ranges assumable (for example, from 0° C. to 65° C.).

Moreover, in the present display device, a pixel in the display section may be constituted of two sub-pixels connected to a single source line and a single gate line.

In this case, it is preferable that: with respect to at least one display signal voltage, the control section sets a luminance of the first sub-pixel to the first luminance and sets a luminance of the second sub-pixel to the second luminance different from the first luminance (pixel-division driving). Further, in case of displaying a half-tone luminance (luminance other than white and black), the control section may carry out the display while differentiating display luminances of the sub-pixels.

Moreover, in this case, it is preferable that the control section set the luminance gradation of each of the sub-pixels so that a total value of the luminance outputted from each of the sub-pixels becomes the luminance corresponding to the display signal.

In this case, as compared with a case of carrying out the display with an entire pixel, the luminance (brightness) of both the sub-pixels can be set to be close to maximum or minimum. Therefore, it is possible to further improve the viewing angle property of the present display device.

For example, by setting the luminance of one sub-pixel to be black display (white display), and by adjusting the luminance of the other sub-frame, it is possible to display an image whose luminance is low (high). In this way, it is possible to minimize the difference between the display luminance and the actual luminance in the one sub-pixel. Note that, in this case, it is not necessary that the black display (white display) is carried out in one sub-pixel. That is, when the sub-pixels are different from each other in terms of the luminance, it is possible to improve the viewing angle in principle. In the foregoing arrangement, the pixel-division driving and the sub-frame display are used in combination. Therefore, a synergy effect of the sub-frame display and the pixel-division driving makes it possible to extremely favorably improve the viewing angle property.

Further, an arrangement for carrying out the above-described pixel-division driving can be designed in the following way.

First, the sub-pixels are connected to auxiliary lines different from each other. Then, each of the sub-pixels includes (i) a pixel capacitor, (ii) a switching element for applying the display signal, which has been applied to the source line, to the pixel capacitor when the gate line turns ON, and (iii) an auxiliary capacitor connected to the pixel capacitor and each of the auxiliary lines.

Then, the control section differentiate auxiliary signals, flowing in the auxiliary lines connected to the sub-pixels, from each other. In this way, values of the voltage applied to the pixel capacitor of the sub-pixel can be differentiated from each other.

Moreover, as described above, in case where the sub-frame display is carried out, when the display screen of the display section is the liquid crystal panel, it is preferable that the control section change the polarity of the voltage applied to the liquid crystal of each of the sub-pixels at a frame cycle.

Then, similarly, also in case where the sub-frame display and the pixel-division driving are carried out in combination, when the display screen of the display section is the liquid crystal panel, it is preferable that the control section change the polarity of the voltage applied to the liquid crystal of each of the sub-pixels at a frame cycle.

In this way, even in case where the voltages applied to the liquid crystal are different from each other between the sub-frames, it is possible to totally offset the liquid crystal voltages in two frames.

Moreover, in an arrangement in which the above-described auxiliary signal differentiates the luminances of the sub-frames, it is preferable that the control section change the polarity of the voltage applied to the liquid crystal of each of the sub-pixels at a frame cycle and reverse a phase of the auxiliary signal at a frame cycle (it is more preferable that also timings thereof are identical with each other).

Moreover, in the above description, the control section sets a luminance gradation of at least one of the first to m-th display signals to "a minimum value or a value smaller than a first predetermined value" or "a maximum value or a value larger than a second predetermined value" and adjusts a luminance gradation of each of other display signals so as to display an image.

However, the present invention is not limited to this, but the control section may adjust the luminance gradations of all the display signals so as to display an image.

Moreover, also in this arrangement, in case where the display screen of the display section is the liquid crystal panel, it is preferable that the control section change the polarity of the voltage applied to the liquid crystal at a frame cycle.

In this way, even in case where the voltages applied to the liquid crystal are different between the sub-frames, it is possible to totally offset the liquid crystal voltages in two frames. Therefore, it is possible to prevent the above-described burning, flicker, and the like drawbacks.

Moreover, in case where m is 2 in the present display device, it is preferable to arrange the present display device as follows.

A display device, dividing a single frame into two sub-frames which are a first and second sub-frames, so as to display an image, the display device including:

a display section for displaying an image whose luminance is based on a luminance gradation of a display signal that has been inputted; and a control section for generating a first display signal which is a display signal of the first sub-frame and a second display signal which is a display signal of the second sub-frame so that division of the frame does not vary the total of the luminance outputted from the display section in a single frame and for outputting the first ad second display signals to the display section at a doubled clock, wherein the control section is designed so that the luminance gradation of the first display signal is adjusted and the luminance gradation of the second display signal is minimized in case of displaying an image whose brightness is low, and the luminance gradation of the first display signal is maximized and the luminance gradation of the second display signal is adjusted in case of displaying an image whose brightness is high, and the frame is divided so that a ratio of the period corresponding to the first sub-frame and the period corresponding to the second sub-frame is 1:n (n is a natural number not less than 1).

Moreover, in case where the display screen of the present display device is the liquid crystal panel, a combination of the present display device and the image signal input section (signal input section) makes it possible to constitute a liquid crystal monitor used for a personal computer, etc.

Here, the image signal input section conveys the image signal, inputted from outside, to the control section.

In this arrangement, the control section of the present display device generates the display signal and outputs it to the display section according to the image signal conveyed from the image signal input section.

Moreover, in case where the display screen of the present display device is the liquid crystal panel, a combination of the present display device and the tuner section makes it possible to constitute the liquid crystal television receiver.

Here, the tuner section selects a channel of a television broadcasting signal and conveys a television image signal of the channel thus selected to the control section.

In this arrangement, the control section of the present display device generates the display signal and outputs it to the display section according to the television image signal conveyed from the tuner section.

Moreover, a method of the present invention for displaying an image can be described by each of the following first to fifth methods for displaying an image. That is, the first method is a method of displaying an image by dividing a single frame into m number of sub-frames where m is an integer not less than 2, the method including an outputting step for generating first to m-th display signals which are display signals in first to m-th sub-frames so that division of the frame does not vary the total of the luminance outputted from the display section in a single frame and for outputting the first to m-th display signals to the display section at an m-fold clock, wherein the control section is designed so that the control section sets a luminance gradation of at least one of the first to m-th display signals to "a minimum value or a value smaller than a first predetermined value" or "a maximum value or a value larger than a second predetermined value" and adjusts a luminance gradation of each of other display signals so as to display an image.

Moreover, the second method of displaying an image is a method of displaying an image by dividing a single frame into m number of sub-frames where m is an integer not less than 2, said method comprising an outputting step for generating first to m-th display signals which are display signals in first to m-th sub-frames so that division of the frame does not vary a total luminance outputted from the display section in a single frame and for outputting the first to m-th display signals to the display section, wherein each of pixels provided on the display section varies its luminance according to a voltage of each of the first to m-th display signals, and the pixel has first and second sub-pixels connected to a single source line and a single gate line, and the outputting step is such that: a luminance of the first sub-pixel is set to a first luminance and a luminance of the second sub-pixel is set to a second luminance, different from the first luminance, with respect to at least one display signal voltage.

Further, the third method of displaying an image is a method of displaying an image by dividing a single frame into two sub-frames as first and second sub-frames, said method comprising an outputting step for generating a first display signal which is a display signal in the first sub-frame and a second display signal which is a display signal in the second sub-frame so that division of the frame does not vary a total luminance outputted from the display section in a single frame and for outputting the first and second display signals to the display section, wherein the outputting step is such that:

a luminance gradation of the first display signal is adjusted and a luminance gradation of the second display signal is set to a minimum value or a value smaller than a first predetermined value, and the luminance gradation of the first display signal is set to a maximum value or a value larger than a second predetermined value and the luminance gradation of the second display signal is adjusted in case of displaying an image whose brightness is high, and the frame is divided so that a ratio of a period corresponding to the first sub-frame and a period corresponding to the second sub-frame is 1:n where n is a number more than 1.

Further, the fourth method of displaying an image is a method of displaying an image by dividing a single frame into m number of sub-frames where n is an integer not less than 2, said method comprising an outputting step for generating first to m-th display signals which are display signals in first to m-th sub-frames so that division of the frame does not vary a total luminance outputted from the display section in a single frame and for outputting the first to m-th display signals to the display section, wherein the display section is set so as to cause a liquid crystal panel to display an image, and the outputting step is such that a polarity of a voltage applied to liquid crystal is varied at a frame cycle.

Moreover, the fifth method of displaying an image is a method of displaying an image by dividing a single frame into two sub-frames as first and second sub-frames, the method including an outputting step for generating a first display signal which is a display signal in a first sub-frame and a second display signal which is a display signal in a second sub-frame so that division of the frame does not vary the total of the luminance outputted from the display section in a single frame and for outputting the first and second display signals to the display section at a doubled clock, wherein the outputting step is such that:

a luminance gradation of the first display signal is adjusted and a luminance gradation of the second display signal is minimized in case of displaying an image whose brightness is low, and the luminance gradation of the first display signal is maximized and the luminance gradation of the second display signal is adjusted in case of displaying an image whose brightness is high, and the frame is divided so that a ratio of a period corresponding to the first sub-frame and a period corresponding to the second sub-frame is 1:n (n is a natural number not less than 1:preferably, ranges from 1 to 7).

Each of these first to fifth methods of displaying an image is used in the above-described present display device. Therefore, as compared with an arrangement carrying out the normal hold display, it is possible to reduce the difference roughly by half by using each of these methods. As a result, it is possible to suppress the excess brightness caused by the difference, or it is possible to prevent the burning of the display screen, flicker, and the like drawbacks.

Moreover, a display program of the present invention causes a computer provided with a display section including the display screen (for example, the liquid crystal panel) to carry out the outputting step of any one of the above-described first to third methods.

The above-described computer reads the program so as to carry out the outputting step of any one of the first to third methods.

Moreover, by recording the program in a recording medium readable by a computer, the program can be easily saved and distributed.

Moreover, the display device of the present invention can be described also as follows.

That is, the display device of the present invention (present display device) is a display device of displaying an image by dividing a single frame into two sub-frames as the first and second sub-frames, the display device, including: a display section for displaying an image whose luminance is based on a luminance gradation of a display signal that has been inputted; and a control section for generating a first display signal which is a display signal of the first sub-frame and a second display signal which is a display signal of the second sub-frame so that division of the frame does not vary the total of the luminance outputted from the display section in a single frame and for outputting the first ad second display signals to the display section at a doubled clock, wherein the control section is designed so that the luminance gradation of the first display signal is adjusted and the luminance gradation of the second display signal is minimized in case of displaying an image whose brightness is low, and the luminance gradation of the first display signal is maximized and the luminance gradation of the second display signal is adjusted in case of displaying an image whose brightness is high, and the frame is divided so that a ratio of the period corresponding to the first sub-frame and the period corresponding to the second sub-frame is 1:n (n is a natural number not less than 1).

The present display device displays an image by using the display section including the display screen such as the liquid crystal panel.

Moreover, in the present display device, the control section drives the display section by the sub-frame display. Here, the sub-frame display is a method of displaying an image by dividing a single frame into a plurality (two sub-frames in the present display device) of sub-frames (first and second sub-frames).

That is, the control section outputs the display signal to the display section twice in a single frame period (outputs the first display signal which is a display signal in the first sub-frame and the second display signal which is a display signal in the second sub-frame).

Therefore, the control section causes all the gate lines of the display screen of the display section to be turned ON once in each of the sub-frame periods (that is, turned ON twice in a single frame period).

Moreover, the control section operates so that the output frequency (clock) of the display signal becomes twice as high as the output frequency (doubled clock) when the normal hold display is carried out.

Note that, the normal hold display is a normal display carried out without dividing a single frame into sub-frames (display carried out by turning ON all the gate lines of the display screen only once in a single frame period).

Moreover, the display section (display screen) is so designed as to display an image whose luminance is based on the luminance gradation of the display signal which has been inputted from the control section.

Then, the control section generates the first display signal and the second display signal (sets the luminance gradations of the first and second display signals) so that division of the frame does not vary the total of the luminance (total luminance) outputted from the display section in a single frame.

Moreover, in the display screen of the display section, it is usual that: in case where the brightness (and the luminance) of an image is minimum or maximum, the difference between the expected luminance and the actual luminance at a large viewing angle becomes minimum (0).

Here, the brightness corresponds to the luminance of a displayed image, and is the degree of brightness felt by humans (see equations (5) and (6) in the following embodiment). Note that, in case where the total of the luminance outputted in a single frame does not vary, the total of the brightness outputted in a single frame does not vary, either.

Moreover, the expected brightness is the brightness (value corresponding to the luminance gradation of the display signal) which should be outputted from the display screen.

Moreover, the actual brightness is the brightness which is actually outputted from the screen and is a value which varies according to the viewing angle. Moreover, the actual brightness and the expected brightness are the same when viewed perpendicularly with respect to the front surface of the screen.

Then, in the present display device, in case of displaying an image whose brightness is low (in case where it is possible to display the total brightness only in the first sub-frame), the control section carries out the gradation expression by minimizing the luminance gradation of the second display signal and by adjusting the luminance gradation of the first display signal.

Therefore, because the brightness displayed in the second sub-frame is minimum, the difference in the second sub-frame can be minimized.

Meanwhile, in case of displaying an image whose brightness is high (in case where it is impossible to display the total brightness only in the first sub-frame), the control section carries out the gradation expression by maximizing the luminance gradation of the first display signal and by adjusting the luminance gradation of the second display signal. On this account, in this case, because the brightness of an image displayed in the first sub-frame is maximum, the difference in the first sub-frame can be minimized.

Further, in the present display device, the control section is designed so as to divide a frame into the first sub-frame and the second sub-frame, so that a ratio of the period corresponding to the first sub-frame and the period corresponding to the second sub-frame is 1:n (n is a natural number not less than 1).

Here, in case where the display screen of the display section is composed of the liquid crystal panel, it takes a time, corresponding to the response speed of the liquid crystal, for the voltage of the liquid crystal to be a value corresponding to the display signal. Therefore, in case where a period corresponding to any one of the sub-frames is too short, there is a possibility that the voltage of the liquid crystal cannot be increased within the period so as to be a value corresponding to the display signal.

Therefore, by setting the ratio of the period corresponding to the first sub-frame and the period corresponding to the second sub-frame to be 1:1 or 1:2, it is possible to prevent one of the sub-frame periods from being too short. Therefore, it is possible to properly display an image even by the liquid crystal whose response speed is low.

Moreover, it is also preferable that a divisional point of the frame be a point which allows each of the first sub-frame and the second sub-frame to minimize the difference between the actual brightness and the expected brightness (point which maximizes the luminance of the first display signal and minimizes the luminance of the second display signal).

Moreover, in the normal hold display, the difference between the actual brightness and the expected brightness is maximum when a frame is divided at a point where the ratio is from 1:3 to 1:7.

Therefore, by dividing a frame at a point where the difference is maximum in the normal hold display, the present display device can minimize the difference at this point.

Therefore, as compared with an arrangement carrying out the normal hold display, the difference in a single frame can be reduced so as to be roughly by half, so that it is possible to suppress the excess brightness phenomenon caused by the difference.

Note that, in case of carrying out the sub-frame display whose ratio of the period corresponding to the first sub-frame and the period corresponding to the second sub-frame is 1:n, it is preferable that the control section generate the first display signal and the second display signal in the following way.

That is, first, the control section calculates Lt represented by $$Lt=(1/(n+1))\hat{}(1/\gamma)\times L\max$$

in accordance with (i) the maximum luminance Lmax of an image displayed in a single frame and (ii) a predetermined value γ.

Next, the control section judges whether or not a frame gradation L, which is the luminance gradation of the display signal outputted in case of carrying out the normal hold display, is not more than Lt.

Then, in case where the frame gradation L is not more than Lt, the control section sets the luminance gradation F of the second display signal to be minimum (0), and sets the luminance gradation R of the first display signal so that $$R=(1/n+1))\hat{}(1/\gamma)\times L.$$

Further, in case where the frame gradation L is more than Lt, the control section sets the luminance gradation R of the first display signal to be maximum, and sets the luminance gradation F of the second display signal so that $$F=((L\hat{}\gamma-(1/n+1))\times L\max\hat{}\gamma))\hat{}(1/\gamma).$$

In this way, it is possible to easily generate the first and second display signals.

Moreover, as above, in case of carrying out the sub-frame display in which the ratio of the period corresponding to the first sub-frame and the period corresponding to the second sub-frame is 1:n, as for output operations of the display signals, for example, it is preferable that the first display signal and the second display signal obtained as above be alternately outputted to the display section with a difference of 1/(n+1) cycle. That is, in case of dividing a single frame at 1:n, it is preferable to alternately output the first and second display signals in each display line while keeping a divided time width.

The display signals are outputted in this way, so that it is possible to divide the frame at the ratio of 1:n even in case where n is any natural number.

Further, with this arrangement, an output frequency of the display signal can constantly be maintained at a doubled clock. Therefore, even in case where n is 2 or more, it is not necessary to multiply the output frequency by n+1, so that it is possible to carry out the sub-frame display at low cost.

Moreover, in the present display device, it is preferable that the display screen of the display section be composed of the liquid crystal panel. The excess brightness phenomenon described above can be seen conspicuously in the liquid crystal panel. Therefore, the sub-frame display of the present display device is especially effective in an arrangement having the display screen of the liquid crystal panel.

Moreover, the excess brightness phenomenon of the liquid crystal panel becomes conspicuous in case of the liquid crystal panel (for example, VA mode) whose display luminance becomes intense with an increase in the viewing angle. Therefore, the sub-frame display of the present display device is especially effective in an arrangement having the liquid crystal panel.

Moreover, in the sub-frame display of the present display device, the display signals are outputted at a doubled clock, so that it may not be effective when the response speed of the liquid crystal in the liquid crystal panel is low.

Therefore, it is preferable that the control section be designed so as to judge whether or not a liquid crystal response speed of the liquid crystal panel satisfies the following conditions (c) and (d), and so as to carry out the normal hold display in case where the liquid crystal response speed of the liquid crystal panel does not satisfy the following conditions (c) and (d).

(c) When a voltage signal is given to the liquid crystal, displaying an image having the minimum brightness (minimum luminance), in order to change the image having the minimum brightness into the image having the maximum brightness (maximum luminance), the voltage of the liquid crystal reaches a value not less than 90% of the voltage of the voltage signal in a period corresponding to the first sub-frame.

(d) When a voltage signal is given to the liquid crystal, displaying an image having the maximum brightness (maximum luminance), in order to change the image having the maximum brightness into the image having the minimum brightness (minimum luminance), the voltage of the liquid crystal reaches a value not more than 5% of the voltage of the voltage signal in a period corresponding to the first sub-frame.

Note that, the above-described voltage signal is a signal applied to the liquid crystal according to the display signal.

Moreover, in the normal hold display; it is preferable that the control section drive the liquid crystal panel by the alternating current. This is because, by driving the liquid crystal panel by the alternating current, it is possible to change the electric charge polarity (direction of the voltage (inter-electrode voltage) between the pixel electrodes sandwiching the liquid crystal) of the pixel per frame.

In case of a direct current drive, a biased voltage is applied between the electrodes, so that the electrodes are electrically charged. In case where this state is continued, a state in which the electric potential difference is generated between the electrodes (a state called "burning") occurs even when a voltage is not applied.

Here, in case of carrying out the sub-frame display like the present display device does, in many cases, values (absolute values) of a voltage applied between the pixel electrodes are different from each other between the sub-frames.

Therefore, in case of changing the polarity of the inter-electrode voltage at the sub-frame cycle, the voltage difference between the first sub-frame and the second sub-frame causes an applied inter-electrode voltage to be biased. On this account, in case of driving the liquid crystal panel for a long time, the electrodes are electrically charged, so that there is a possibility that the burning, flicker, or the like drawback occurs.

Therefore, in case of the present display device, it is preferable that the polarity of the inter-electrode voltage be changed at the frame cycle. This method is effective also in case of dividing a single frame into m number of sub-fields. Moreover, this method is effective also in case where a single frame is divided into two sub-fields and the division is carried out at 1:n.

Note that, there are two methods for changing the polarity of the inter-electrode voltage at the frame cycle.

One method is that the polarity of the voltage applied to the liquid crystal in the first sub-frame is the same as the polarity of the voltage applied to the liquid crystal in the second sub-frame (a single-polar voltage is applied to the liquid crystal in a single frame), but the polarity of the voltage applied to the liquid crystal in a frame is different from the polarity of the voltage applied to the liquid crystal in a frame adjacent to that frame.

Moreover, another method is that polarities of the voltage applied to the liquid crystal in two sub-frames of a single frame are differentiated from each other, and the polarities of the voltage applied to the liquid crystal are equalized with each other in the first sub-frame of a frame and in the second sub-frame of the other frame adjacent to the above-described first sub-frame.

As described above, even in case where the inter-electrode voltages are largely different from each other between the sub-frames, it is possible to prevent the burning and the flicker by alternating the inter-electrode voltage at the frame cycle.

Note that, in the present display device, the control section usually generates the display signals, inputted to the display section, by utilizing the image signal inputted from outside and a relation table indicative of a relationship between the image signal and the display signal.

Here, the above-described relation table is generally called LUT (look-up table).

Incidentally, the response property and the gradation luminance property of the display screen (display panel) such as the liquid crystal panel changes according to the environmental temperature (temperature (air temperature) of the environment surrounding the display section). On this account, an optimal display signal corresponding to the image signal also changes according to the environmental temperature.

Therefore, it is preferable to provide a plurality of relation tables (LUT) covering temperature ranges different from each other in the present display device.

Then, it is preferable that the control section be designed so as to select and use the relation table corresponding to the environmental temperature.

This arrangement makes it possible to send a more appropriate display signal, generated from the image signal, to the display section. Therefore, the image display can be carried out with appropriate luminance (brightness) in any temperature ranges assumable (for example, from 0° C. to 65° C.).

Moreover, in case where the display screen of the present display device is the liquid crystal panel, a combination of the present display device and the image signal input section makes it possible to constitute a liquid crystal monitor used for a personal computer, etc.

Here, the image signal input section conveys the image signal, inputted from outside, to the control section.

In this arrangement, the control section of the present display device generates the display signal and outputs it to the display section according to the image signal conveyed from the image signal input section.

Moreover, in case where the display screen of the present display device is the liquid crystal panel, a combination of the present display device and the tuner section makes it possible to constitute the liquid crystal television receiver.

Here, the tuner section selects a channel of a television broadcasting signal and conveys a television image signal of the channel thus selected to the control section.

In this arrangement, the control section of the present display device generates the display signal and outputs it to the display section according to the television image signal conveyed from the tuner section.

Moreover, a method of the present invention for displaying an image is a method of displaying an image by dividing a single frame into two sub-frames as first and second sub-frames, the method including an outputting step for generating a first display signal which is a display signal in a first sub-frame and a second display signal which is a display signal in a second sub-frame so that division of the frame does not vary a total luminance outputted from the display section in a single frame and for outputting the first and second display signals to the display section at a doubled clock, wherein the outputting step is such that:

a luminance gradation of the first display signal is adjusted and a luminance gradation of the second display signal is minimized in case of displaying an image whose brightness is low, and the luminance gradation of the first display signal is maximized and the luminance gradation of the second display signal is adjusted in case of displaying an image whose brightness is high, and the frame is divided so that a ratio of a period corresponding to the first sub-frame and a period corresponding to the second sub-frame is 1:n where n is a natural number not less than 1.

Moreover, it is preferable that the above-described n be 1 or 2, or an integer ranging from 3 to 7.

The present display method is used in the above-described present display device.

Therefore, in the present display method, as compared with an arrangement carrying out the normal hold display, the difference in a single frame can be reduced so as to be roughly by half, so that it is possible to suppress the excess brightness phenomenon caused by the difference.

Moreover, the display program of the present invention causes a computer provided with the display section including the display screen (for example, the liquid crystal panel) to carry out the outputting step of the present display method.

The above-described computer reads the program so as to carry out the outputting step of the present display method.

Moreover, the program is recorded in a recording medium readable by a computer, so that the program can be easily saved and distributed.

Further, the present invention can be described also as a hold-type image display device having a viewing angle property, e.g., a liquid crystal display device which improves variation of a gradation γ property which varies depending on a viewing angle. Further, the present display device can be described also as a display device which displays an image corresponding to a single frame period in accordance with a total luminance obtained by carrying out time integration with respect to luminances in two (former and latter) sub-frame periods, and splits a luminance of a VA (vertical alignment) mode liquid crystal panel divided into some domains so that one of the sub-frames causes a minimum (black display) luminance or a maximum (white display) luminance, and outputs a rest of the luminance in the other sub-frame.

Further, operations of the present display device can be described also as follows. That is, an RGB data signal (image signal) sent at a normal clock cycle, e.g., 25 MHz is accumulated in a frame memory (F.M.) 11. The data accumulated in the frame memory is outputted from the frame memory at a clock whose frequency is twice as high as a normal clock cycle. Thus outputted RGB data is converted into former sub-frame data (former stage display signal) and latter sub-frame data (latter stage display signal) on the basis of an LUT (look-up table), and an output to a panel (display section) is converted in the former and latter sub-frames, so as to cause the panel to display the output at a CLK (clock) frequency which is twice as high as a normal clock cycle.

Further, in case of converting an image signal in two sub-frames, it is necessary to convert a display frequency so that its speed is doubled. However, in the present display device, data is accumulated in the frame memory, and the data is read out at a doubled frequency, so that a data signal is converted into a doubled frequency, and the data whose frequency has been doubled is outputted twice, and the data are converted into the former sub-frame data and the latter sub-frame data in accordance with the LUT.

Further, a condition of an actual panel is not simply expressed by a conversion equation like the equation (1), and a luminance exists even in case where the gradation is 0. Moreover, in case of a liquid crystal panel, there is a limited response time taken to reach the luminance. Thus, these factors are taken into consideration in the sub-frame conversion, so that it is preferable to carry out the conversion after actually measuring the value.

Further, operations in case of dividing a single frame into sub-frames not equally but at 1:3 can be described also as follows. That is, the image signal (RGB) data is inputted to the frame memory. The data is read out from the frame memory at a doubled clock frequency. FIG. 4 illustrates a relationship between input data and output data in the frame memory. As illustrated in FIG. 4, a timing at which data of the former sub-frame is read and a timing at which data of the latter sub-frame is read are deviated from each other, thereby changing a ratio of display periods corresponding to the sub-frames. FIG. 5 illustrates a gate timing in case where the ratio is 1:3. In accordance with a total luminance obtained by carrying out integration with respect to the two sub-frames, the frame luminance is obtained. In the same manner as this, it is possible to carry out the two-division display not only at 1:3 but also at any ratio.

Further, a human visual sense property is not linear with respect to a luminance, but is represented by a psychometric lightness M and is expressed by equations (5) and (6) (see Document 8). That is, it is more preferable to carry out the division at an intermediate value of a psychometric lightness than to carry out the division at an intermediate value of the luminance because such division improves the deviation of the γ value in viewing from a diagonal direction. In an image display device, a gradation luminance signal is converted into a luminance in accordance with a gradation luminance property like the equation (1) as approximation of the psychometric lightness so as to carry out the display, and a value within a range from 2.2 to 3 is often used as γ.

Thus, it is preferable to carry out the division at an intermediate value of a gradation corresponding to γ, and its value is within a range from 1:3 to 1:7 as a time ratio. In case where a display period ratio is set so that the former sub-frame is 3 and the latter sub-frame is 1 in a single frame as a period ratio, a minimum luminance is obtained in the former sub-frame or a maximum luminance is obtained in the latter sub-frame, so as to carry out the gradation luminance display of a frame display luminance in accordance with a total luminance obtained by carrying out integration thereof. In this case, an output in the former sub-frame is a minimum output (0) until the output reaches a certain threshold gradation output. In case where the output exceeds the threshold gradation output, an output in the latter sub-frame is a maximum output (output of 255 in case of 8 bits). The threshold gradation Lt is expressed by the equation (7) on the basis of the equation (1).

In case where the output gradation value (frame gradation) L is not more than Lt, an output gradation value in the former sub-frame is converted into a minimum output (0) in accordance with the LUT, and an output gradation value (luminance gradation) R in the latter sub-frame is expressed by the equation (8). In case where the output gradation value L is not less than Lt, an output gradation value (luminance gradation) F in the former sub-frame is set as expressed by the equation (9) in accordance with the LUT, and a value in the latter sub-frame is converted into a maximum output (output of 255 in case of 8-bit output), so as to output thus converted value. However, in an actual display device described above, the gradation luminance property does not necessarily correspond to the equation (1), so that it is necessary to determine a conversion value by actually measuring the value.

Further, a response property and a gradation luminance property of a liquid crystal panel vary, so that it is possible to exactly express a luminance by varying a value in each of LUTs which respectively cover temperatures (FIG. 8 shows a block diagram in case where three LUTs are prepared). Moreover, in order that a gradation voltage can be finely set, it is preferable to determine an output voltage by setting a driver output for division driving. In a driver for driving a liquid crystal panel, the output voltage is set so that a luminance of the liquid crystal panel is γ=2.2 with respect to the gradation data. Thus, it may be impossible to obtain an output corresponding to the γ property merely by adding the gradation data when the division driving is carried out. In case of carrying out the sub-frame driving, it is preferable to output a gradation which has been obtained by carrying out conversion into a divided luminance. Thus, an output voltage value of a driver which has been set in a single-frame hold state sometimes fails to sufficiently carry out the gradation expression, so that it is preferable to use a driver in which a voltage for division driving is set.

Further, the following description explains a reason for which it is possible to further improve the excess brightness by dividing a frame at a ratio ranging from 1:3 to 1:7. That is, the excess brightness is a condition under which: an output luminance of each gradation has a property illustrated in FIG. 2 when viewed from a diagonal direction with respect to its front surface, so that the image seems pale. A human visual sense has properties illustrated in the equations (5) and (6) with respect to a luminance, and is likely to be sensitive to a dark image in terms of the luminance, and is likely not to be sensitive to a bright image in terms of the luminance. Thus, a video signal (image signal) is made into a gradation signal as follows: a luminance is multiplied by γ=2.2 and thus obtained value is evenly divided, thereby realizing a value close to the human visual sense property (when the equations (5) and (6) are approximated to each other, γ (α of the equation (6a) is about 2.5)).

In case of generating videos as a TV set, visually impressive videos may be displayed by carrying out processes such as increasing the value of γ with respect to the signal (further visualization), canceling black/white signals, etc. Thus displayed videos look impressive, and seem to be visually very sharp. That is, it seems that the human visual sense recognizes the excess brightness not by the luminance but by M obtained by the equations (5) and (6). It seems that the human visual sense recognizes the excess brightness by the value multiplied by a (close to the equations (5) and (6)). Therefore, in order to make the display state correspond to the human visual sense, it is preferable to carry out the division at 50% in terms of the brightness so as to obtain further improvement.

In approximating the equations (5) and (6) to the equation (6a) similar to the equation (1), approximation is carried out so that α=2.2 to 3 (about 2.4). As to the division carried out so that a value obtained by the α conversion is 50%, its divisional ratio is 1:3 when α=2.2, and is 1:7 when α=3.0. Thus, it is considered to be preferable that the divisional ratio ranges from 1:3 to 1:7. That is, in case of actually applying the equations (5) and (6) to a TV or a display, when the luminance (output) is Y, the equations are simplified as the equation (6a). Here, Y is a display luminance (output) of the display. The value α is a value within a range from 2.2 to 3. When the value α is 2.2, the divisional ratio is about 1:3. When the value α is 3, the divisional ratio is 1:7.

Thus, it is most preferable to carry out the division at a ratio ranging from 1:3 to 1:7 as compared with the even division. Note that, there is no strict meaning in the values 2.2 and 3, but they are regarded as values which are substantially suitable for the human sense. Therefore, it is considered to be appropriate to carry out the division so that the brightness within a range from 2.2 and 3 is 50%. Note that, even in case where the division is carried out otherwise, for example, even in case where the even division is carried out, it is possible to obtain a sufficient effect.

Moreover, in case of dividing a frame at 1:n, as a method for carrying out time division, there is adopted a method in which: the number of sub-frames is increased, and division is carried out at a ratio of output corresponding to a total number of the sub-frames (a method in which: when carrying out the division at 1:n, a frame is divided into n+1 sub-frames so as to output in a single sub-frame and n sub-frames separately). However, according to this method, a frequency in data transfer and the like becomes high, so that it is difficult to realize the arrangement as an actual product. Therefore, it is preferable to realize the ratio of the time division by changing a ratio of a gate timing of the liquid crystal panel.

An image output of an active matrix (TFT) liquid crystal panel whose number of pixels is a×b is carried out as follows: data sets whose number is "a" (corresponding to a single line) are stored in a source, and the data corresponding to a single line is written at an output timing of a gate, and pixel data is changed, and data are line-sequentially written in a first line to a b-th line, so as to rewrite data of a single image. In order to write data in the pixel twice in a single frame period on the basis of time-division driving, data is transferred at a doubled frequency so as to reduce a gate-ON period by half, and data of the first line to the b-th line is written in a half frame period, and writing is carried out with respect to the first to b-th lines.

In case of sequentially turning ON gates of the first to b-th lines in this manner, data written in the pixel is outputted equally in a former half and a latter half of a single frame period. That is, the output of the pixel is even in terms of time. This is because the gate is turned ON in a half of a single period. Thus, it is possible to change the divisional ratio by changing the gate-ON timing for the output data unlike the aforementioned even division.

Further, in order to carry out the division at 1:3, as illustrated in FIG. 5, input is carried out in a former half sub-frame so as to turn ON the gate, and the gate is turned ON in ¾ frame period, and output is carried out in a latter half sub-frame. Data is outputted in the former sub-frame of ¾th line so as to turn ON the gate, and the gate is turned ON in response to the outputted data in a latter half sub-frame of a first line, and the gate is turned ON so as to output data in the ¾+1th line, and the gate is turned ON in a latter half sub-frame of a second line.

In this manner, it is possible to change a ratio of an output period by alternately and sequentially turning gates ON after each ¾ frame. Of course, data accumulated in the frame memory is outputted while corresponding to a gate timing.

Further, the polarity reverse method illustrated in FIG. 25 can be described also as "the polarity is alternately reversed among three sub-frames and the polarity is reversed in the next three frames with it being an opposite polarity".

Further, the present invention can be described also as the following first to twelfth image display devices. That is, a first image display device divides a display period of a single frame into m number of sub-frames, wherein a total luminance obtained by integrating luminances of the m number of sub-frames corresponds to a luminance of a single frame, and the integrated luminance of the m sub-frames is set so as to divide a luminance of the sub-frame so that a total luminance in the m sub-frames in case where an image is viewed from a diagonal direction less deviates from a front luminance in case where a display is carried out in a single frame. On this account, the excess brightness phenomenon which occurs when viewed from a diagonal direction is suppressed, so that it is possible to improve variation in the gradation γ property which varies depending on a viewing angle (the excess brightness phenomenon in a diagonal direction is improved by carrying out the division) in a hold-type liquid crystal display device having a viewing angle property, for example, in a liquid crystal display device using liquid crystal.

Further, a second image display device is based on the first image display device and is arranged so that: in case of a panel whose gradation luminance property in a diagonal direction is a property illustrated in FIG. 3, a display period of a single frame is divided into m number of sub-frames, a total luminance of the m sub-frames corresponds to a luminance of a single frame, and all the luminances of the m sub-frames of a single frame are minimum or maximum except for one sub-frame. On this account, it is possible to minimize (0) or maximize a difference between the front luminance and the luminance in a diagonal direction, so that the deviation from the front surface corresponds to only a single sub-frame, and the excess brightness when viewed from a diagonal direction is suppressed to be 1/n times, thereby improving variation of the gradation γ property which varies depending on a viewing angle (the deviation from the front surface in terms of the maximum luminance and the minimum luminance is 0, so that it is possible to reduce the deviation from the front surface in terms of integrated luminance in a single frame by using the luminance in the sub-frame) in a hold-type liquid crystal display device having a viewing angle property, for example, in a liquid crystal display device using liquid crystal.

Further, a third image display device is based on the first image display device and is arranged so that: a display time of a single frame is divided into two sub-frames, and a total obtained by integrating luminances of the two sub-frames corresponds to a luminance of a single frame. A single frame is divided into two sub-frames, so that a viewing angle property is improved, and a luminance ratio of the two sub-frames is determined so that a γ property when viewed from a diagonal direction is improved as in the front surface.

For example, in case of using a VA mode panel whose gradation γ property viewed from a diagonal direction deviates as illustrated in FIG. 2, the deviation from the property in the front surface is 0 when the gradation, luminance is minimum or maximum, that is, the deviation is least. By combining the case of the minimum luminance with the case of the maximum luminance, it is possible to reduce the deviation from the front surface in terms of the γ property.

Thus, the luminance is distributed so that the luminance is minimum (black) or maximum (white) in either of the sub-frames, so that the deviation in the single sub-frame is 0. Thus, the difference between the front gradation integration luminance and the gradation luminance integration in a diagonal direction is ½. As a result, the gradation luminance γ property in a diagonal direction is improved as illustrated in FIG. 3, so that it is possible to improve variation of the gradation γ property which varies depending on a viewing angle (the divisional number is 2, so that the circuit is simplified, thereby improving the excess brightness) in a hold-type liquid crystal display device having a viewing angle property, for example, in a liquid crystal display device using liquid crystal.

Further, a fourth image display device is based on the first image display device and is arranged so that: in case where a display time in a single frame is divided into two sub-frames and a former period and a latter period are different from each other in the time distribution, a total of integrated luminance in the two sub-frames is a luminance in a single frame, and the division is carried out at such a ratio that the integrated luminance in the two sub-frames is smaller than the deviation from the front luminance in case of carrying out single-frame display, and the division is carried out so that a luminance in a shorter sub-frame period is maximum or a luminance in a longer sub-frame period is minimum.

Further, the time division is carried out as follows: when a gradation luminance γ property of a gradation luminance in a single frame in case where a luminance in a shorter sub-frame period is maximum and a longer sub-frame period is minimum ranges from 2.2 to 3, the gradation is not more than an intermediate gradation (128 in case of 255 gradation at maximum). Thus, it is possible to further suppress the deviation of the gradation luminance in the black side in a diagonal direction than in case of evenly carrying out the time division, thereby improving the deviation so as to be suitable for the human visual sense (by unevenly dividing a frame period into two sub-frame periods, it is possible to realize a combination which reduces the deviation).

Further, a fifth image display device is based on the fourth image display device and is arranged so that: a period ratio of the sub-frames is within a ratio ranging from 1:3 to 1:7. In this manner, a ratio of the two sub-frames ranges from 1:3 to 1:7, so that it is possible to improve the excess brightness by carrying out the division suitable for the visual sense property.

Further, a sixth image display device is based on any one of the first to fifth image display devices and is arranged so that: the image display device uses a vertical mode (VA) panel in which a gradation property viewed from a diagonal direction shifts from a front luminance gradation gammer property due to the angle. Thus, the excess brightness is likely to occur in a diagonal direction in the VA (MVA) mode panel, so that this results in a remarkable effect.

Further, a seventh image display device is based on any one of the first to fifth image display devices and is arranged so that: the image display device uses a normally black (NB) panel in which a gradation property viewed from a diagonal direction shifts from a front luminance gradation γ property due to the angle.

Further, an eighth image display device is based on any one of the first to fifth image display devices and is a liquid crystal television using a liquid crystal panel in which a gradation property viewed from a diagonal direction shifts from a front luminance gradation γ property to the bright side in all the gradations when the angle varies.

Further, a ninth image display device is based on any one of the first to eighth image display devices and is arranged so that: the luminance distribution in the sub-frames is varied depending on a temperature, and in case where response of liquid crystal in a low temperature does not reach a targeted luminance (95% for example) within the sub-frames, a luminance difference between the sub-frames is reduced, and the division is carried out so as to realize a luminance ratio which allows the liquid crystal to respond with respect to the targeted luminance within the sub-frame period, and the division is adjusted so as to maintain the gradation luminance γ property in the front surface.

Further, in case where the liquid crystal response time is not less than a single frame, the division is carried out so that variation of the liquid crystal response is reduced between the sub-frames, and the division of the sub-frame is adjusted so that the gradation luminance γ property is not varied by a temperature also in the front gradation γ property, so that it is possible to obtain a gradation property corresponding to an environmental temperature even in case where the liquid crystal response speed is varied by variation of the environmental temperature for example, thereby improving variation of the gradation γ property which varies due to the viewing angle (in case where the liquid crystal response is slow, the luminance cannot reach the maximum luminance and the minimum luminance in the sub-frame period, so that the excess brightness is less improved unless at least the response property satisfies the foregoing condition) in a hold-type liquid crystal display device having a viewing angle property, for example, in a liquid crystal display device using liquid crystal.

Further, a tenth image display device is based on any one of the first to ninth image display devices and is a TFT liquid crystal driving device, dividing a single frame into two sub-frames so as to drive the device, wherein polarities of a voltage applied to a pixel are the same in a single frame, or the polarities of the voltage applied to the pixel are different from each other in a single frame, and the polarities of the applied voltage are the same in a latter sub-frame of a former frame and a former sub-frame of a display frame.

Thus, the polarities of the applied voltage are uneven, and flicker and burning are prevented, so that it is possible to improve variation of the gradation γ property which varies depending on a viewing angle (the polarity is reversed as described above, so that burning and flicker are reduced) in a hold-type liquid crystal display device having a viewing angle property, for example, in a liquid crystal display device using liquid crystal.

Further, an eleventh image display device is based on any one of the first to ninth image display devices and is an image display device, dividing one frame into two sub-frames, whose total of integration of the sub-frame luminances is a gradation luminance in a single frame, wherein polarities of a voltage applied to a pixel in a sub-frame of the frame are different from each other, and the polarities of the voltage are the same in a latter sub-frame of a former frame and in a former sub-frame of a next frame. Thus, the polarity is reversed, so that burning and flicker are reduced.

Further, a twelfth image display device is based on any one of the first to eleventh image display devices and the image display device is a liquid crystal display device.

Further, a thirteenth image display device is arranged so that: in case where a liquid crystal panel is made to respond so that white (maximum luminance)-black (minimum luminance), the luminance reaches a white state (maximum brightness) at a luminance ratio of 90% under such condition that white is 100% and black is 0% within a sub-frame period, and a driving method of the first to fifth image display devices is used only in case where the luminance reaches a black state at a luminance ratio of 5%, and a sub-frame luminance within a single frame is evenly distributed in case where, for example, temperature variation in the same panel causes the response property deviates from the foregoing range.

Further, a driving method of the first image display device is a driving method used in any one of the first to twelfth image display devices.

Further, as to the arrangement concerning the twelfth image display device, there are provided some LUTs corresponding to temperature ranges as illustrated in FIG. 8, so that it is possible to cover all the temperature ranges (from 0° C. to 65° C.). Moreover, in case where the excess brightness is more emphasized in carrying out the time-division driving than in carrying out the normal driving (in case where the response speed is lower), sub-frame outputs subjected to the time division are equalized in former and latter sub-frames, thereby equalizing a magnitude of the excess brightness to that in the normal driving.

That is, the fig liquid crystal panel in the normal hold mode is arranged so that a single liquid crystal state is established with respect to a certain gradation. Therefore, the liquid crystal response property has no relation with an output gradation. However, in case of carrying out the lime-division driving (even division into two) of the present invention, a halftone display (in case of such an output that 0 in the former sub-frame and 255 (maximum) in the latter sub-frame is as illustrated in FIG. 10(*a*), and the liquid crystal has a response property, so that an output is as illustrated by a black thick line of FIG. 10(*b*).

As a condition for improving the excess brightness, it is preferable that either of the two sub-frames is black (minimum luminance) or white (maximum luminance). However, in the halftone display when the liquid crystal response is slow, the condition is as illustrated in FIG. 10(*c*), so that it is impossible to output black (minimum luminance) and white (maximum luminance) in the sub-frame. Since it is impossible to respond, the output luminance departs from black or white, and the output display seems uneven when viewed from a diagonal direction as illustrated in FIG. 11. In order to suppress the unevenness, it is preferable that the response exceeds a certain level (thirteenth image display device).

Further, according to the present invention, in case where a viewing angle property in a diagonal direction is a gradation luminance property as illustrated in Fig. a like a VA mode panel, one frame is divided into two sub-frames, and a total of integration of luminances in the sub-frames is a luminance in a single frame, and the division is carried out so that luminance gradation properties in all the sub-frames except for one sub-frame are minimum (black) or maximum (white) so as to be the same as that in the front surface, so that a value of the deviation is divided by the number of the sub-frames. As a result, the gradation luminance in a diagonal direction is closer to the front gradation luminance property, thereby improving the deviation which occurs in an image due to a viewing angle.

Moreover, variation of the liquid crystal response time due to the temperature variation causes the γ property to vary, and such condition is varied by adjusting the luminance ratio between the sub-frames, thereby obtaining a gradation property corresponding to the temperature. Further, polarities of a voltage applied to the pixel are equalized with each other, or polarities of a sub-frame voltage are different from each other in a frame and polarities of the voltage are the same in a latter sub-frame of a former frame and in a former frame of a display frame, so that a polarity ratio (positive and negative) of the applied voltage are even, thereby preventing burning and flicker in carrying out the sub-frame division driving.

It should be understood that various aspects of various embodiments of the present invention may be combined in various ways. Each of these combinations are within the scope of the present invention. For example, one such combination may include a display driving method, comprising supplying an image signal of a gradation level; and displaying the image signal at the supplied gradation level, wherein a frame of the image signal is supplied in a plurality of sub-frames, and wherein at least two of the sub-frames include periods of different lengths.

Another such combination may include an apparatus for displaying an image of an image signal, comprising a control section, adapted to supply a gradation level of the image signal; and a display section, adapted to display the image signal at the supplied gradation level, wherein a frame of the image signal is supplied in a plurality of sub-frames, and wherein a period of at least two of the sub-frames different from one another.

Yet another such combination may include a display driving method, comprising supplying an image signal of a gradation level, wherein a frame of the image signal is divided into a plurality of sub-frames, the periods of at least two of the sub-frames being different from one another; reversing a polarity of the supplied image signal at a frame cycle; and displaying the image signal at the supplied gradation level, inclusive of any polarity reversal.

Still another such combination may include an apparatus for displaying an image of an image signal, comprising a control section, adapted to supply a gradation level of the image signal, wherein a frame of the image signal is divided into a plurality of sub-frames, the periods of at least two of the sub-frames being different from one another; and a display section, adapted to reverse a polarity of the supplied image signal at each frame cycle and adapted to display the image signal at the supplied gradation level, inclusive of any polarity reversal.

A further combination may include a display driving method, comprising supplying an image signal of a gradation level, wherein a frame of the image signal is divided into a plurality of sub-frames; and displaying the image signal, at the supplied gradation level, on an image display section including an arrangement of sub-pixels including at least two sub-pixels for each display pixel, wherein a phase of a supplemental signal is varied in conjunction with a polarity of the image signal, and wherein the phase is varied and the polarity is reversed at each frame cycle.

An even further combination may include an apparatus for displaying an image of an image signal, comprising a control section, adapted to supply a gradation level of the image signal, wherein a frame of the image signal is divided into a plurality of sub-frames; and a display section, adapted to display the image signal, at the supplied gradation level, the image display section including an arrangement of sub-pixels including at least two sub-pixels for each display pixel, wherein a phase of a supplemental supplied signal is varied in conjunction with a polarity of the supplied image signal, and wherein the phase is varied and the polarity is reversed at each frame cycle.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display device, dividing a single frame into m number of sub-frames, where m is an integer not less than 2, so as to display an image, said display device comprising:

a display section for displaying an image whose luminance is based on a luminance gradation of a display signal; and a control section for generating first to m-th display signals in first to m-th sub-frames so that division of the frame does not vary a total luminance outputted from the display section in a single frame and for outputting the first to m-th display signals to the display section, wherein the first to m-th display signals include (i) a display signal whose luminance gradation is adjusted to any of a minimum value, a value smaller than a first value, a maximum value, and a value larger than a second value, the second value being relatively larger than the first value and (ii) a display signal whose luminance gradation is adjusted to a value other than the minimum value, the value smaller than the first value, the maximum value, and the value larger than the second value, the display section is set to cause a liquid crystal panel to display an image, and the control section is designed to vary a polarity of a voltage applied to liquid crystal at a sub-frame cycle within a same frame cycle.

2. A liquid crystal monitor, comprising:

the display device, as set forth in claim 1, whose display section is a liquid crystal panel; and a signal input section for conveying an image signal to the control section, wherein the control section of the display device is designed to generate the display signal in accordance with the image signal.

3. A liquid crystal television receiver, comprising:

the display device, as set forth in claim 1, whose display section is a liquid crystal panel; and a tuner section for selecting a channel of a television broadcasting signal to convey a television image signal of the channel thus selected to the control section, wherein the control section of the display device is designed to generate the display signal in accordance with the television image signal.

4. A method of displaying an image by dividing a single frame into m number of sub-frames where m is an integer not less than 2, said method comprising an outputting step for generating first to m-th display signals in first to m-th sub-frames so that division of the frame does not vary a total luminance outputted from the display section in a single frame and for outputting the first to m-th display signals to the display section, wherein the first to m-th display signals include (i) a display signal whose luminance gradation is adjusted to any of a minimum value, a value smaller than a first value, a maximum value, and a value larger than a second value, the second value being relatively larger than the first value and (ii) a display signal whose luminance gradation is adjusted to a value other than the minimum value, the value smaller than the first value, the maximum value, and the value larger than the second value, the display section is set so as to cause a liquid crystal panel to display an image, and the outputting step is such that a polarity of a voltage applied to liquid crystal is varied at a sub-frame cycle within a same frame cycle.

5. A display driving method, comprising:

supplying an image signal of a gradation level, wherein a frame of the image signal is divided into a plurality of sub-frames, the periods of at least two of the sub-frames being different from one another; and reversing a polarity of the supplied image signal at a sub-frame cycle within a same frame cycle; and displaying the image signal at the supplied gradation level, inclusive of any polarity reversal, wherein the plurality of sub-frames include (i) a sub-frame of a gradation level of any of a minimum value, a value smaller than a first value, a maximum value, and a value larger than a second value, the second value being relatively larger than the first value and (ii) a sub-frame of a gradation level other than the minimum value, the value smaller than the first value, the maximum value, and the value larger than the second value.

6. The display driving method of claim 5, wherein the image signal is displayed on an LCD display device.

7. The display driving method of claim 6, wherein the plurality of sub-frames include a sub-frame of a gradation level of the maximum value or the value larger than the second value, and a sub-frame of a gradation level of the minimum value or the value smaller than the first value.

8. The display driving method of claim 5, wherein the plurality of sub-frames include a sub-frame of a gradation level of the maximum value or the value larger than the second value, and a sub-frame of a gradation level of the minimum value or the value smaller than the first value.

9. The display driving method of claim 5, wherein the display driving method is used in a pixel divisional driving system including at least two sub-pixels for each display pixel.

10. The display driving method of claim 9, wherein one of the sub-pixels is a relatively dark sub-pixel and wherein one of the sub-pixels is a relatively bright sub-pixel.

11. An apparatus for displaying an image of an image signal, comprising:

a control section, adapted to supply a gradation level of the image signal, wherein a frame of the image signal is divided into a plurality of sub-frames, the periods of at least two of the sub-frames being different from one another; and a display section, adapted to reverse a polarity of the supplied image signal at a sub-frame cycle within a same frame cycle, and adapted to display the image signal at the supplied gradation level, inclusive of any polarity reversal, wherein the plurality of sub-frames include (i) a sub-frame of any of a gradation level of a minimum value, a value smaller than a first value, a maximum value, and a value larger than a second value, the second value being relatively larger than the first value and (ii) a sub-frame of a gradation level other than the minimum value, the value smaller than the first value, the maximum value, and the value larger than the second value.

12. The apparatus of claim 11, wherein the display section includes an LCD display device.

13. The apparatus of claim 12, wherein the plurality of sub-frames include a sub-frame of a gradation level of the -maximum value or the value larger than the second value, and a sub-frame of a gradation level of the minimum value or the value smaller than the first value.

14. The apparatus of claim 13, wherein the display section includes an arrangement of sub-pixels, including at least two sub-pixels for each display pixel.

15. The apparatus of claim 14, wherein one of the sub-pixels is a relatively dark sub-pixel and wherein one of the sub-pixels is a relatively bright sub-pixel.

16. The apparatus of claim 11, wherein the plurality of sub-frames include a sub-frame of a gradation level of the maximum value or the value larger than the second value, and a sub-frame of a gradation level of the minimum value or the value smaller than the first value.

17. A display driving method, comprising:

supplying an image signal of a gradation level, wherein a frame of the image signal is divided into a plurality of sub-frames; and displaying the image signal, at the supplied gradation level, on an image display section including an arrangement of sub-pixels including at least two sub-pixels for each display pixel, wherein a phase of a supplemental signal is varied in conjunction with a polarity of the image signal, and wherein the phase is varied and the polarity is reversed at a sub-frame cycle within a same frame cycle, wherein the plurality of sub-frames include (i) a sub-frame of any of a gradation level of a minimum value, a value smaller than a first value, a maximum value, and a value larger than a second value, the second value being relatively larger than the first value and (ii) a sub-frame of a gradation level other than the minimum value, the value smaller than the first value, the maximum value, and the value larger than the second value.

18. The display driving method of claim 17, wherein the image signal is displayed on an LCD display device.

19. The display driving method of claim 18, wherein the plurality of sub-frames include a sub-frame of a gradation level of the maximum value or the value larger than the second value, and a sub-frame of a gradation level of the minimum value or the value smaller than the first value.

20. The display driving method of claim 17, wherein the plurality of sub-frames include a sub-frame of a gradation level of the maximum value or the value larger than the second value, and a sub-frame of a gradation level of the minimum value or the value smaller than the first value.

21. The display driving method of claim 17, wherein one of the sub-pixels is a relatively dark sub-pixel and wherein one of the sub-pixels is a relatively bright sub-pixel.

22. The display driving method of claim 17, wherein the periods of at least two of the sub-frames are different from one another.

23. An apparatus for displaying an image of an image signal, comprising:

a control section, adapted to supply a gradation level of the image signal, wherein a frame of the image signal is divided into a plurality of sub-frames; and a display section, adapted to display the image signal, at the supplied gradation level, the image display section including an arrangement of sub-pixels including at least two sub-pixels for each display pixel, wherein a phase of a supplemental supplied signal is varied in conjunction with a polarity of the supplied image signal, and wherein the phase is varied and the polarity is reversed at a sub-frame cycle within a same frame cycle, wherein the plurality of sub-frames include (i) a sub-frame of any of a gradation level of a minimum value, a value smaller than a first value, a maximum value, and a value larger than a second value, the second value being relatively larger than the first value and (ii) a sub-frame of a gradation level other than the minimum value, the value smaller than the first value, the maximum value, and the value larger than the second value.

24. The apparatus of claim 23, wherein the display section includes an LCD display device.

25. The apparatus of claim 24, wherein the plurality of sub-frames include a sub-frame of a gradation level of the maximum value or the value larger than the second value, and a sub-frame of a gradation level of the minimum value or the value smaller than the first value.

26. The apparatus of claim 23, wherein the plurality of sub-frames include a sub-frame of a gradation level of the maximum value or the value larger than the second value, and a sub-frame of a gradation level of the minimum value or the value smaller than the first value.

27. The apparatus of claim 23, wherein one of the sub-pixels is a relatively dark sub-pixel and wherein one of the sub-pixels is a relatively bright sub-pixel.

28. The apparatus of claim 23, wherein the periods of at least two of the sub-frames are different from one another.

* * * * *